US009988210B2

(12) United States Patent
Buck

(10) Patent No.: US 9,988,210 B2
(45) Date of Patent: Jun. 5, 2018

(54) BIN

(71) Applicant: Thomas K. Buck, Pasadena, CA (US)

(72) Inventor: Thomas K. Buck, Pasadena, CA (US)

( * ) Notice: Subject to any disclaimer, the term of this patent is extended or adjusted under 35 U.S.C. 154(b) by 706 days.

(21) Appl. No.: 14/490,626

(22) Filed: Sep. 18, 2014

(65) Prior Publication Data

US 2015/0076152 A1 Mar. 19, 2015

Related U.S. Application Data

(60) Provisional application No. 61/879,528, filed on Sep. 18, 2013.

(51) Int. Cl.

| | |
|---|---|
| ***B65F 1/06*** | (2006.01) |
| ***B65F 1/02*** | (2006.01) |
| ***B65F 1/16*** | (2006.01) |
| *B65F 1/14* | (2006.01) |

(52) U.S. Cl.

CPC ..... *B65F 1/06* (2013.01); *B65F 1/02* (2013.01); *B65F 1/16* (2013.01); *B65F 1/1484* (2013.01); *B65F 1/1615* (2013.01); *B65F 2210/112* (2013.01); *B65F 2210/1123* (2013.01); *B65F 2210/1125* (2013.01); *B65F 2210/1126* (2013.01); *B65F 2210/1128* (2013.01); *B65F 2220/12* (2013.01)

(58) Field of Classification Search

CPC ..... B65D 7/20; B65F 1/02; B65F 1/06; B65F 1/1484; B65F 1/16; B65F 1/1615; B65F 2210/112; B65F 2210/1123; B65F 2210/1125; B65F 2210/1126; B65F 2210/1128; B65F 2220/12

USPC ..... 206/459.1, 459.6; 220/495.08, 908, 220/908.1

See application file for complete search history.

(56) References Cited

U.S. PATENT DOCUMENTS

| | | | | |
|---|---|---|---|---|
| 3,779,419 | A | 12/1973 | Heitz | |
| 4,238,033 | A | 12/1980 | Artzt | |
| 4,362,244 | A | 12/1982 | Cornou | |
| 4,630,752 | A | 12/1986 | DeMars | |
| 4,753,367 | A | 6/1988 | Miller et al. | |
| 4,765,579 | A | 8/1988 | Robbins, III et al. | |
| 4,867,340 | A * | 9/1989 | Byers | B65F 1/06 206/813 |
| 5,190,252 | A | 3/1993 | Schrager | |

(Continued)

OTHER PUBLICATIONS

International Search Report and Written Opinion for PCT Application No. PCT/US2014/056405; dated Mar. 12, 2015, 15 pages.

*Primary Examiner* — James N Smalley
*Assistant Examiner* — Madison L Poos
(74) *Attorney, Agent, or Firm* — Lewis Roca Rothgerber Christie LLP

(57) ABSTRACT

A bin for receiving or storing one or more items. The bin includes a wall having an upper end and a lower end, and a bottom extending along the lower end of the wall. The wall and the bottom cooperate to define a chamber for receiving or storing one or more items. The bin also includes mouth at the upper end of the wall that is in communication with the chamber. The bin further includes a rim extending around a periphery of the mouth. The bin also includes content information on at least a portion of an exterior surface of the rim that is configured to identify the one or more items the bin is intended to receive or store.

51 Claims, 66 Drawing Sheets

(56) References Cited

U.S. PATENT DOCUMENTS

| | | | | |
|---|---|---|---|---|
| 5,476,187 | A | 12/1995 | Marisco | |
| 5,556,063 | A | 9/1996 | Boyd | |
| 5,626,240 | A | 5/1997 | Friedrichs et al. | |
| 5,662,238 | A | 9/1997 | Sarno | |
| 5,803,300 | A | 9/1998 | DeMars | |
| 5,816,431 | A | 10/1998 | Giannopoulos | |
| 5,971,194 | A | 10/1999 | Freedland | |
| 6,170,144 | B1 * | 1/2001 | Phillipson | A01G 9/021 29/453 |
| 6,250,492 | B1 | 6/2001 | Verbeek | |
| 7,204,407 | B2 | 4/2007 | Laher | |
| 7,252,207 | B2 | 8/2007 | Liao | |
| 2004/0206759 | A1 * | 10/2004 | Busch | B65F 1/1615 220/315 |
| 2005/0081416 | A1 | 4/2005 | Morris | |
| 2007/0202751 | A1 * | 8/2007 | Wentz | B65F 1/06 439/675 |
| 2009/0107998 | A1 * | 4/2009 | Meissen | B65D 21/0233 220/254.3 |
| 2009/0261105 | A1 | 10/2009 | Cunningham et al. | |
| 2012/0181282 | A1 | 7/2012 | Heller et al. | |

* cited by examiner

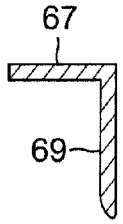
FIG. 7H1
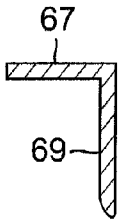
FIG. 7H2
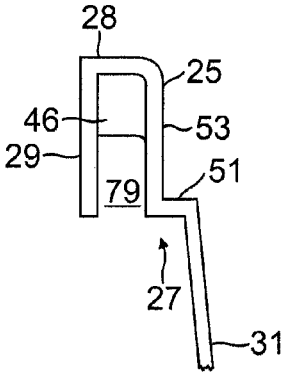
FIG. 7G1
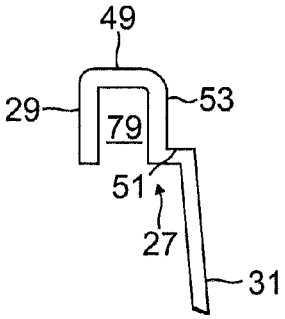
FIG. 7G2
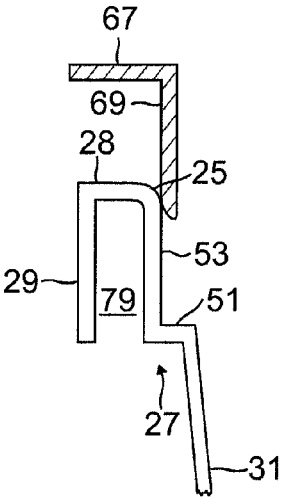
FIG. 7I3
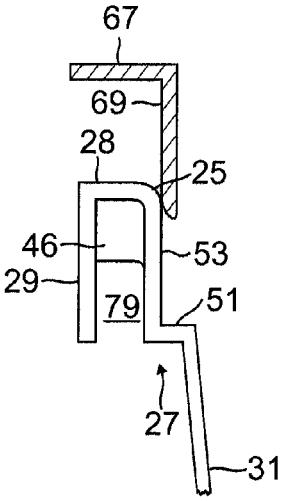
FIG. 7I1
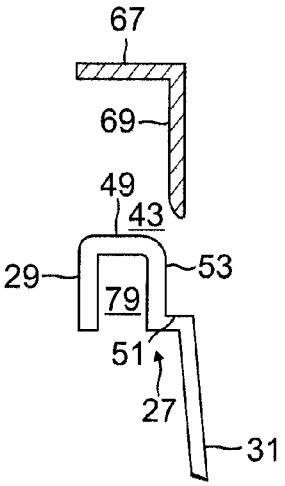
FIG. 7I2

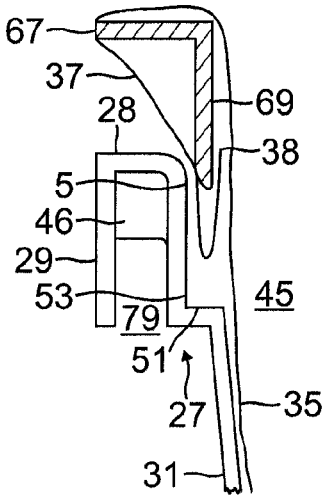
FIG. 7N1
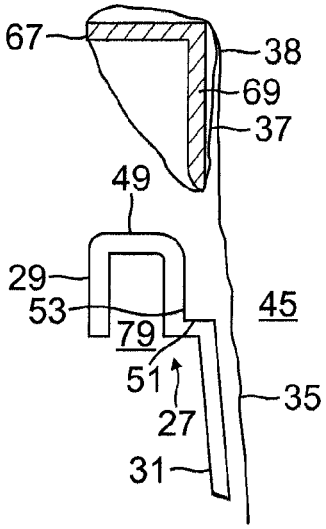
FIG. 7N2
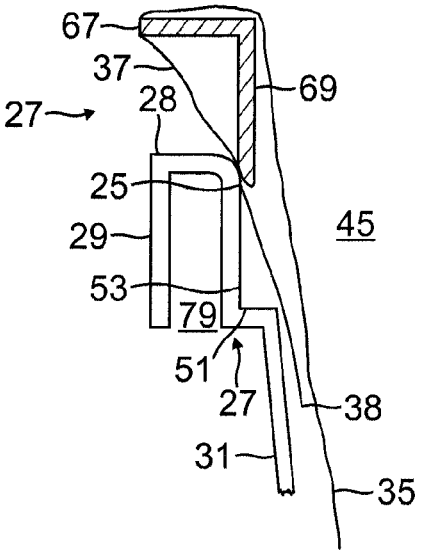
FIG. 7N3

FIG. 13E1

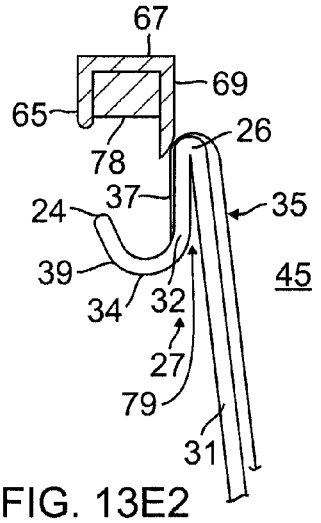
FIG. 13E2
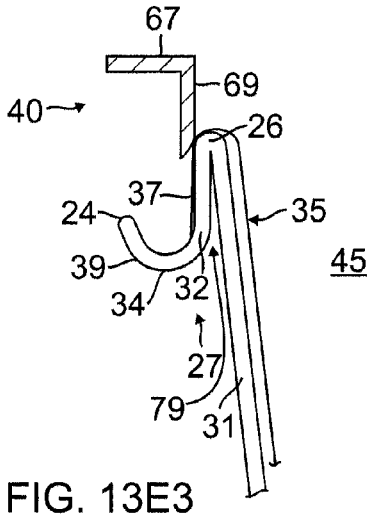
FIG. 13E3
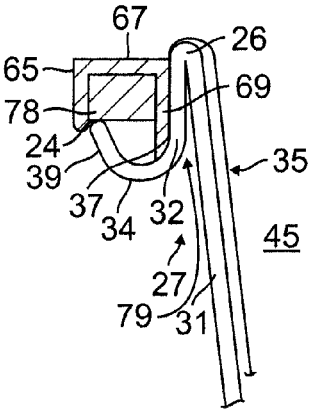
FIG. 13G2
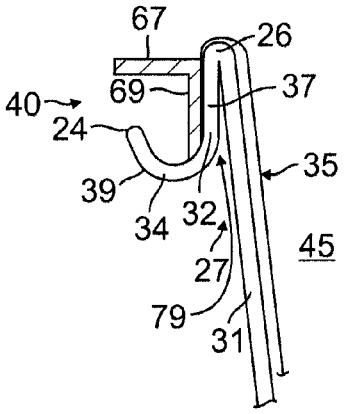
FIG. 13G3

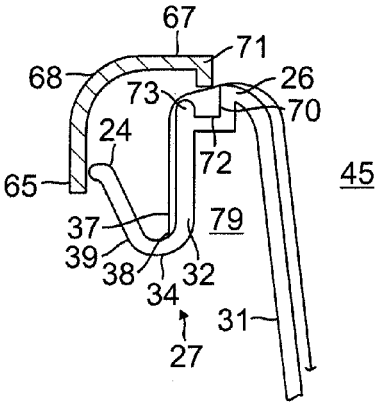
FIG. 15F2
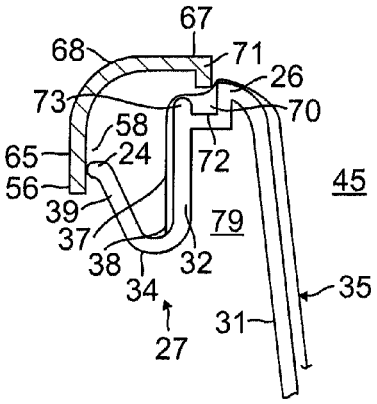
FIG. 15F3
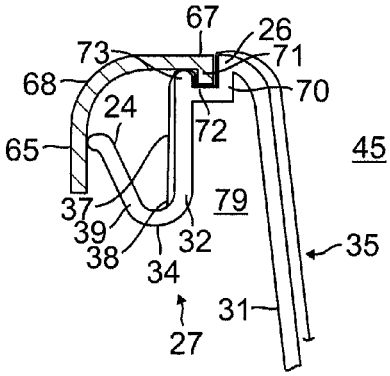
FIG. 15H2
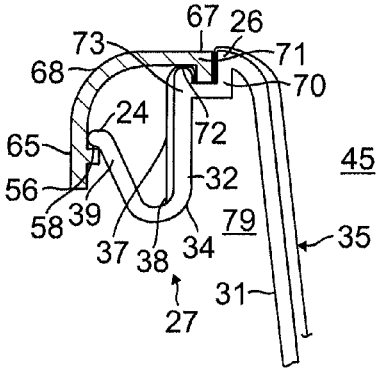
FIG. 15H3

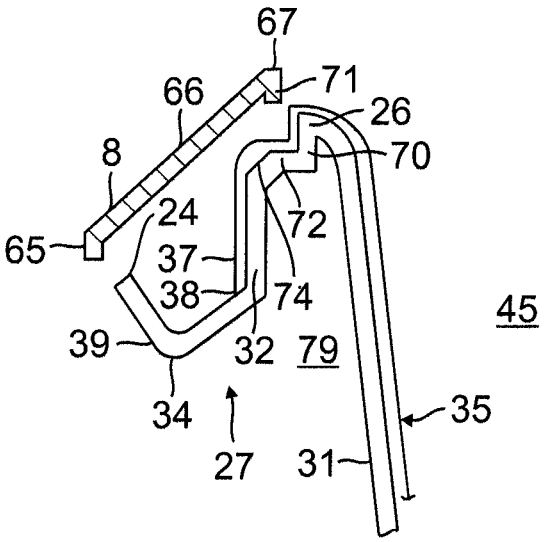
FIG. 15F1
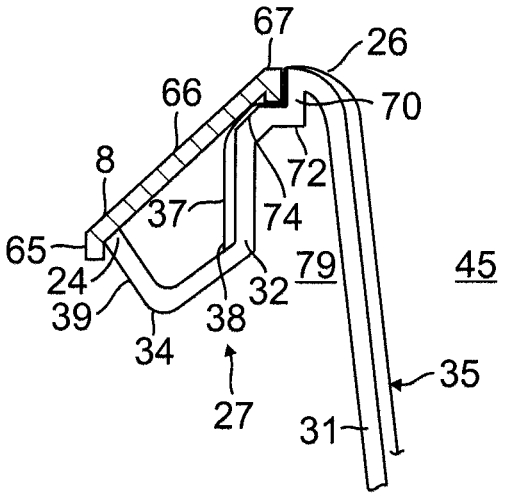
FIG. 15H1

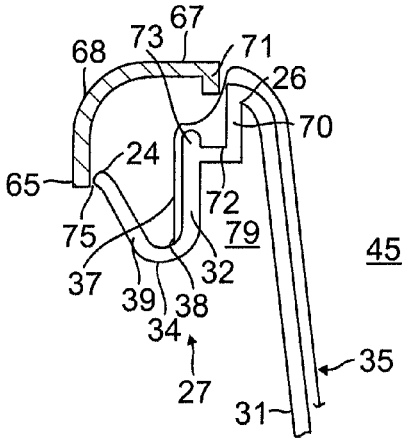
FIG. 15F4
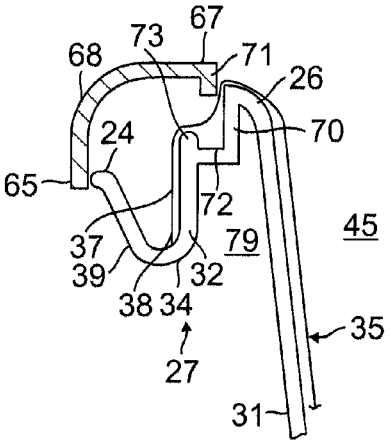
FIG. 15F5

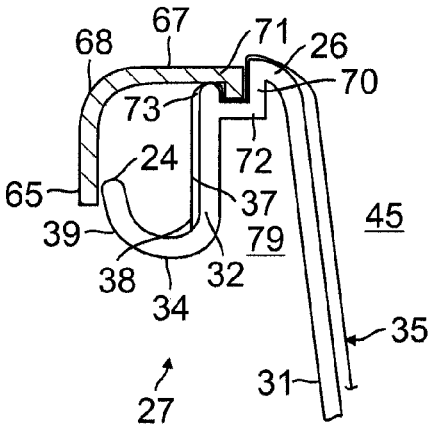
FIG. 16F2
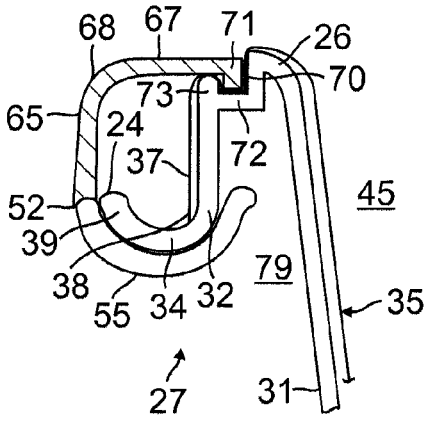
FIG. 16F3

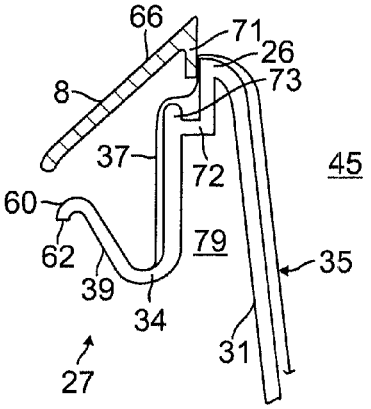
FIG. 21D1
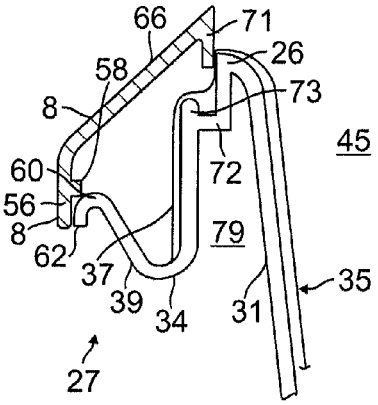
FIG. 21D2
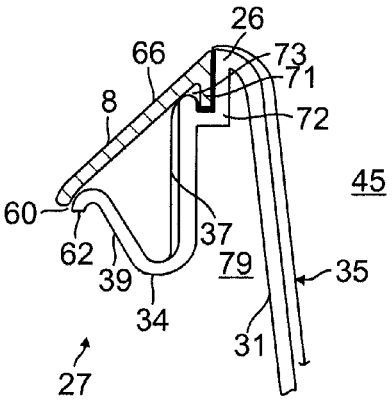
FIG. 21E1
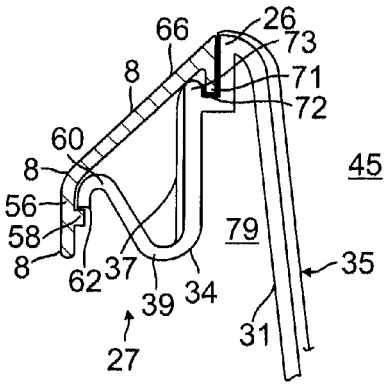
FIG. 21E2

BIN

CROSS-REFERENCE TO RELATED APPLICATION

This application claims the benefit of and priority to U.S. Provisional Application No. 61/879,528, filed Sep. 18, 2013, the entire content of which is incorporated herein by reference.

FIELD

The present disclosure relates generally to a bin that may be used as a receptacle for the collection of materials and items, including waste and recycling, and that may also be used as a container for the display, sale, or distribution of materials and items, and that is equipped with a rim that facilitates such uses.

BACKGROUND

Bins often lack information that is visible both at a distance from the bin and when standing next to the bin. This is perhaps most commonly a problem of bins with walls that are tapered and permit a bin to nest in an identical bin. For such bins, information on the wall of the bin is often not visible to a person standing next to the bin.

Another information-related problem is that persons having an item to be deposited in a bin are unable to readily determine whether a particular bin is an appropriate receptacle. The efficient use of discarded materials and the quality of solid waste streams, including recycling streams and waste streams not intended for hazardous wastes, are adversely affected by insufficient information about both the immediate bin and the location of alternative bins with different contents or intended contents.

A further information-related problem is that when a manufacturer imprints a bin with information or indicia of the bin's content, the information is often insufficient. Manufacturers often provide no information or indicia on the bin and that which manufacturers do provide is often of a general character, such as a recycling symbol. The actual specifications of the intended contents, and prohibited items, for a particular discard stream may be more detailed, and the information and indicia provided by a manufacturer may be incomplete.

A related problem is that when information or indicia are added at the facilities where the bins are used, the added signage is often informal, unattractive, and ad hoc. Persons and entities may find formal, attractive, consistently presented, and easily compared information more useful.

A further problem is that where a bin is lined, the means of securing the liner, including tying the liner in a knot at the exterior of the bin, is often unsightly.

A related liner problem occurs where a liner is not tied and the edge of the liner extends downward from the rim of the bin. In addition to liner—specifically, its position relative to the bin—not being secured, the edge of the liner and its adjacent border detract from the lines and appearance of the bin. This is particularly noticeable where the wall of the bin is tapered inward from top to bottom and the edge of the liner and its adjacent border hang from the rim.

A further variation of the liner problem arises when the bin has a lid and a liner, and the edge of the liner extends downward from the rim of the bin so that the edge of the liner and its adjacent border detract from the lines and appearance of the bin and lid.

Another liner-related problem is that bins are often lined with excessively large liners that permit and facilitate tying at the bin's exterior. Where tying is unnecessary, excessively large liners are a waste of resources.

Another liner-related problem occurs when the edge of the liner is to be inserted into a cavity within the rim and the process of inserting the edge of the liner into the cavity is cumbersome.

A further liner-related problem is the common practice of routinely discarding the liner with its contained waste or recycling. While disposal of a liner with its contents is appropriate in some circumstances, it is not necessary in others, and the unnecessary disposal of liners suitable for reuse (and perhaps ultimate recycling) is a waste of resources.

A distinct species of this problem arises when a ring, circular or otherwise, is used to secure a liner and the ring does not engage with the bin so as to permit the bin to be overturned and emptied with the ring engaged. Such unsecured rings promote an emptying process in which the ring and liner are removed, thus requiring additional time to empty the bin and unnecessarily encouraging disposal of the liner along with its contents.

Another liner-related problem pertains to sanitation. Liners are sometimes secured by a device that, when securing the liner, includes a surface that faces the interior of the bin and is not protected by the liner, thus exposing the device to any unsanitary contents of the bin.

Another liner-related sanitary problem arises where a liner is secured by a ring that fits within the bin's chamber and may be removed only by inserting a hand into the bin's mouth. Where the chamber of the bin is unsanitary, the inserted hand may be soiled or contaminated.

A similar sanitary problem is the absence of exterior handles, or the absence of a rim that may serve as an exterior handle. Where the chamber of a bin is unsanitary and a user lifts the bin by inserting part of her hand into the chamber, the inserted portion of the hand may be soiled or contaminated.

A ring-related problem occurs when a ring engages with the bin and the engagement process is unduly time consuming, the completion of the engagement is not immediately evident, or the engagement process is otherwise unsatisfactory.

A further ring-related problem occurs when a ring has engaged with the bin, but the disengagement means are not immediately evident.

Another ring-related problem occurs when a ring has engaged with the bin, and the disengagement process is difficult, unduly time consuming, or otherwise unsatisfactory.

SUMMARY

The present disclosure is directed to various embodiments of bins for receiving or storing one or more items. In one embodiment, the bin includes a wall having an upper end and a lower end and a bottom extending along the lower end of the wall. The wall and the bottom cooperate to define a chamber for receiving or storing the one or more items. A mouth is defined by the upper end of the wall and is in communication with the chamber. The bin also includes a rim extending around a periphery of the mouth and content information on at least a portion of an exterior surface of the rim. The content information is configured to identify the one or more items the bin is intended to receive or store. The content information may be a writing, a picture, a symbol, machine-readable code, a surface treatment, or any combination thereof. The content information may include a first form of content information and a second form of content information associated with the first form of content information. The first form of content information may be a color of the rim that is different than a color of the wall or a material characteristic of the rim that is different than a material characteristic of the wall. The second form of content information may be a writing, a picture, a symbol, machine-readable code, or any combination thereof. The content information may also indicate the character of the one or more items the bin is intended to receive or store. The character information may include a benefit of the one or more items, a price of the one or more items, a source of the one or more items, manufacturing information regarding the one or more items, processing information regarding the one or more items, use of the one or more items, a destination of the one or more items, information regarding entities or individuals associated with the one or more items, or any combination thereof. The content information may not include information regarding the commercial product name, number, or dimensions of the bin, the name, logo, identifier or contact information of the manufacturer of the bin, the name, logo, identifier or contact information of a manufacturer of a liner of the bin, or the specifications of the liner.

The bin may also include a series of labels configured to be coupled to the rim. Content information on one of the labels may be different than content information on another one of the labels. The bin may also include a series of placards configured to be detachably coupled to the rim, and content information on one of the placards may be different than content information on another one of the placards.

The rim of the bin may include a ring. The ring may include an oblique face and the content information may be on the oblique face. The bin may also include a series of detachable rings. Content information on one of the detachable rings may be different than content information on another one of the detachable rings. The bin may also include a series of liners configured to be detachably coupled to the rim. Content information on one of the liners may be different than content information on another one of the liners. The rim may also include an oblique lip and the content information may be on the oblique lip.

The present disclosure is also directed to various embodiments of a bin and ring assembly for receiving or storing one or more items. In one embodiment, the bin and ring assembly includes a bin that includes a wall having an upper end and a lower end and a bottom extending along the lower end of the wall. The wall and the bottom cooperate to define a chamber for receiving or storing the one or more items. A mouth is defined by an upper end of the wall and is in communication with the chamber. The bin also includes a rim extending around a periphery of the mouth and a ring configured to engage the rim of the bin. When the ring is engaged with the rim of the bin, no portion of the ring is shared with an interior surface of the chamber. The bin may also include a seat defined in the rim of the bin such that when the ring is engaged, an innermost portion of the ring is received in the seat. The rim of the bin may also include a seat wall such that when the ring is engaged, the seat wall is between the innermost portion of the ring and the chamber. The innermost portion of the ring may include a downwardly extending flange. The rim of the bin may also include a collar spaced from the seat wall such that when the ring is engaged, the downwardly extending flange is between the seat wall and the collar.

The rim of the bin may also include a trough attached to the wall or an outwardly extending flare attached to the wall. At least one aperture may be defined in the rim of the bin to facilitate disengagement of the ring. The rim of the bin may include a pair of opposing apertures to facilitate the disengagement of the ring. The ring may be made out of any suitable material, such as an elastic polymer material. The bin may also include a liner lining the chamber. A portion of the liner may be secured between the ring and the rim of the bin.

The present disclosure is also directed to various embodiments of a bin assembly for receiving or storing one or more items. In one embodiment, the bin assembly includes a bin that includes a wall having an upper end and a lower end. The wall tapers between the upper end and the lower end such that one of the bins is configured to nest in another one of the bins. The bin also includes a bottom extending along the lower end of the wall. The wall and the bottom cooperate to define a chamber for receiving or storing the one or more items. A mouth defined by an upper end of the wall is in communication with the chamber. The bin also includes a rim extending outward around a periphery of the mouth. The bin assembly also includes a ring or a lid configured to engage the rim of the bin. The ring or the lid includes at least one discrete and non-continuous engagement mechanism for engaging the rim of the bin. The discrete and non-continuous engagement mechanism may include a discrete and non-continuous protrusion on an interior surface of the one of the ring and the lid. The protrusion is configured to engage a portion of the rim of the bin. The ring or the lid may also include a tab, and the protrusion may be on the tab. An exterior surface of the ring or the lid may also include a disengagement indicium proximate to the protrusion. The rim of the bin may also a notch configured to receive the protrusion. When the ring or the lid is engaged with the rim of the bin, the protrusion may underlap a portion of the rim. The discrete and non-continuous engagement mechanism may include an inwardly extending indentation. The discrete and non-continuous engagement mechanism may include a latch configured to rotate between an engaged position and a disengaged position. The bin assembly may also include a live hinge hingedly coupling the latch to the ring or the lid. The latch may also include a hook configured to detachably engage a portion of the rim. The latch may further include a protrusion configured to detachably engage a portion of the rim of the bin. The ring or the lid may be configured to detachably engage the rim of the bin with a snap fit or a friction fit connection. The rim of the bin may include a hinge hingedly coupling the ring or the lid to the rim of the bin. The bin assembly may also include the other of the ring and the lid configured to engage the rim of the bin. At least a portion of the ring or the lid may include a straight edge below an uppermost portion of the wall.

The present disclosure is also directed to a bin assembly that includes a bin including a wall having an upper end and a lower end and a bottom extending along the lower end of the wall. The wall and the bottom cooperate to define a chamber for receiving or storing one or more items. A mouth is defined by an upper end of the wall and is in communication with the chamber. The bin also includes a rim extending outward around a periphery of the mouth and a channel defined below a lower surface of the rim. The channel is configured to facilitate grasping the bin. The bin assembly also includes a ring or a lid configured to engage the rim of the bin. The rim may include a downwardly extending flare fixedly coupled to the wall. The channel may be wedge-shaped and may be defined between a lower surface of the flare and an outer surface of the wall. The rim may include a trough fixedly coupled to the wall. The channel may be wedge-shaped and may be defined between a lower surface of the trough and an outer surface of the wall. The rim may also include a fall fixedly coupled to an uppermost portion of the wall, and the trough may be fixedly coupled to a lower end of the fall. The rim may include an oblique lip fixedly coupled to the wall. The channel may extend either continuously around the rim or may be discontinuous. The rim a substantially vertical lip, a frame spaced from the vertical lip, and a substantially horizontal lip extending between upper ends of the vertical lip and the frame. The channel may be defined between an inner surface of the vertical lip, a lower surface of the horizontal lip, and an outer surface of the frame.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

The features and advantages of the bins of the present disclosure will be better understood by reference to the following descriptions when considered in conjunction with the accompanying figures. In the figures, like reference numerals are used throughout the figures to reference like features and components. The figures are not necessarily drawn to scale.

FIG. 4D1 depicts a cross section of the bin of the fourth embodiment and a potential user, specifically a potential depositor, who is standing next to the bin, holding in one hand a device (such as a smartphone) that is capable of reading machine-readable information, holding in the other hand an item for potential deposit, and accessing information, by sight and by device, on the horizontal lip of the bin;

FIG. 4D2 depicts a cross section of the bin of the fourth embodiment and a potential user, specifically a potential depositor, who is standing next to the bin and accessing information by sight on a horizontal lip and accessing information by device on a vertical lip;

FIG. 4D3 depicts a cross section of the bin of the fourth embodiment and a potential user, specifically, a potential depositor, who is standing next to the bin and accessing information by sight and by device on a curved lip;

FIG. 7G1 is a cross section of the bin of the seventh embodiment shown in FIG. 7D FIG. 7G2 is a second cross section of the bin of the seventh embodiment shown in FIG. 7D;

FIG. 7H1 is a cross section of the ring of the seventh embodiment shown in FIG. 7E;

FIG. 7H2 is a second cross section of the ring of the seventh embodiment shown in FIG. 7E;

FIG. 7I1 is a cross section of the rim of the seventh embodiment shown in FIG. 7F;

FIG. 7I2 is a second cross section of the rim of the seventh embodiment shown in FIG. 7F;

FIG. 7I3 is a third cross section of the rim of the seventh embodiment shown in FIG. 7F;

FIG. 7N1 is a cross section of the rim of the seventh embodiment shown in FIG. 7I1 but showing the overdraped and undertucked liner depicted in FIG. 7M and showing that the ring of the rim now rests directly on the liner, which in turn rests on the bin;

FIG. 7N2 is a cross section of the rim of the seventh embodiment shown in FIG. 7I2 but showing the overdraped and undertucked liner depicted in FIG. 7M;

FIG. 7N3 is a cross section of the rim of the seventh embodiment shown in FIG. 7I3 but showing the overdraped and undertucked liner depicted in FIG. 7M;

FIG. 13E1 is a cross section of the rim of the thirteenth embodiment together with a liner as shown in FIG. 13D;

FIG. 13E2 is a second cross section of the rim of the thirteenth embodiment together with a liner as shown in FIG. 13D;

FIG. 13E3 is a third cross section of the rim of the thirteenth embodiment together with a liner as shown in FIG. 13D;

FIG. 13G2 is a cross section of the rim of the thirteenth embodiment shown in FIG. 13E2, but the ring has now been pushed downward so that the ring is engaged with the bin and secures the liner;

FIG. 13G3 is a cross section of the rim of the thirteenth embodiment shown in FIG. 13E3, but the ring has now been pushed downward so that the ring is engaged with the bin and secures the liner;

FIG. 15F1 is a cross section of the rim of the fifteenth embodiment together with a liner as shown in FIG. 15C;

FIG. 15F2 is a second cross section of the rim of the fifteenth embodiment together with a liner as shown in FIG. 15C;

FIG. 15F3 is a third cross section of the rim of the fifteenth embodiment together with a liner as shown in FIG. 15C;

FIG. 15F4 is a fourth cross section of the rim of the fifteenth embodiment together with a liner as shown in FIG. 15C;

FIG. 15F5 is a fifth cross section of the rim of the fifteenth embodiment together with a liner as shown in FIG. 15C;

FIG. 15H1 is a cross section of the rim of the fifteenth embodiment together with a liner as shown in FIG. 15F1, but the ring has now been pushed downward so that the ring is engaged with the bin and secures the liner;

FIG. 15H2 is a cross section of the rim of the fifteenth embodiment together with a liner as shown in FIG. 15F2, but the ring has now been pushed downward so that the ring is engaged with the bin and secures the liner;

FIG. 15H3 is a cross section of the rim of the fifteenth embodiment together with a liner as shown in FIG. 15F3, but the ring has now been pushed downward so that the ring is engaged with the bin and secures the liner;

FIG. 16F2 is a cross section of the rim of the bin assembly of the sixteenth embodiment shown in FIG. 16A;

FIG. 16F3 is another cross section of the rim of the bin assembly of the sixteenth embodiment as shown in FIG. 16A;

FIG. 21D1 is a cross section of the rim of the of the twenty-first embodiment together with a liner as shown in FIG. 21C;

FIG. 21D2 is a second cross section of the rim of the twenty-first embodiment together with a liner as shown in FIG. 21C;

FIG. 21E1 is a cross section of the rim of the twenty-first embodiment shown in FIG. 21D1, but the ring has now been pushed downward so that the ring is engaged with the bin and secures the liner;

FIG. 21E2 is a cross section of the rim of the twenty-first embodiment shown in FIG. 21D2, but the ring has now been pushed downward so that the ring is engaged with the bin and secures the liner;

FIG. 25H is a second cross section of the rim of the twenty-fifth embodiment together with the liner as shown in FIG. 25E;

FIG. 25I is a third cross section of the rim of the twenty-fifth embodiment together with the liner as shown in FIG. 25E;

FIG. 26 is a side view of a portion of a twenty-sixth embodiment, a bin assembly, together with a liner lining the bin and secured by the ring;

FIG. 27A is a side view of a portion of a twenty-seventh embodiment, a bin assembly, together with a liner lining the bin, and the ring resting in a stable but unengaged position;

FIG. 27B is a cross section of a portion of the twenty-seventh embodiment together with a liner lining the bin and the ring resting in a stable but unengaged position as shown in FIG. 27A;

FIG. 28A is a side view of a twenty-eighth embodiment, a bin assembly together with a liner lining the bin and secured by the ring;

FIG. 28B is a cross section of a portion of the rim of the twenty-eighth embodiment together with the liner lining the bin and secured by the ring as shown in FIG. 28A;

FIG. 29A is a side view of a twenty-ninth embodiment, a bin assembly together with a liner lining the bin and secured by the ring;

FIG. 29B is a cross section of the front portion of a rim of the twenty-ninth embodiment together with the liner lining the bin and secured by the ring as shown in FIG. 29A;

FIG. 29C is a second cross section of a portion of a rim of the twenty-ninth embodiment together with the liner lining the bin and secured by the ring as shown in FIG. 29A;

FIG. 30A is a top view of a thirtieth embodiment, a bin assembly, together with a liner lining the bin and secured by the ring;

FIG. 30B is a cross section of the rim of the thirtieth embodiment together with the liner shown in FIG. 30A;

Figure 1A:
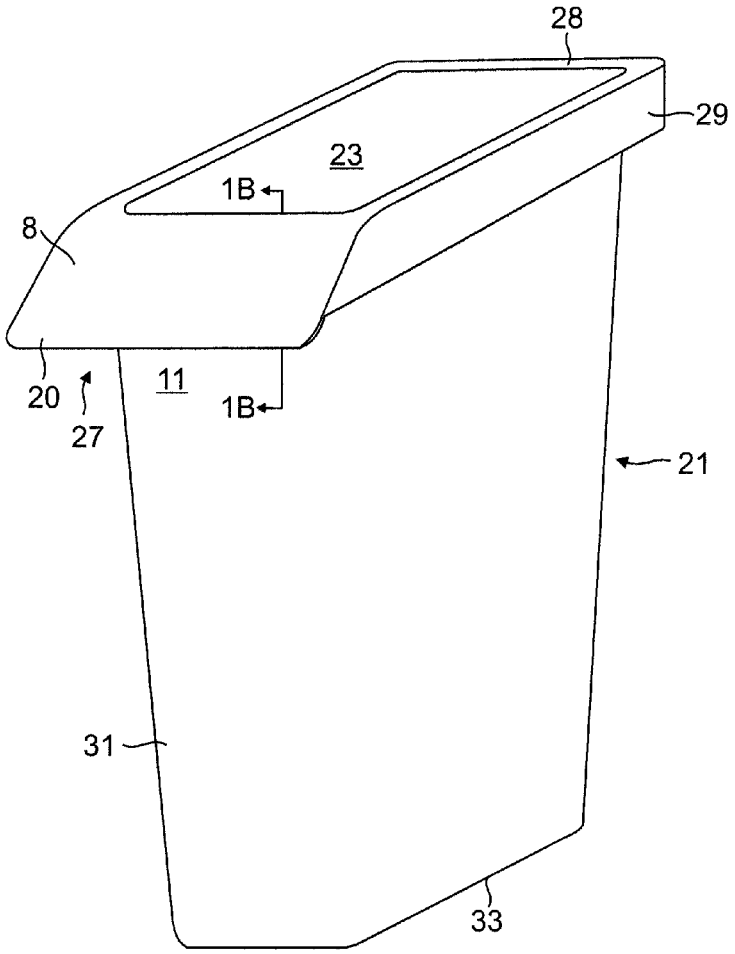
FIG. 1A is a perspective view of a first embodiment of a bin.
Figure 7A:
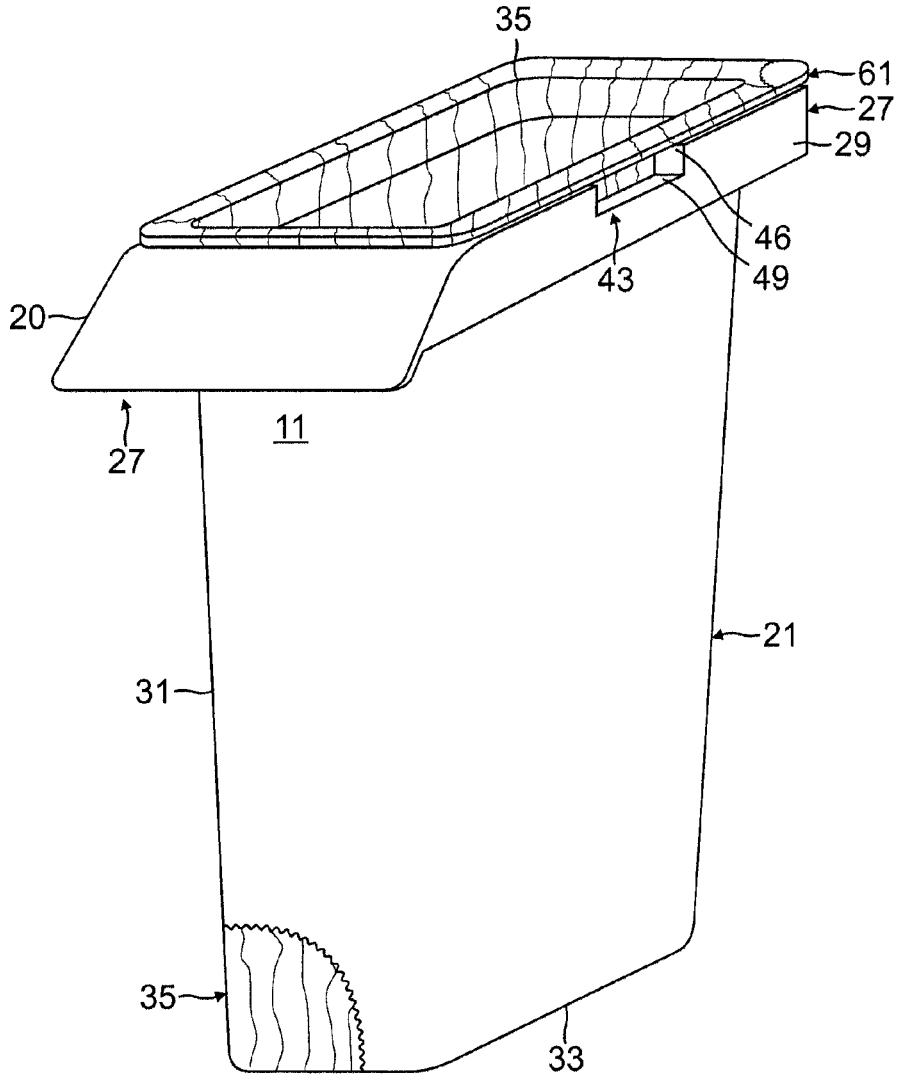
FIG. 7A is a perspective view of a seventh embodiment, a bin assembly that includes a bin and a ring and that is shown with a liner lining the bin and secured by the ring.
Figure 7B:
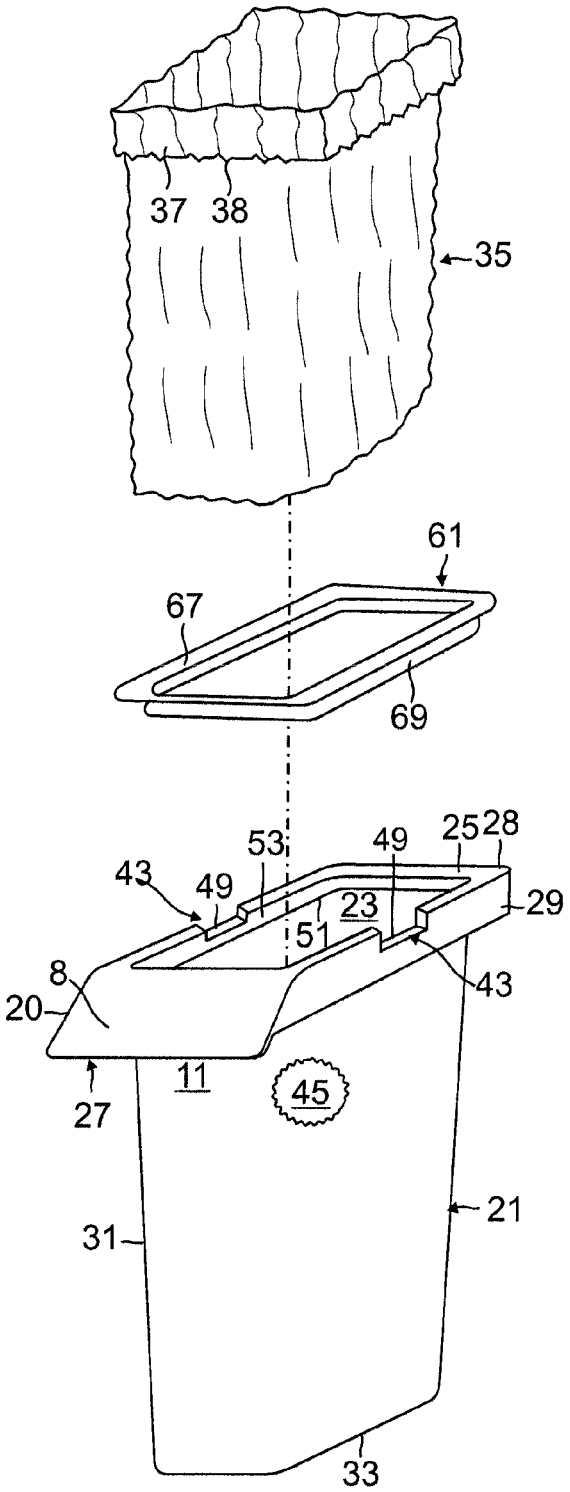
FIG. 7B is an exploded perspective view of the ring and bin of the seventh embodiment, shown with a liner.
Figure 7C:
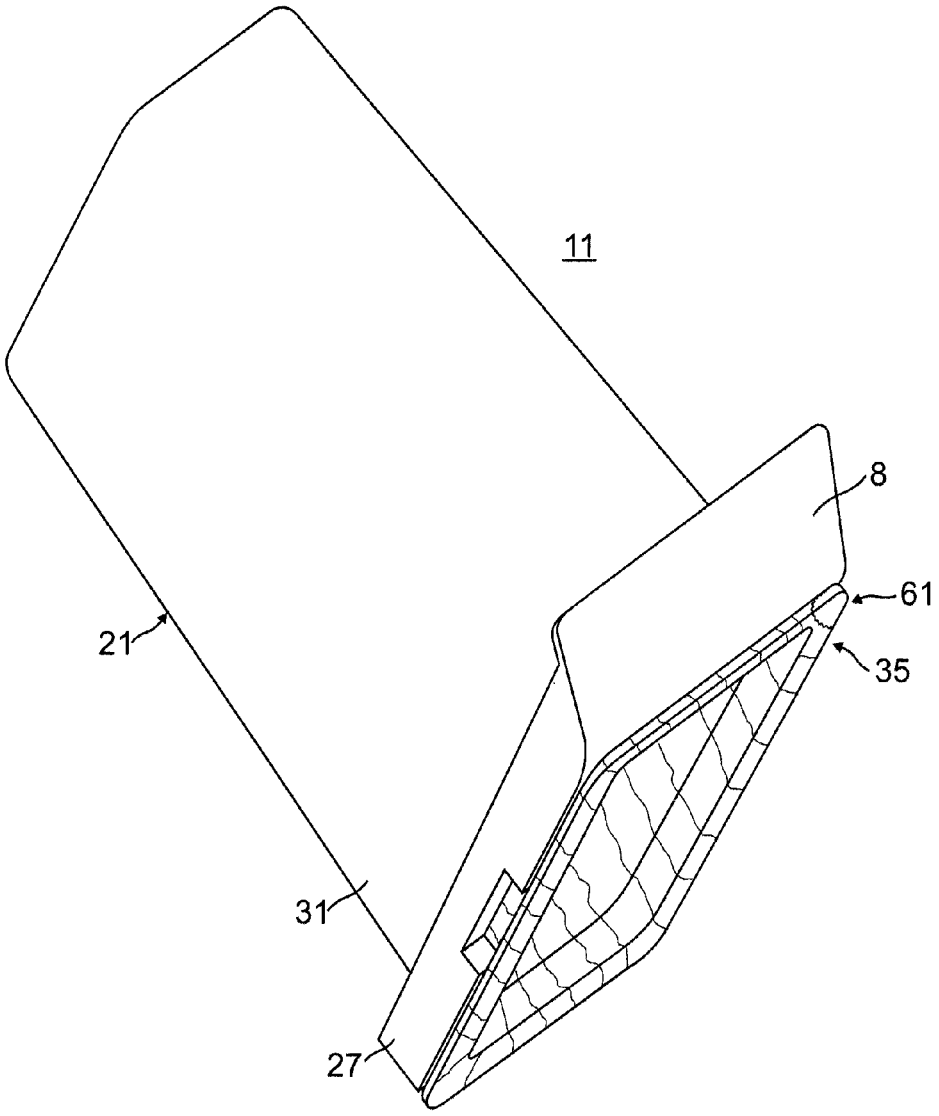
FIG. 7C is a perspective view of the seventh embodiment, shown with a liner lining the bin and secured by the ring, and shown in the process of being emptied without removing the liner.
Figure 7D:
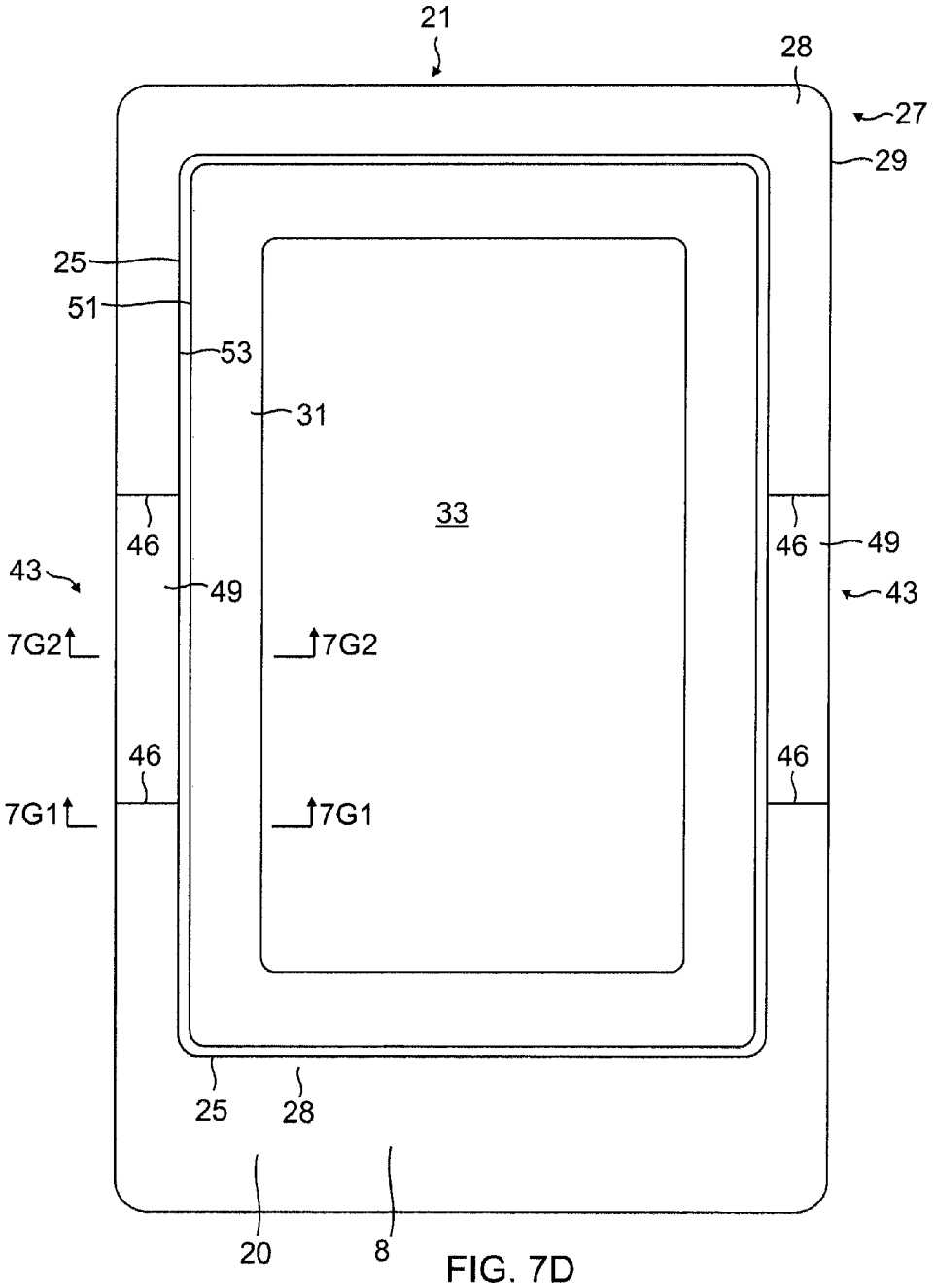
FIG. 7D is a top view of the bin of the seventh embodiment.
Figure 7E:
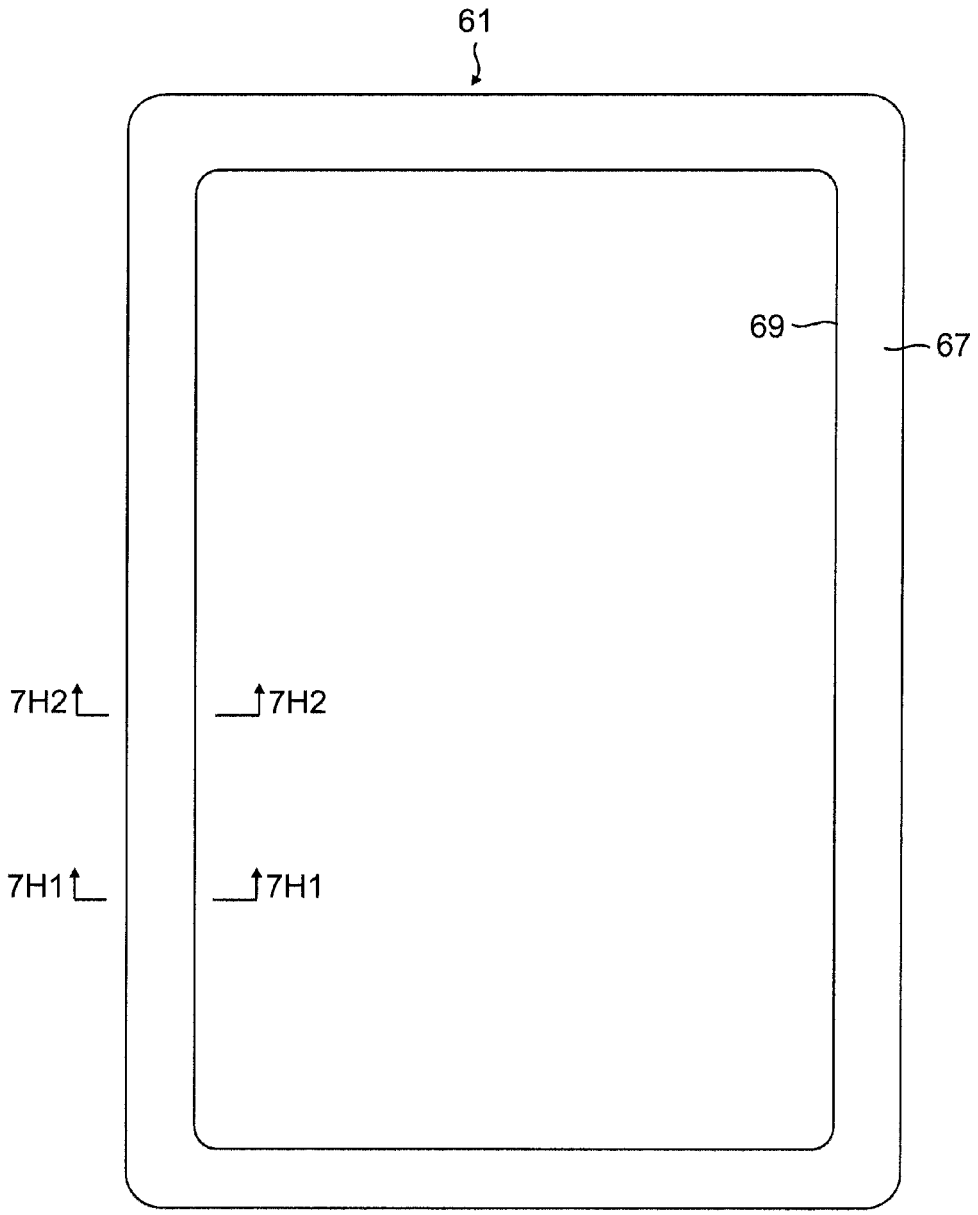
FIG. 7E is a top view of the ring of the seventh embodiment.
Figure 7F:
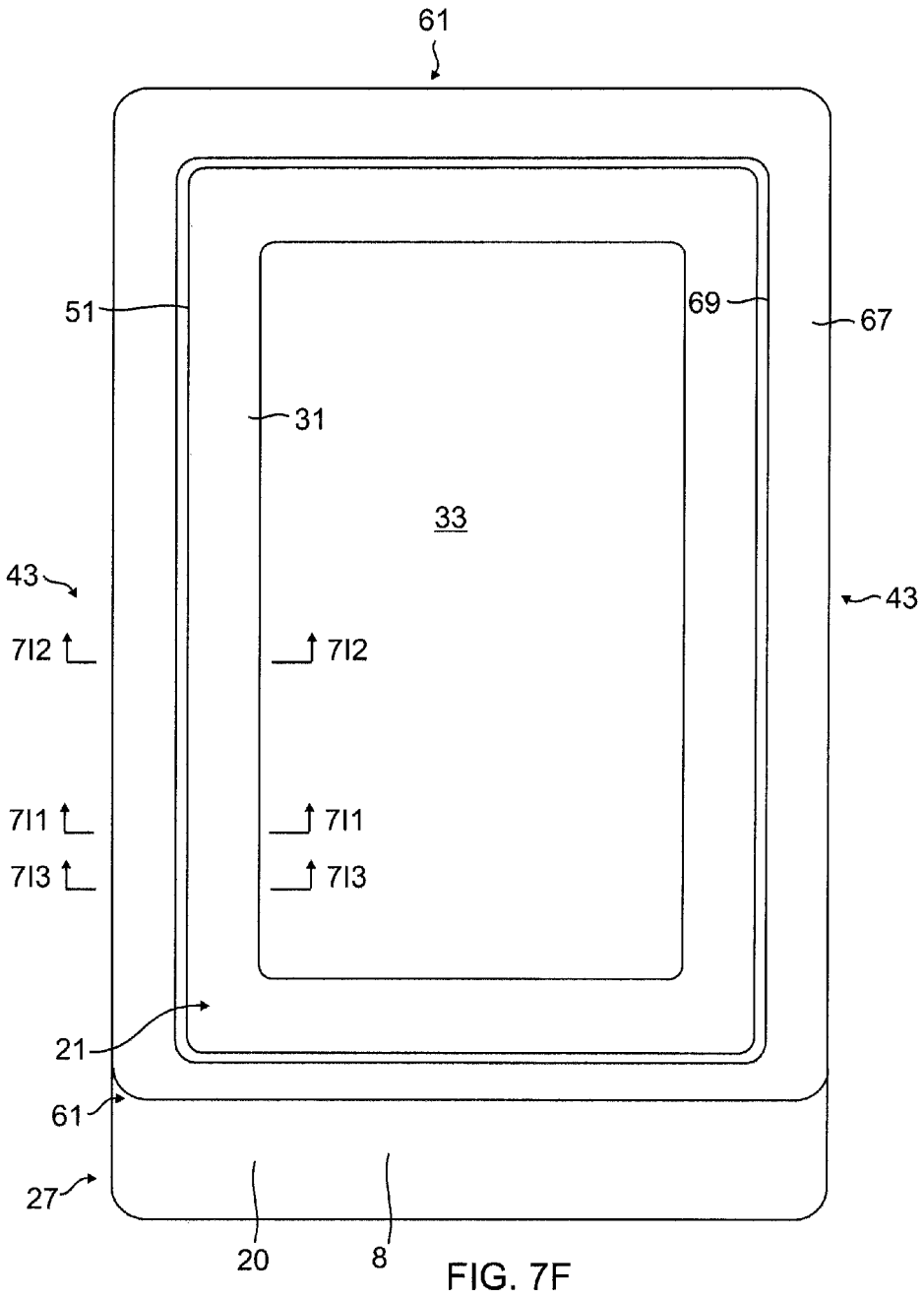
FIG. 7F is a top view of the ring and bin of the seventh embodiment in which the ring is resting on the bin in a stable but unengaged position.
Figure 7J:
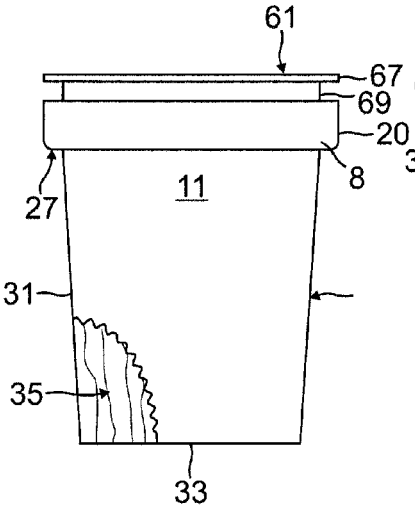
FIG. 7J is a front view of the seventh embodiment in which the ring is resting on the bin in a stable but unengaged position.
Figure 7K:
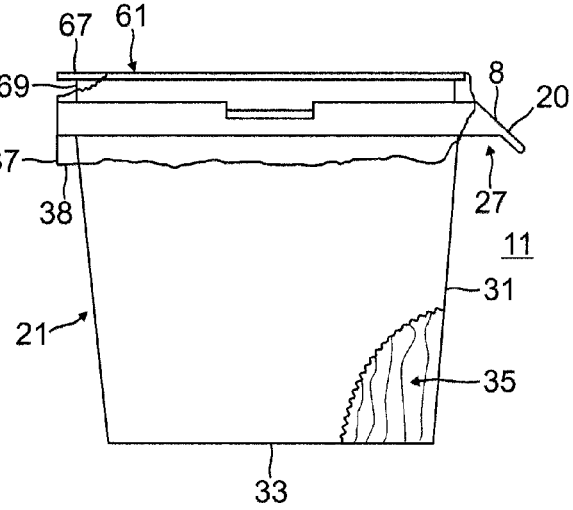
FIG. 7K is a side view of the ring and bin of the seventh embodiment in which the ring is resting on the bin in a stable but unengaged position and a liner has been inserted in the bin so that the liner lines the bin and drapes over, and hangs from, the ring.
Figure 7L:
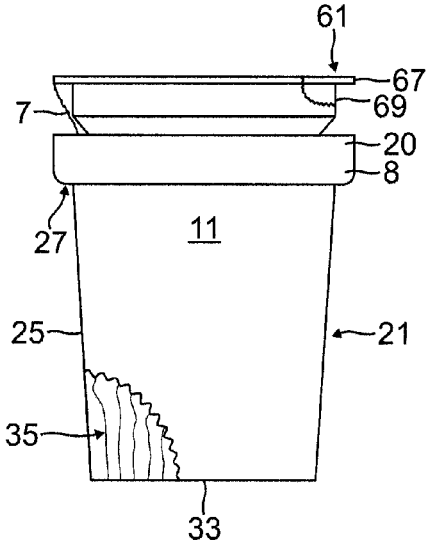
FIG. 7L is a front view of the ring and bin of the seventh embodiment in which the ring and overdraped liner depicted in FIG. 7K have been lifted, and the edge and a portion of the border of the liner have been tucked under the ring and into the bin.
Figure 7M:
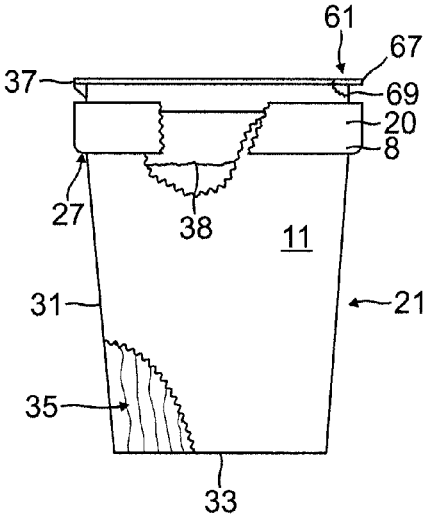
FIG. 7M is a front view of the ring and bin of the seventh embodiment in which the ring and overdraped and undertucked liner depicted in FIG. 7L have been lowered so that the ring is again resting in a stable but unengaged position.
Figure 7P:
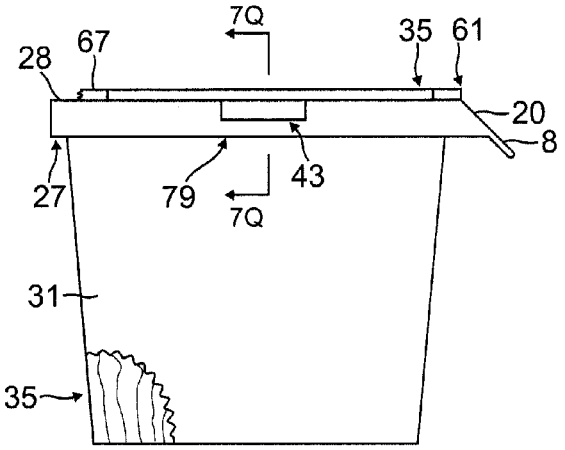
FIG. 7P is a side view of the ring and bin of the seventh embodiment shown in FIG. 7K but the ring is now engaged with the bin and secures the liner so that the liner does not interfere with the information on the oblique lip.
Figure 7Q:
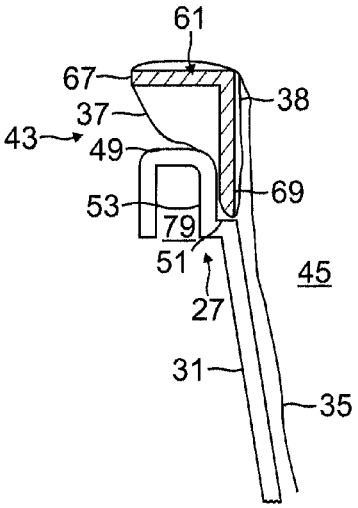
FIG. 7Q is a cross section of the rim of the seventh embodiment shown in FIG. 7P.
Figure 7R:
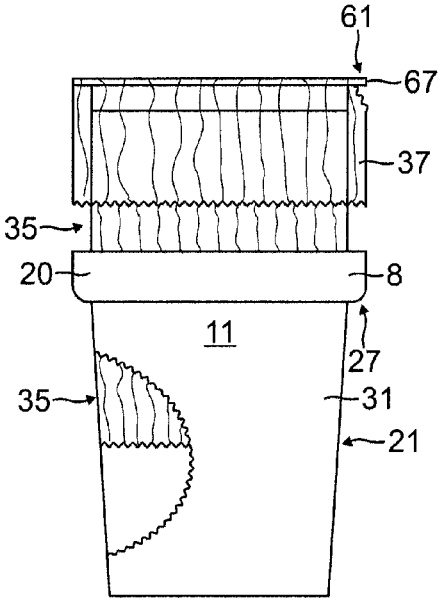
FIG. 7R is a front view of the ring and bin of the seventh embodiment in which the ring has been disengaged and lifted from the bin so as to permit removal and replacement of the liner.
Figure 7S:
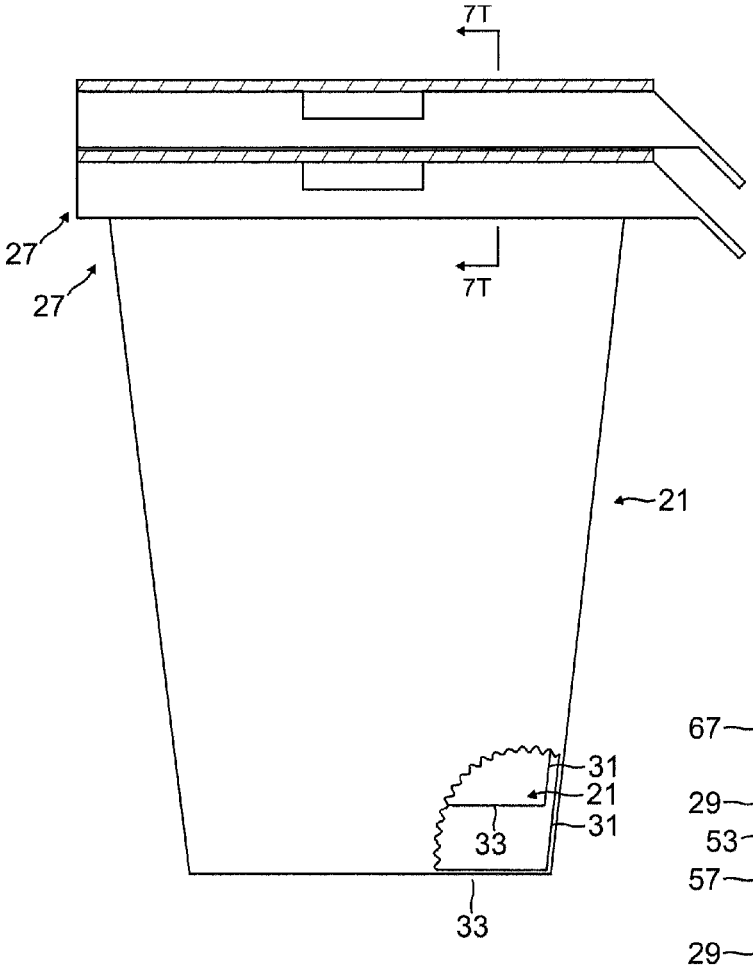
FIG. 7S is a side view of a set of two bin assemblies of the seventh embodiment in which each ring is engaged with its bin and in which one of the assemblies is nested in the other.
Figure 7T:
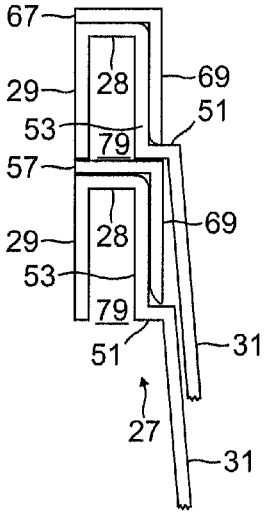
FIG. 7T is a cross section of a portion of the two bin assemblies of the seventh embodiment depicted in FIG. 7S.
Figure 30A:
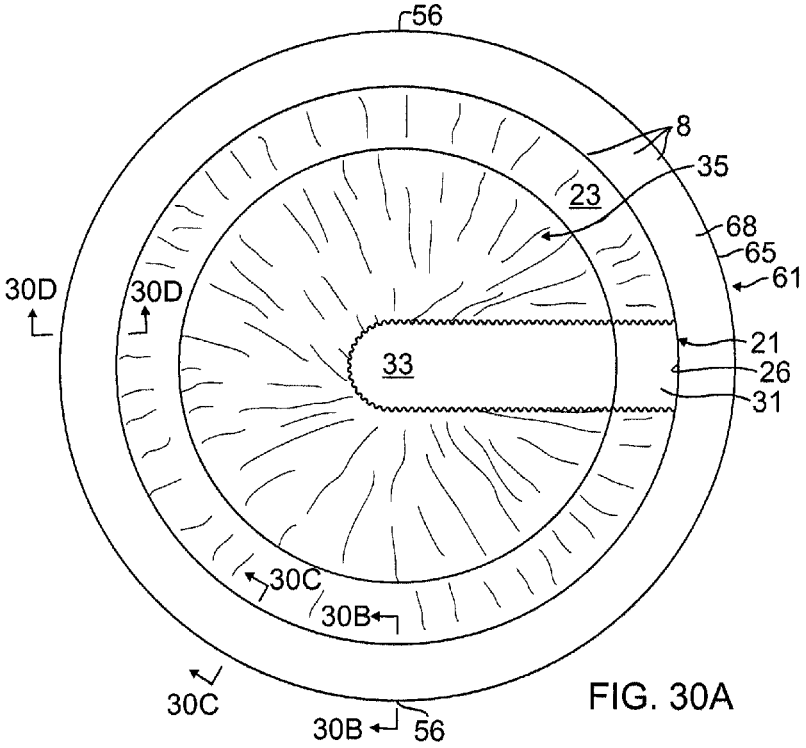
Figure 30C:
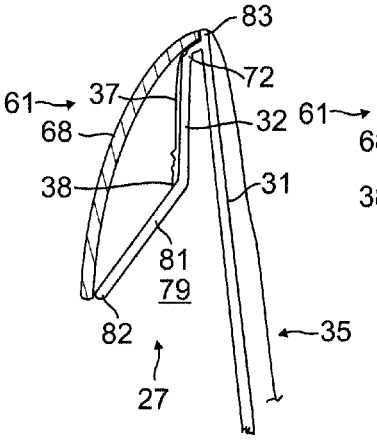
Figure 30D:
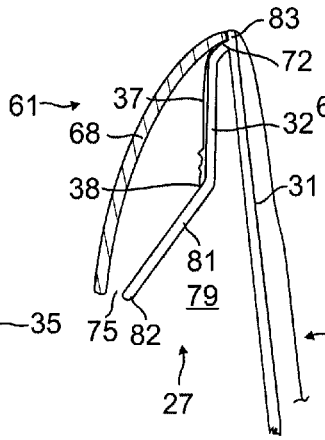
Figure 31A:
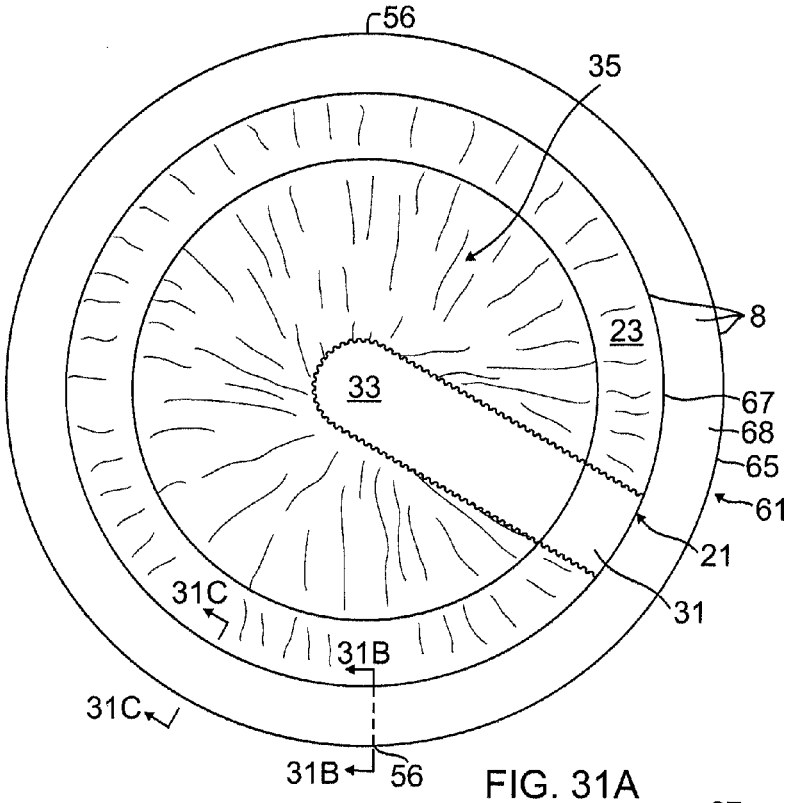
Figure 31C:
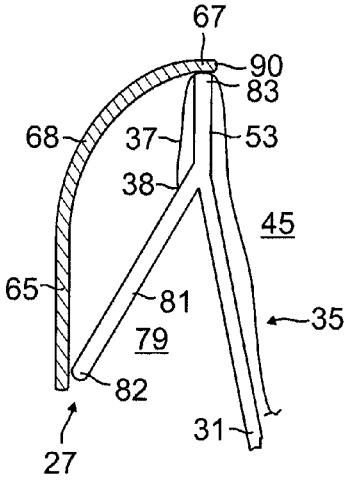
Figure 31B:
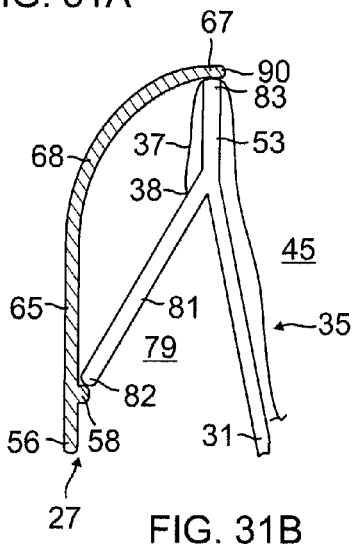
Figure 32A:
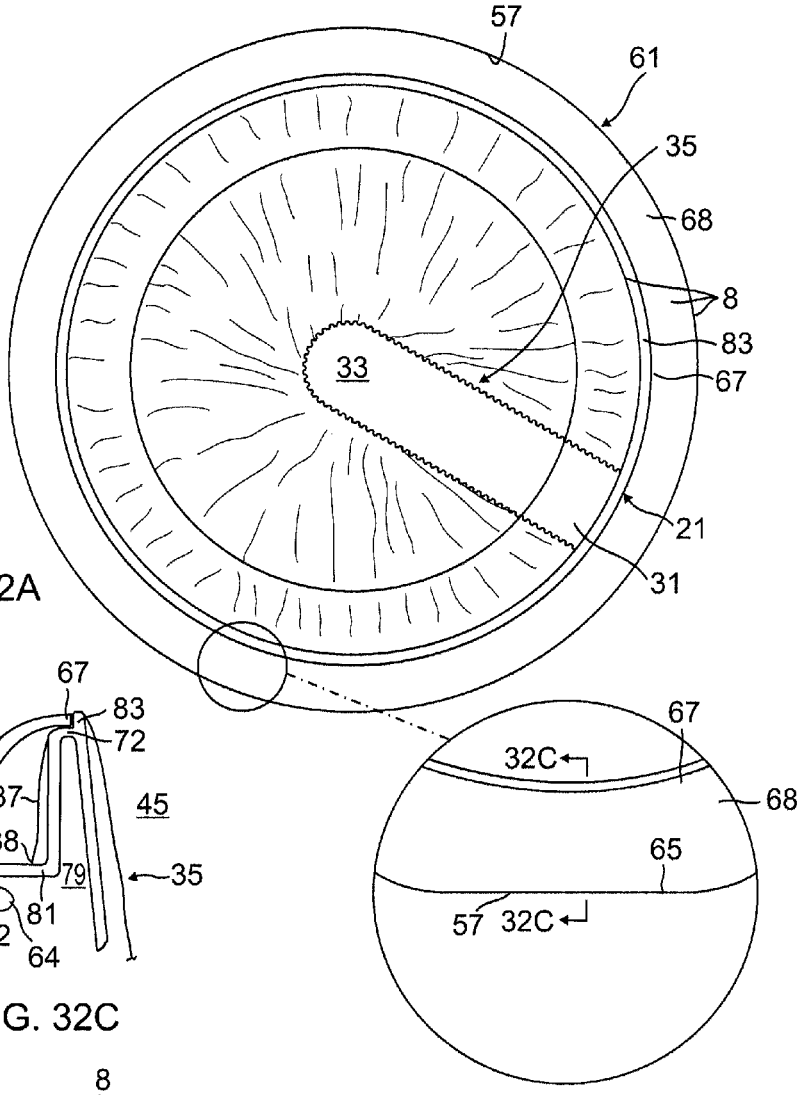
Figure 32C:
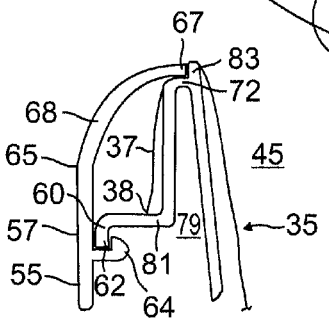
Figure 32B:
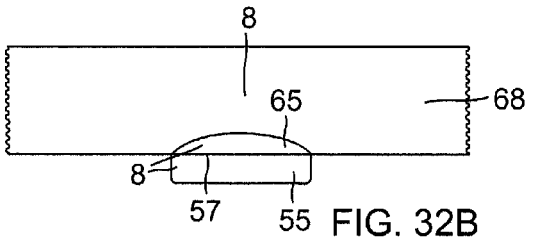
Figure 33A:
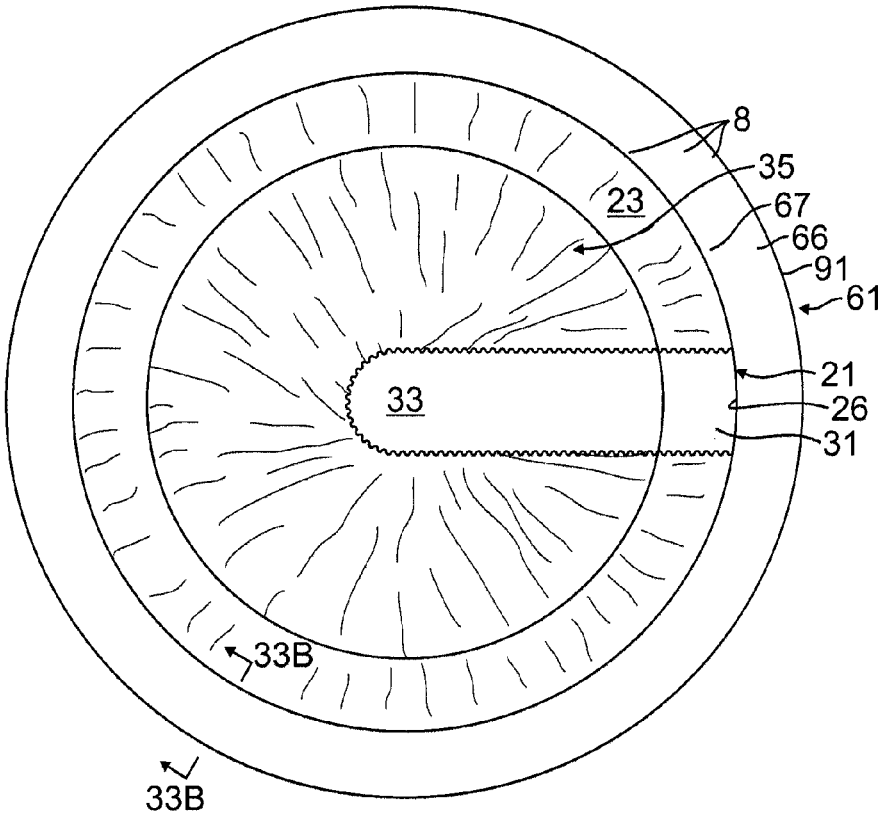
Figure 33B:
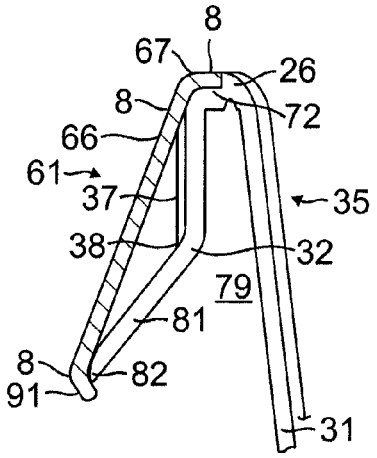
Figure 34A:
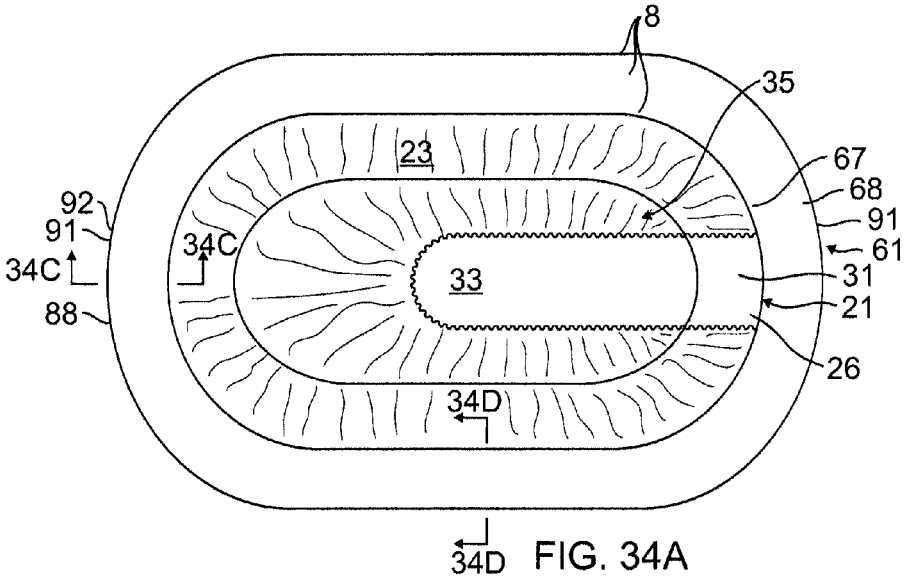
Figure 34B:
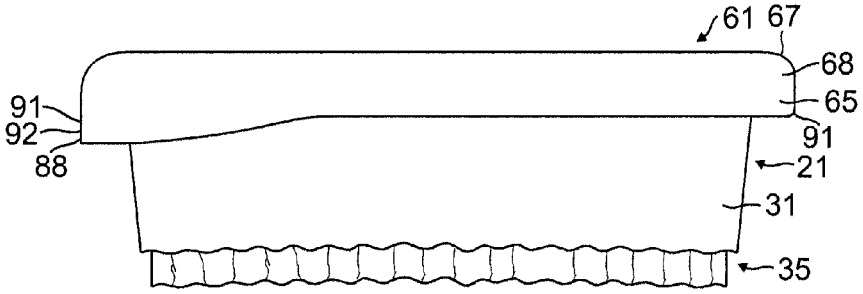
Figure 34C:
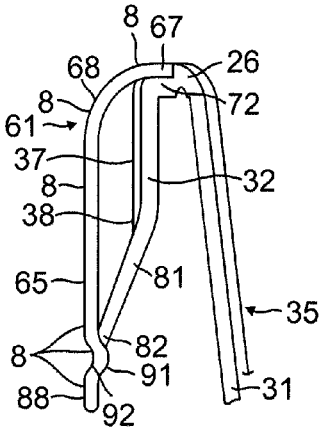
Figure 34D:
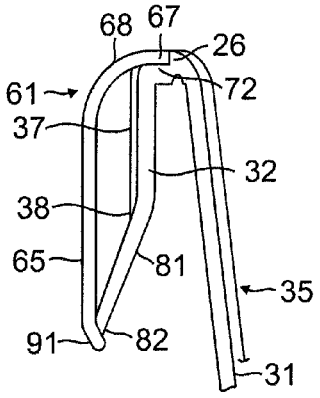
Figure 35:
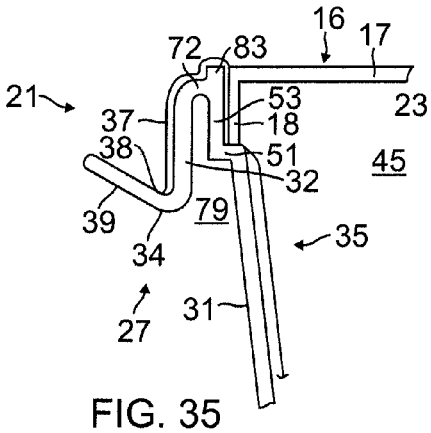
Figure 36:
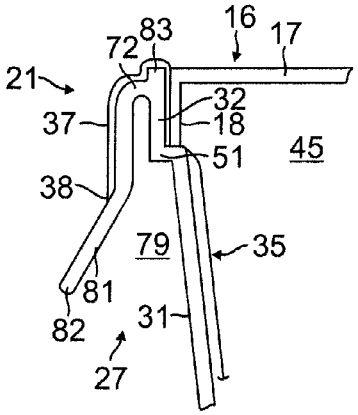
Figure 37:
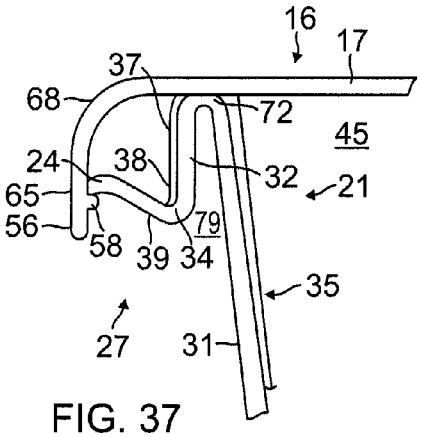
Figure 38:
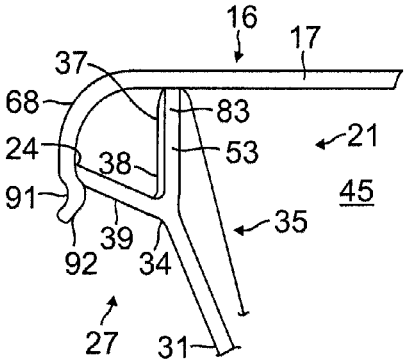
Figure 39:
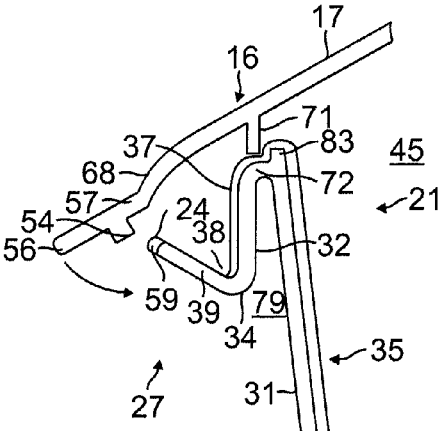
Figure 40:
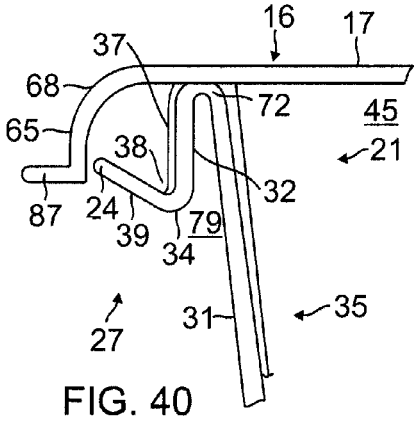
Figure 41:
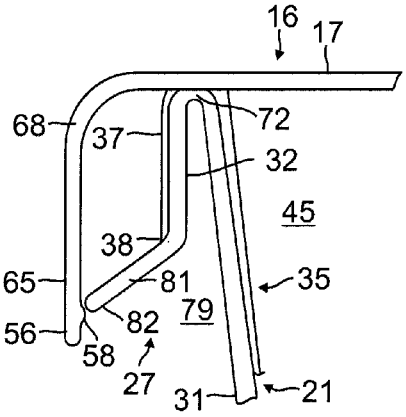
Figure 42:
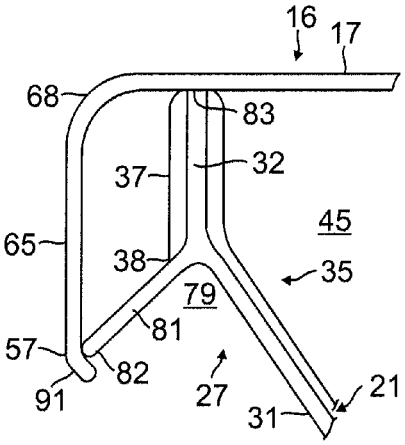
Figure 43:
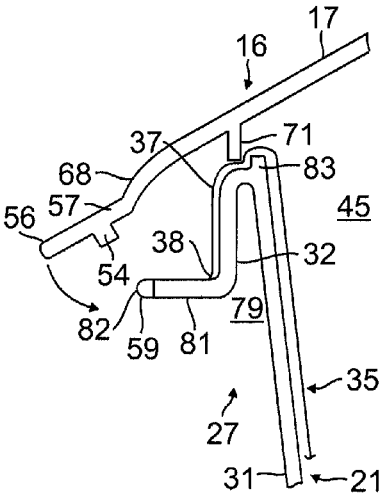
Figure 44:
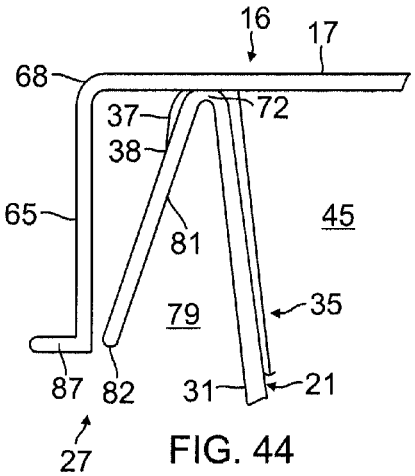
Figure 45:
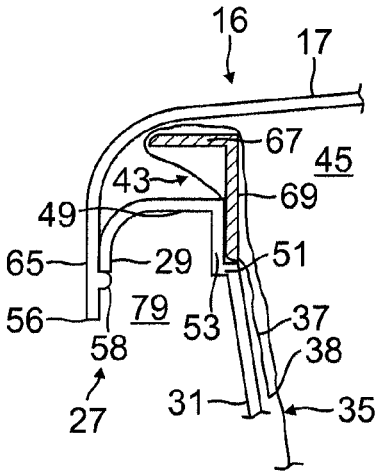
Figure 46:
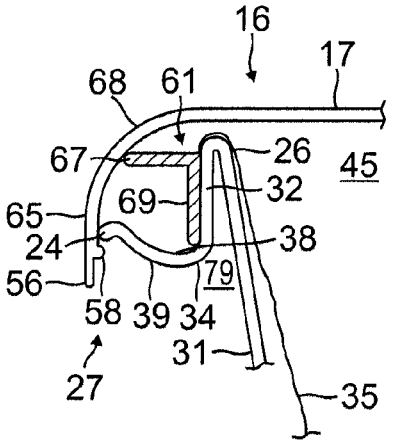
Figure 47:
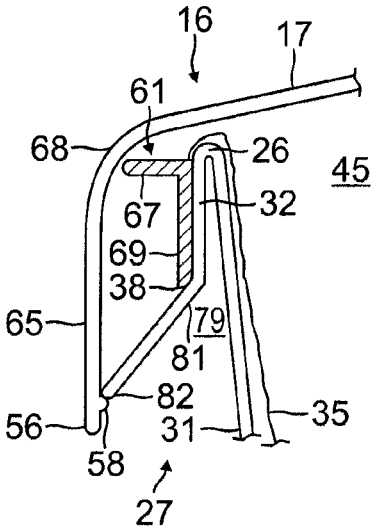
Figure 48:
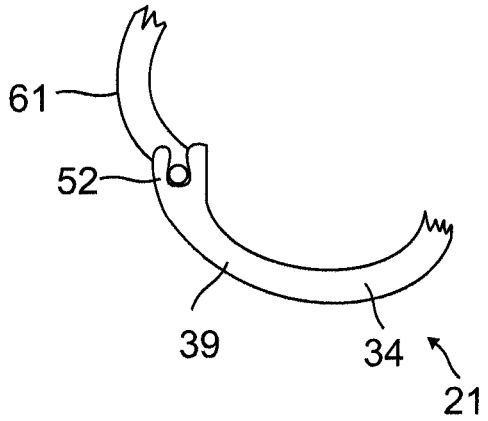
Figure 49:
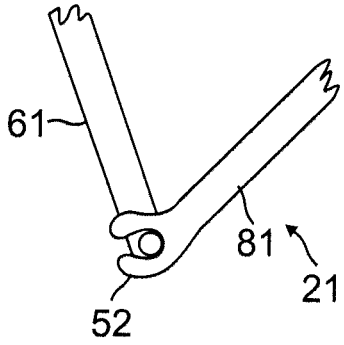
Figure 50:
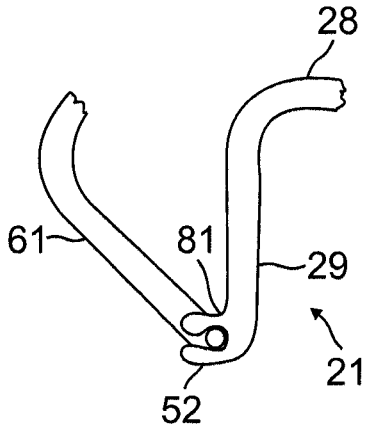
Figure 51:
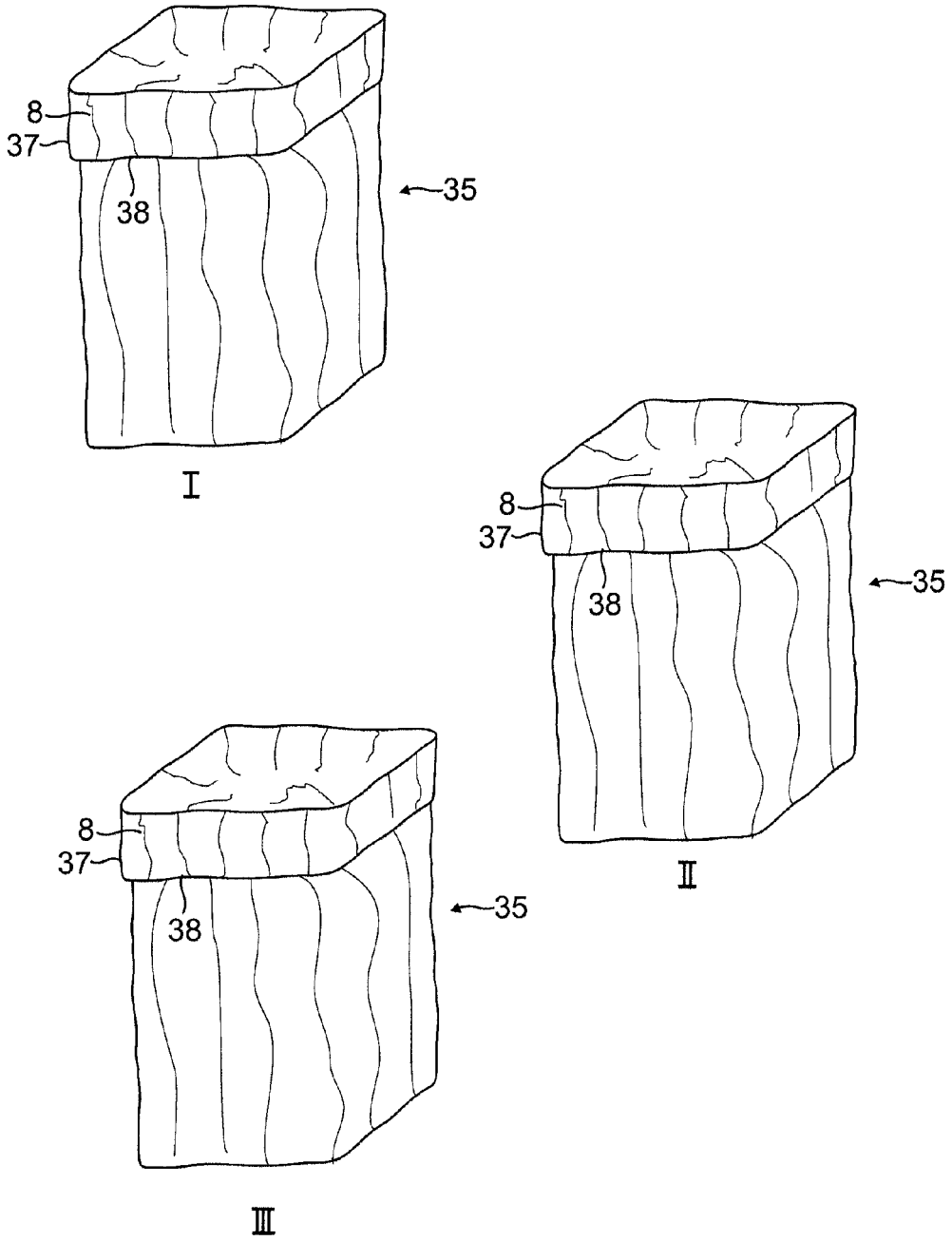
Figure 52:
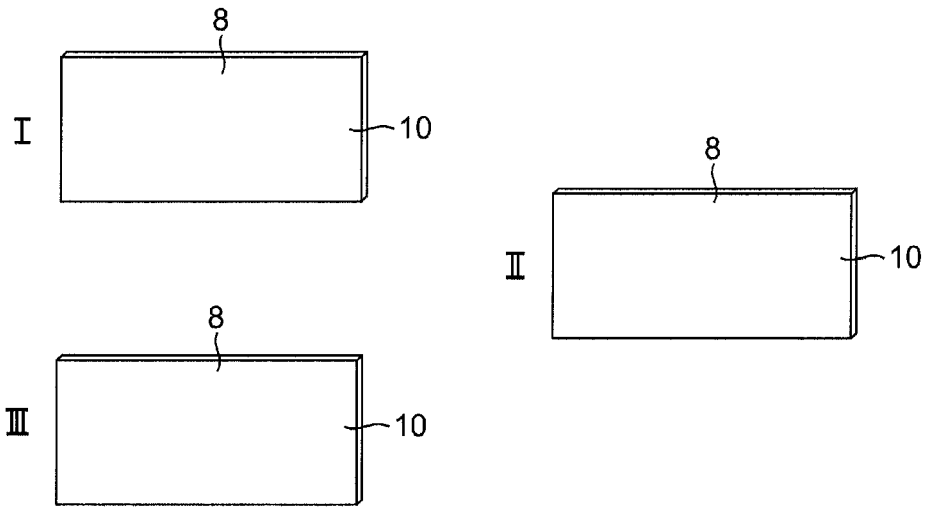
Figure 53:
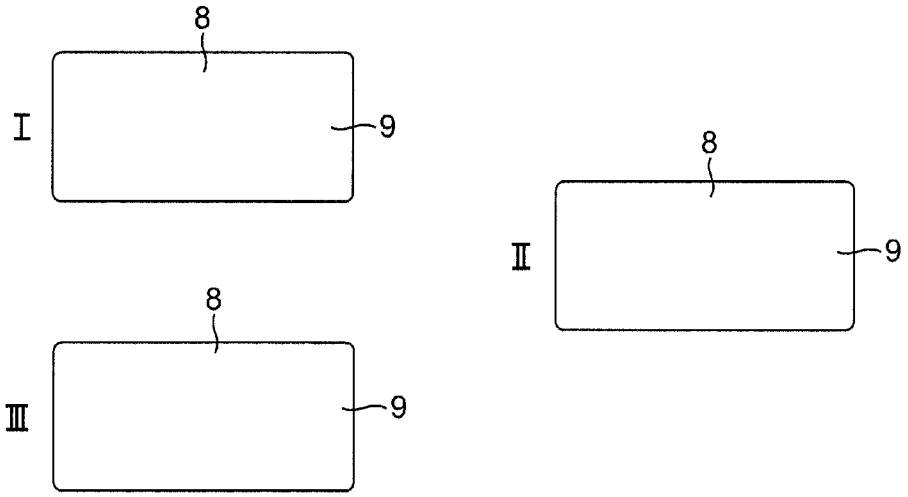

FIG. 30C is a second cross section of the rim of the thirtieth embodiment together with the liner shown in FIG. 30A;

FIG. 30D is a third cross section of the rim of the thirtieth embodiment together with the liner shown in FIG. 30A;

FIG. 31A is a top view of a thirty-first embodiment, a bin assembly, together with a liner lining the bin and secured by the ring;

FIG. 31B is a cross section of the rim of the thirty-first embodiment together with the liner shown in FIG. 31A;

FIG. 31C is a second cross section of the rim of the thirty-first embodiment together with the liner shown in FIG. 31A;

FIG. 32A is a top view of a thirty-second embodiment, a bin assembly, together with a liner lining the bin and secured by the ring and additionally shown in part in an enlargement;

FIG. 32B is a side view of a portion of the ring of the thirty-second embodiment;

FIG. 32C is a cross section of a portion of the ring of the thirty-second embodiment shown in FIG. 32A;

FIG. 33A is a top view of a thirty-third embodiment, a bin assembly, together with a liner lining the bin and secured by the ring;

FIG. 33B is a cross section of the rim of the thirty-third embodiment together with the liner shown in FIG. 33A;

FIG. 34A is a top view of a thirty-fourth embodiment, a bin assembly, together with a liner lining the bin and secured by the ring;

FIG. 34B is a side view of a portion of the thirty-fourth embodiment together with a liner lining the bin and secured by the ring;

FIG. 34C is a cross section of the rim of the thirty-fourth embodiment together with the liner shown in FIG. 34A;

FIG. 34D is a second cross section of the rim of the thirty-fourth embodiment together with the liner shown in FIG. 34A;

FIG. 35 is a cross section of a portion of a bin and a portion of a lid of a thirty-fifth embodiment, a bin assembly that includes a bin, a lid and a ring (unshown);

FIG. 36 is across section of a portion of a bin and a portion of a lid of a thirty-sixth embodiment, a bin assembly that includes a bin, a lid, and a ring (unshown);

FIG. 37 is a cross section of a portion of a bin and a portion of a lid of a thirty-seventh embodiment, a bin assembly that includes a bin and a lid;

FIG. 38 is a cross section of a portion of a bin and a portion of a lid of a thirty-eighth embodiment, a bin assembly that includes a bin and a lid;

FIG. 39 is a cross section of a portion of a bin and a portion of a lid of a thirty-ninth embodiment, a bin assembly that includes a bin and a lid;

FIG. 40 is a cross section of a portion of a bin and a portion of a lid of a fortieth embodiment, a bin assembly that includes a bin and a lid;

FIG. 41 is a cross section of a portion of a bin and a portion of a lid of a forty-first embodiment, a bin assembly that includes a bin and a lid;

FIG. 42 is a cross section of a portion of a bin and a portion of a lid of a forty-second embodiment, a bin assembly that includes a bin and a lid;

FIG. 43 is a cross section of a portion of a bin and a portion of a lid of a forty-third embodiment, a bin assembly that includes a bin and a lid;

FIG. 44 is a cross section of a portion of a bin and a portion of a lid of a forty-fourth embodiment, a bin assembly that includes a bin and a lid;

FIG. 45 is a cross section of a portion of a bin, a portion of a ring, and a portion of a lid of a forty-fifth embodiment, a bin assembly that includes a bin, a ring, and a lid;

FIG. 46 is a cross section of a portion of a bin, a portion of a ring, and a portion of a lid of a forty-sixth embodiment, a bin assembly that includes a bin, a ring, and a lid;

FIG. 47 is a cross section of a portion of a bin, a portion of a ring, and a portion of a lid of a forty-seventh embodiment, a bin assembly that includes a bin, a ring, and a lid;

FIG. 48 is a cross section of a portion of a bin and a ring joined by a hinge of a forty-eighth embodiment;

FIG. 49 is a cross section of a portion of a bin and a ring joined by a hinge of a forty-ninth embodiment;

FIG. 50 is a cross section of a portion of a bin and a ring joined by a hinge of a fiftieth embodiment;

FIG. 51 is a perspective view of a set of three liners of a fifty-first embodiment in which each liner of the set is a part of a bin assembly that includes a bin, ring, and liner in which the bin and ring are structurally identical to the bin and ring depicted in FIGS. 7A through 7T;

FIG. 52 is a perspective view of a set of three placards of a fifty-second embodiment, in which each placard of the set is a part of a bin assembly that includes a bin as structurally depicted in FIG. 1A; and FIG. 53 is a front view of a set of three labels of a fifty-third embodiment in which each label of the set is a part of a bin assembly that includes a bin as structurally depicted in FIG. 1A.

DETAILED DESCRIPTION

This present disclosure is directed to various embodiments of bins and various embodiments of bin assemblies. Embodiments of the bin assemblies of the present disclosure may include one or more liners, lids, rings, placards, and/or labels. The bins and bin assemblies of the present disclosure may be used as receptacles or as means of distribution. More specifically, the bins and bin assemblies define a chamber that may be used for collecting various materials or items (such as, for example, waste, recycling, composting, items for destruction, items for reuse, items for repurposing, items for donation, and items for cleaning, such as laundry) or for displaying, selling or otherwise distributing materials, bulk goods or other items. In one or more embodiments, a rim of the bin or a rim of the bin assembly may include readily observable content information for identifying and/or characterizing one or more items the bin or bin assembly is configured to receive or store, although in one or more alternate embodiments the rim may be provided without content information.

Additionally, in one or more embodiments, the bin assembly includes a ring, which, when the ring is engaged with a rim of bin, no portion of the ring is shared with an interior surface of the chamber. Accordingly, the one or more items received or stored in the chamber may be removed by overturning the bin without the risk that the contents will contaminate the ring.

In one or more embodiments, the bin assembly may include a ring and/or a lid that includes at least one discrete and non-continuous engagement mechanism for engaging the rim of the bin. The discrete and non-continuous engagement mechanisms may include a protrusion, a latch, a hook, an indentation, or combinations thereof.

In one or more embodiments, the bin assembly may define a channel below the rim that is configured to facilitate grasping the bin assembly. Accordingly, a user may grasp the bin assembly without having to insert his or hand into the chamber, which may be contaminated by the one or more items received or stored in the chamber.

Figure 1B:
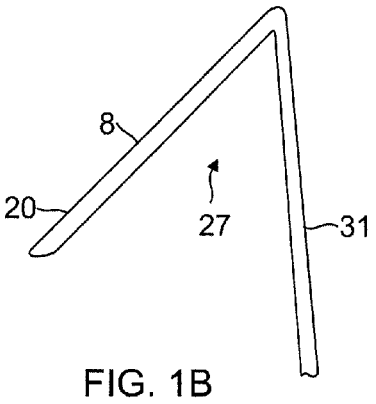
FIG. 1B is a partial cross-sectional view of an oblique lip and portion of an adjacent wall of the bin according to the first embodiment.
Figure 1C:
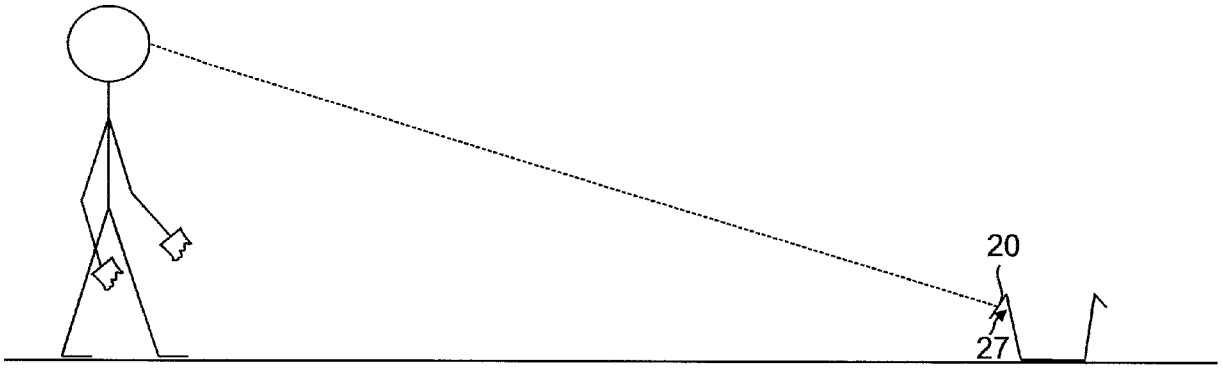
FIG. 1C depicts a cross section of the bin of the first embodiment and a potential user, specifically a potential depositor, who is holding in one hand a device, such as a smartphone, that is capable of reading machine-readable information, holding in the other hand an item for potential deposit, and seeing from a distance the oblique lip of the first embodiment.
Figure 1E:
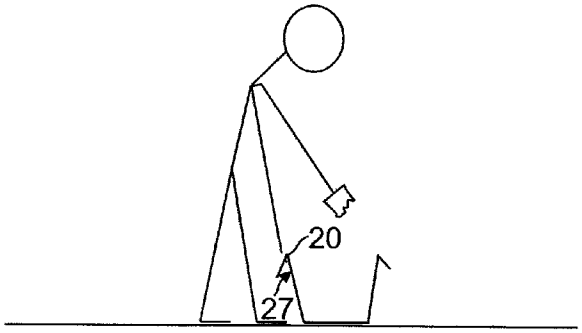
FIG. 1E depicts a cross section of the bin of the first embodiment and a potential user, specifically a potential depositor, accessing information by touch while standing at point of deposit.
Figure 1D:
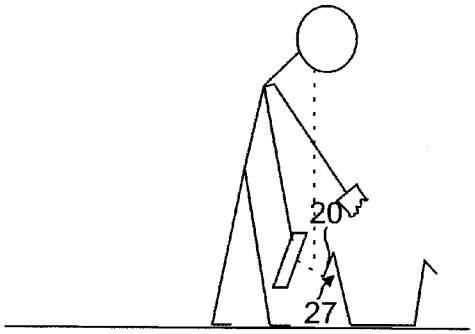
FIG. 1D depicts a cross section of the bin of the first embodiment and a potential user, specifically a potential depositor, accessing information by sight and by device, such as a smartphone, while standing at point of deposit.
Figure 1F:
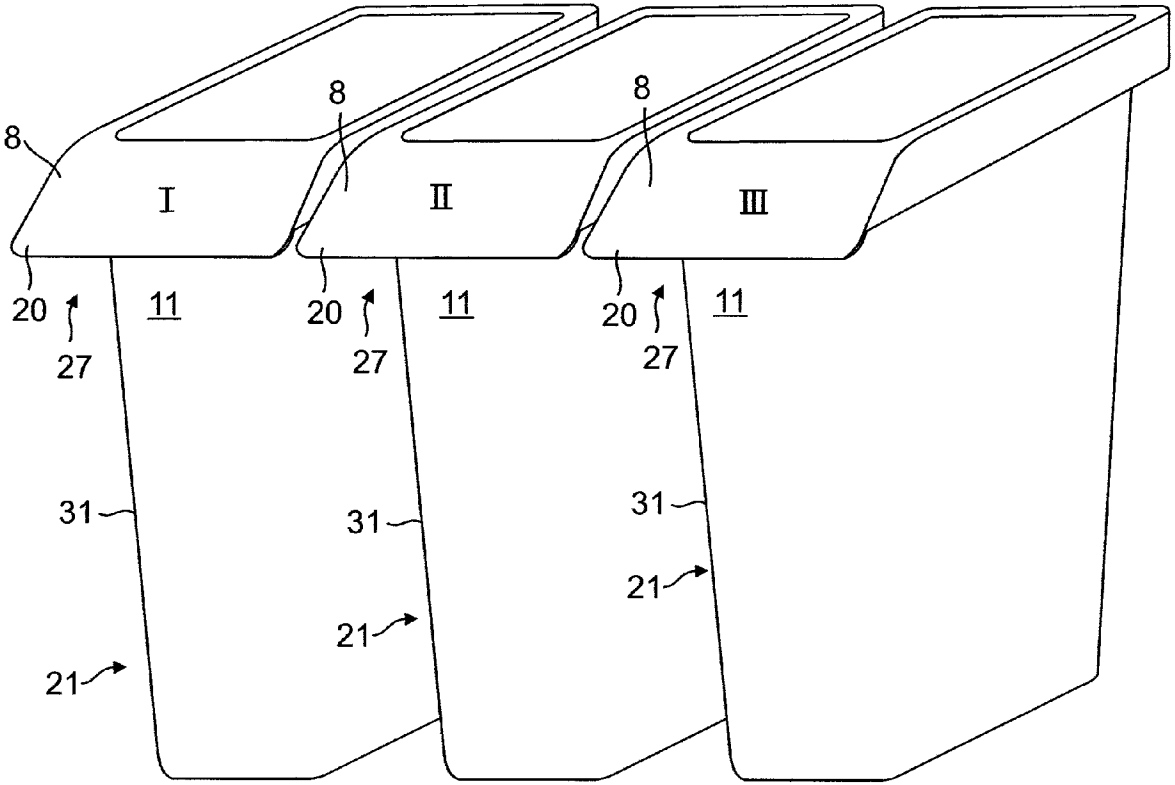
FIG. 1F depicts a set of three bins of the first embodiment arranged side by side.

With reference now to FIGS. 1A through 1G, the first embodiment of a bin 21 is illustrated. As discussed below, the rim 27 of the bin 21 of the first embodiment includes content information 8 on the oblique lip 20. (FIGS. 1B through 1E.) Multiple bins 21 permit efficient side-by-side arrangement for convenient comparison of content information 8. (FIG. 1F.) Any bin 21 nests in an identical bin 21 for efficient transportation and storage. (FIG. 1H.)

As shown in FIG. 1A, the rim 27 of the first embodiment has an asymmetric shape, and one side of the bin 21 is the front 11. The bin 21 has a wall 31, a bottom 33 and a mouth 23. Both the bottom 33 and mouth 23 are essentially rectangular.

The rim 27 includes that portion of the bin 21 that surrounds the mouth 23. The rim 27 joins and surrounds the wall 31. Other than at the front 11, the rim 27 includes a horizontal lip 28 and a vertical lip 29. (FIGS. 1A and 1B.)

On the front 11, an oblique lip 20 extends downward and outward from the wall 31. As shown on FIGS. 1A and 1B, except where it rounds as it joins the wall 31, the oblique lip 20 is angled at approximately 45° from horizontal (FIGS. 1A and 1B.). In one or more alternate embodiments, the oblique lip 20 may be angled at any other suitable angle within the range of less than approximately vertical (i.e., approximately 90° from horizontal) and more than approximately horizontal.

As shown in FIGS. 1A and 1B, content information 8 is found on the oblique lip 20 of the rim 27. The content information 8 includes information in one or more of the following six forms:

a. a writing;
b. a picture;
c. a symbol;
d. a form of machine-readable information, for example, a bar code, a Quick Response code; or an RFID tag;
e. a color which, through use at the bin 21 or otherwise, is associated with a bin content and which is different from the material color or surface color of a wall of the bin 21; and
f. a visually recognizable surface characteristic or material characteristic which, through use at the bin 21 or otherwise, is associated with a bin content and which is different from the surface characteristic or material characteristic of a wall of the bin 21.

Content information 8 includes the identity of items that are contained or intended to be contained within the chamber 45, including, for example, items or materials for sale, items for distribution without charge, waste, recycling, composting, items for destruction, items for reuse, items for repurposing, items for donation, and items for cleaning, such as laundry. Content information 8 further indicates the character of one or more such items, including the benefit of one or more items, a price of the one or more items, a source of the one or more items, manufacturing information regarding one or more items, processing information regarding one or more items, use of one or more items, a destination of one or more items, information regarding entities or individuals associated with one or more items, or combinations thereof.

While content information includes information that may assist or motivate users in adding to or removing from the contents of a bin, content information does not include information about the bin as opposed to its contents. Thus, for example, the following do not fall within the scope of "content information": the commercial product name, identifying number, or dimensions of the bin; the name, logo, identifier or contact information of the manufacturer of the bin; the name, logo, identifier or contact information of a manufacturer of a liner of the bin, or the specifications of such liner.

Certain advantages in accessing content information 8 at the rim 27, and specifically at the oblique lip 20, are shown in FIGS. 1C, 1D and 1F. Content information 8 at an oblique lip 20 may be seen by a potential user, such as a potential depositor, both from a distance (FIG. 1C) and when standing next to the bin 21. (FIG. 1D.) Also, when standing next to the bin, a potential user with an appropriate device, such as a smartphone, may conveniently access machine-readable content information 8. (FIG. 1D.) Further, when standing next to the bin, a potential user who is visually impaired may conveniently access content information 8 by touch. (FIG. 1E.) Content information 8 accessible by touch includes matters written in Braille and any picture, symbol or pattern expressed in three dimensions. (FIG. 1E.)

Figure 1G:
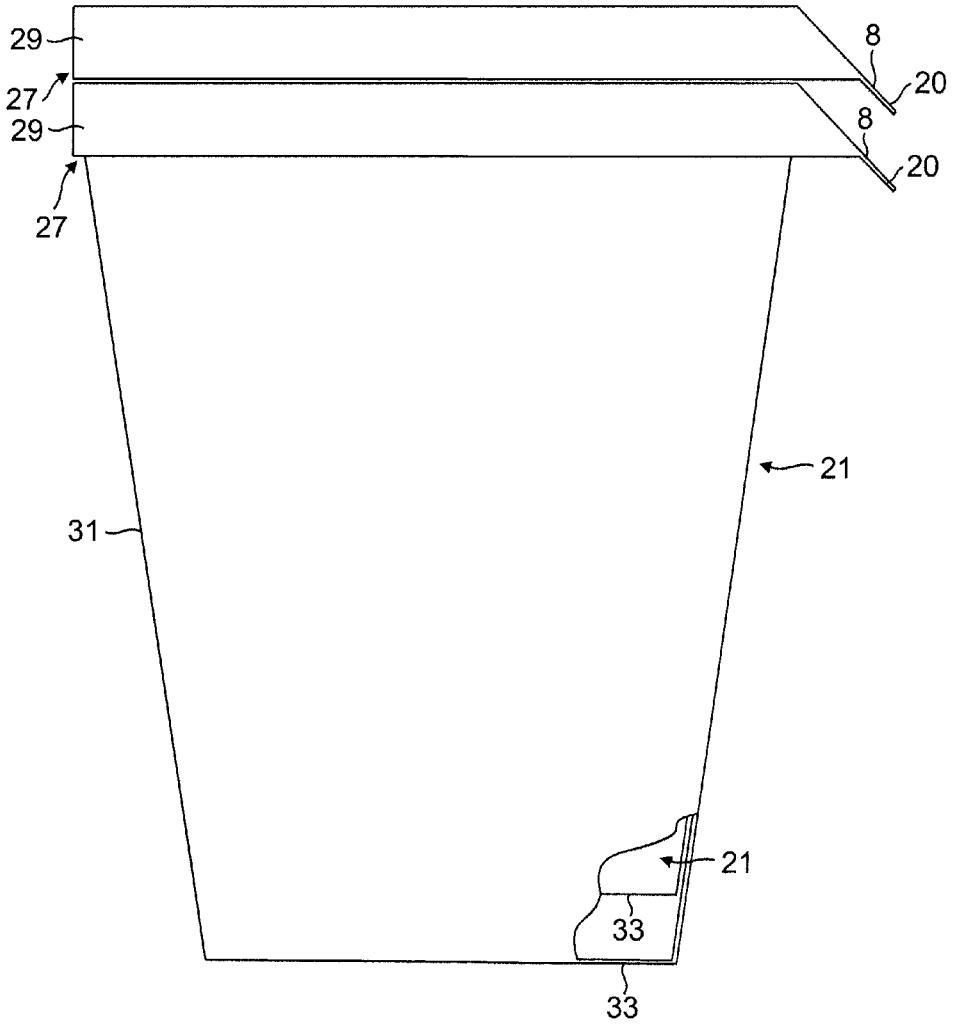
FIG. 1G is a side view of a set of two bins of the first embodiment, showing one of the bins nested in the other bin.

As depicted in FIG. 1G, bins 21 of the first embodiment nest one inside the other for efficient shipping and storage.

As shown in FIG. 1G, when a set of two or more bins 21 of the first embodiment have oblique lips 20 positioned at the same height and angle and these bins 21 are arranged side by side with their fronts 11 facing in the same direction, the oblique lips 20 form a side-by-side array for convenient comparison of their respective information.

The set of three bins 21 shown in FIG. 1F appear as bins I, II, and III. The content information 8 found on each bin 21 of the set is different than the content information 8 on each of the other bins 21 of the set. For example, the content information 8 of bin I may identify bin I's content or intended content as mixed recycling, including paper, specified plastics, and aluminum cans; the content information 8 of bin II may identify bin II's content or intended content as paper with information requiring destruction; and the content information 8 of bin III may identify bin III's content or intended content as trash.

Figure 2A:
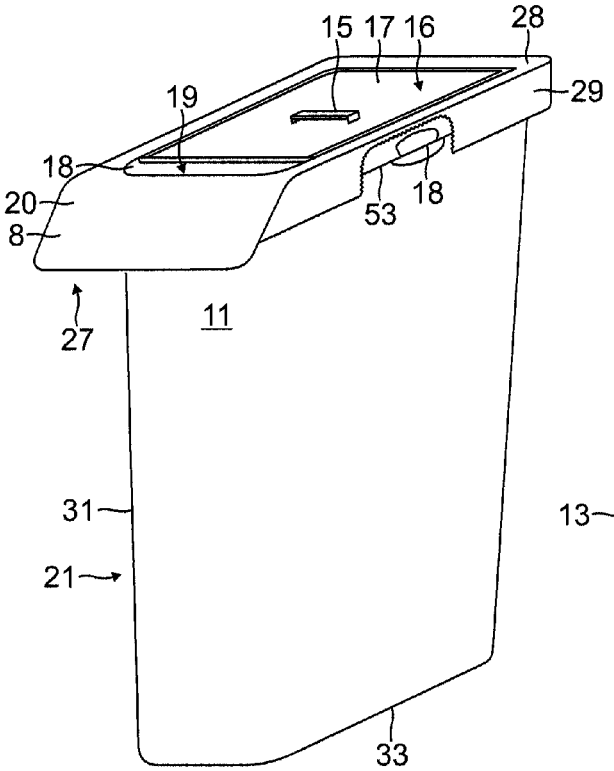
FIG. 2A is a perspective view of a second embodiment of a bin with information.

The second embodiment, shown in FIGS. 2A through 2F, is a bin assembly including a bin 21 and a lid 16. The characteristics of the bin 21 of the first embodiment, discussed above, are also characteristics of the bin 21 of the second embodiment, except that the rim 27 of the second embodiment includes a ledge 51 and a frame 53 to accommodate the lid 16. When the lid 16 is in place on the ledge 51 of the bin 21, the lid 16 does not interfere with the accessibility of information located on exterior surfaces of the rim 27. (FIG. 2A.) Nesting of the bins 21 of the second embodiment is same as in the first embodiment but, of course, a bin 21 cannot nest in an identical bin if the receiving bin 21 has the lid 16 in place.

As suggested above, in the second embodiment, the rim 27 has five basic elements: a ledge 51, which is horizontal; a frame 53, which is vertical; a horizontal lip 28; a vertical lip 29; and an oblique lip 20. (FIGS. 2A and 2D.) On all sides, the wall 31 joins the rim 27 at the ledge 51, and the ledge 51 joins the frame 53. At the front 11, the frame 53 joins the oblique lip 20. On the other three sides, the horizontal lip 28 extends outward from the frame 53, and the vertical lip 29 extends downward from the horizontal lip 28. (FIGS. 2A and 2D.)

The frame 53 will accommodate lids 16 that rest on the ledge 51 at all four sides of the mouth 23, but the lid 16 of the second embodiment does not rest on the ledge 51 at the front 11 of the bin 21. (FIG. 2A.)

Figure 2B:
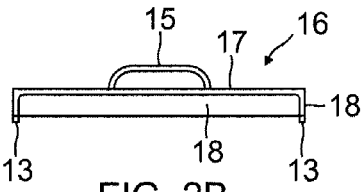
FIG. 2B is a front view of a lid of the second embodiment.
Figure 2C:
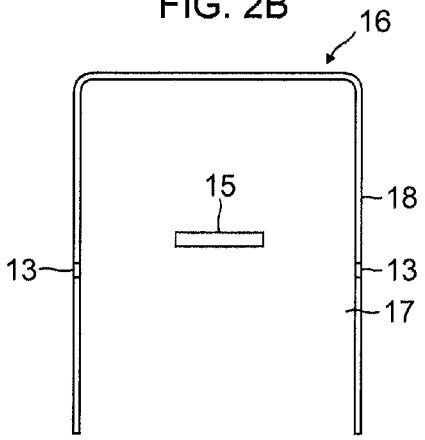
FIG. 2C is a bottom view of the lid of the second embodiment.
Figure 2D:
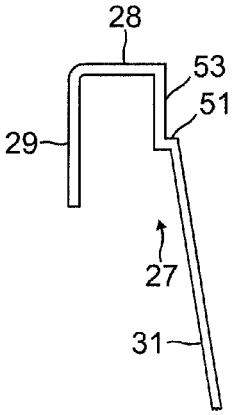
FIG. 2D is a cross section of the rim and a portion of the adjacent wall of the bin of the second embodiment.
Figure 2E:
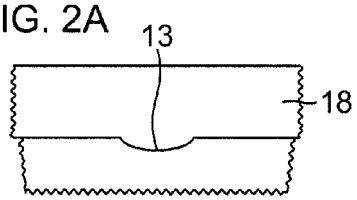
FIG. 2E is a side view of a portion of the lid of the second embodiment.
Figure 2F:
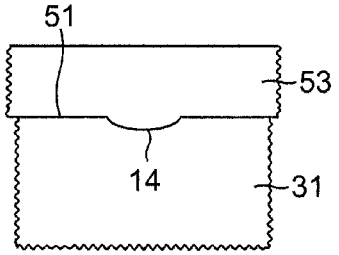
FIG. 2F is an interior view of a portion of the bin of the second embodiment.

As depicted in FIGS. 2B and 2C, which show a front view and bottom view respectively, the lid 16 of the second embodiment includes a handle 15, a cover 17 and a structure 18. The structure 18 extends vertically downward from the cover 17 on three sides.

As shown in FIG. 2A, when the lid 16 is placed on the bin 21, the mouth 23 is covered except for an opening 19. In the second embodiment, the opening 19 is elongated and adjacent to the oblique lip 20. (FIG. 2A.) On all sides other than the front 11, the structure 18 rests on the ledge 51. (FIGS. 2A, 2B, 2C, and 2D.)

To fit the rim 27 at a single location and leave a single opening 19 adjacent to the oblique lip 20, the lid 16 includes an element that fits into a reciprocal element of the rim 27. Specifically, at each of the two parallel sides of the structure 18, a downward facing bump 13 fits into a reciprocal depression 14 in the ledge 51. (FIGS. 2B, 2C, 2E and 2F.)

The opening 19 accommodates media containing data or information, and the content information 8 on the oblique lip 20 identifies the content of the bin 21. (FIG. 2A.) For example, the opening 19 may accommodate paper, and the content information 8 on the oblique lip 20 may identify the content as confidential documents for shredding or other destruction.

Figure 3:
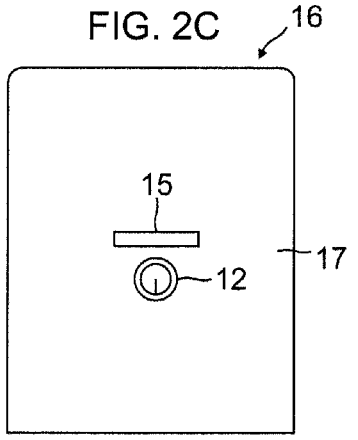
FIG. 3 is a top view of a lid according to a third embodiment.

The third embodiment, shown in part in FIG. 3, is identical to the second embodiment, shown in FIGS. 2A through 2F and described above, except that the lid 16 of the third embodiment has a lock 12 and locking mechanism (not shown) and, corresponding to the locking mechanism, the bin 21 has one or more reciprocal elements (not shown). The lock 12, which allows a key (not shown) to lock and unlock the mechanism, is shown in FIG. 3, a top view of the lid 16 of the third embodiment.

Where a bin 21 of the second or third embodiments has an oblique lip 20 positioned at the same height and angle as each of the oblique lips 20 of a set of bins 21 of the first embodiment, the bin assembly of the second embodiment, or, alternatively, the bin assembly of the third embodiment, may be included in the set of bins 21 of the first embodiment without diminishing the set's capacity for side-by-side comparison of content information 8. For example, among the set of bins 21 of the first embodiment depicted in FIG. 1F, bin II of the first embodiment may be replaced with an assembly of the second or third embodiment without diminishing the set's capacity for side-by-side comparison of content information 8. (FIGS. 1F, 2A through 2F, and 3.)

Figure 4A:
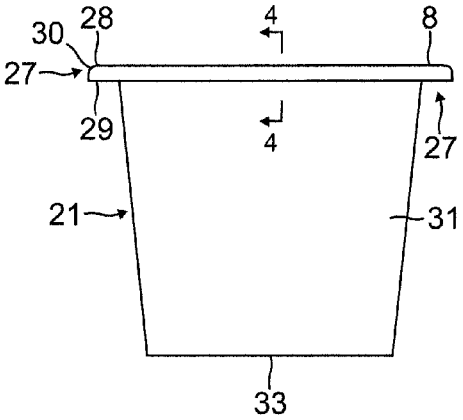
FIG. 4A is a side view of a fourth embodiment of a bin.

The fourth embodiment, shown in FIGS. 4A through 4D3, is a bin 21 in which the information is found at a horizontal lip 28, a vertical lip 29, and a curved lip 30. Like bin 21 of the first embodiment, any bin 21 of the fourth embodiment nests in an identical bin 21 for efficient transportation and storage. (Compare FIG. 4A with FIG. 1G.)

The content information 8 of the fourth embodiment includes information in one or more of the six forms listed in the description of the first embodiment, and pertains to the identity or character of the items that are contained or intended to be contained within bin 21, as described immediately after the list of six forms in the description of the first embodiment.

Figure 4B:
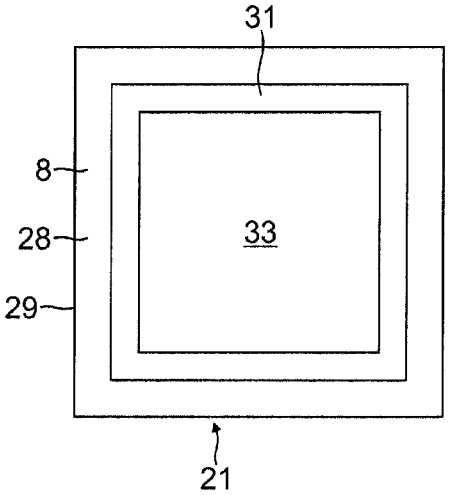
FIG. 4B is a top view of the bin of the fourth embodiment.
Figure 4C:
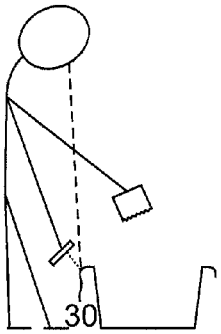
FIG. 4C depicts a cross section of a rim and a portion of the adjacent wall of the bin of the fourth embodiment.
Figure 4C:
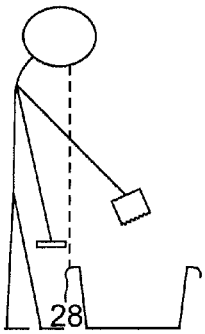
Figure 4C:
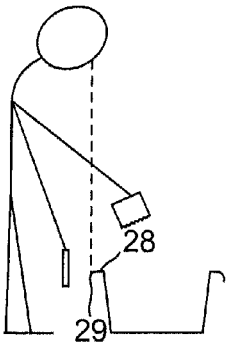
Figure 4C:
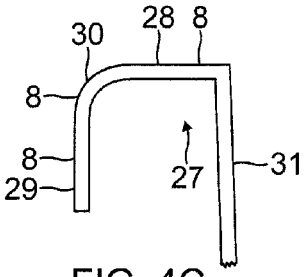

As shown in FIGS. 4A and 4B, the wall 31 rises from an essentially rectangular bottom 33, and a rim 27 joins and surrounds the wall 31, which is tapered to permit nesting of the bin 21. As shown in more detail in FIG. 4C, the rim 27 includes a horizontal lip 28, a vertical lip 29, and a curved lip 30 which transitions between the horizontal lip 28 and the vertical lip 29. Content information 8 is found on each of these three elements of the rim 27.

As depicted in FIGS. 4D1 and 4D3, a potential user, such as a potential depositor, when standing next to the bin, can see the content information 8 on the horizontal lip 28 and on the curved lip 30. As depicted in FIGS. 4D1, 4D2, and 4D3, a potential user, when standing next to the bin with an appropriate device, such as a smartphone, may access machine-readable information located on the horizontal lip 28, the vertical lip 29, and the curved lip 30.

The content information 8 of the fourth embodiment identifies the content or intended content. For example, the content information 8 of bin 21 of the fourth embodiment may identify the content of the bin 21 as expandable file folders for reuse.

Figure 5A:
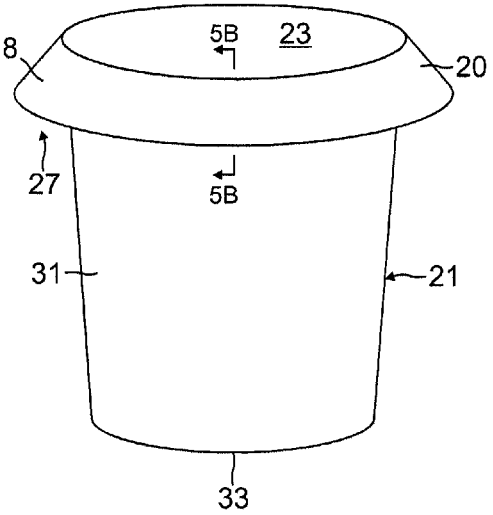
FIG. 5A is a perspective view of a fifth embodiment of a bin with information.
Figure 5B:
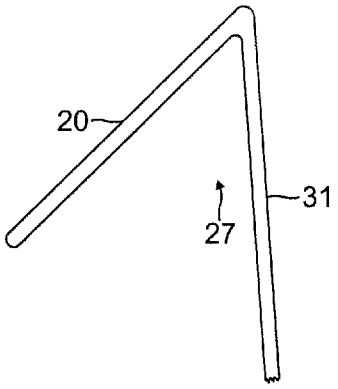
FIG. 5B depicts a cross section of a rim and a portion of the adjacent wall of the bin of the fifth embodiment.

The fifth embodiment, shown in FIGS. 5A and 5B, is a bin 21 with a circular bottom 33 and circular mouth 23. Like bin 21 of the first embodiment, any bin 21 of the fifth embodiment nests in an identical bin 21 for efficient transportation and storage. (Compare FIG. 5A with FIG. 1G.) The rim 27 joins and surrounds the wall 31, which is tapered and permits nesting.

Like the rim 27 of the first embodiment, the rim 27 of the fifth embodiment includes an oblique lip 20. Content information 8 is found at the oblique lip 20 which, in the fifth embodiment, surrounds the wall 31.

The content information 8 of the fifth embodiment includes information in one or more of the six forms listed in the description of the first embodiment, and pertains to the identity or character of the items that are contained or intended to be contained within the bin 21, as described immediately after the list of six forms in the description of the first embodiment.

The content information 8 of the fifth embodiment identifies the bin content or intended content. For example, the content information 8 of bin 21 of the fifth embodiment may identify the content of the bin 21 as Bubble Wrap for reuse in packing.

Figure 6B:
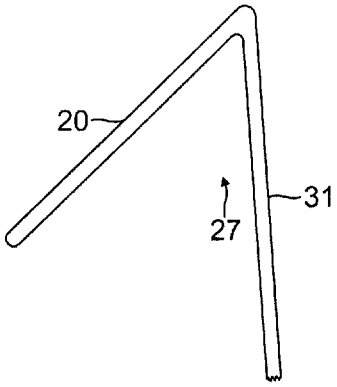
FIG. 6B depicts a cross section of a rim and a portion of the adjacent wall of the bin of the sixth embodiment.
Figure 6A:
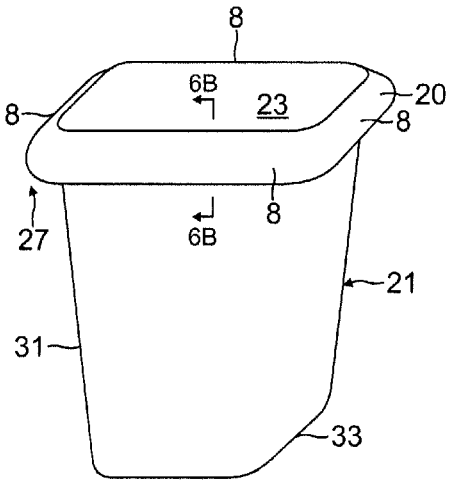
FIG. 6A is a perspective view of a sixth embodiment of a bin with information.

The sixth embodiment, shown in FIGS. 6A and 6B, has all of the structural characteristics of the fifth embodiment, as described above, except that a that bin 21 of the sixth embodiment has an essentially rectangular bottom 33 and essentially rectangular mouth 23 and the oblique lip 27 conforms to the essentially rectangular shape of the mouth.

Like all prior embodiments, the content information 8 of the sixth embodiment includes information in one or more of the six forms listed in the description of the first embodiment, and pertains to the identity or character of the items that are contained or intended to be contained within the bin 21, as described immediately after the list of six forms in the description of the first embodiment.

The content information 8 of the sixth embodiment identifies the bin content or intended content. For example, the content information 8 of bin 21 of the sixth embodiment may identify the content of the bin 21 as loose-fill cushioning material for reuse in packing.

The seventh embodiment, shown in FIGS. 7A through 7T, is a bin assembly that includes a bin 21 and a ring 61. The bin 21 of the seventh embodiment has the same information visibility and accessibility characteristics as the bin 21 of the second embodiment, including its structurally related capacity to permit side-by-side comparison of the content information 8 of similar bins. (Compare FIGS. 7A and 7B with FIG. 1F.) The bin 21 of the seventh embodiment also has the same structural characteristics as the bin 21 of the second embodiment except that, for the seventh embodiment, the bin 21 has been altered in several respects to accommodate the engagement and disengagement of the seventh embodiment's ring 61 and the ring 61's capability of securing a liner 35. Also, in FIG. 7B, the bin 21's chamber 45 is specifically identified.

The ring 61 of the seventh embodiment is, of course, different than the lid 16 of the second embodiment. While a bin 21 of the second embodiment cannot nest in an identical bin 21 if the receiving bin 21 has the lid 16 in place, a bin 21 and the engaged ring 61 of the seventh embodiment nest in an identical assembly in which the ring 61 and the bin 21 are also engaged. (FIG. 7S.) Further, while the lid 16 of the second embodiment must be removed from the bin 21 before overturning the bin 21 for emptying, the ring 61 of the seventh embodiment need not be removed from the bin 21 before overturning the bin 21 for emptying. (FIG. 7C.)

As depicted in FIGS. 7A and 7B, on all sides, the bin 21 accommodates a ring 61 that is capable of securing a liner 35 and, when engaged with the bin 21, the ring 61 is found at the periphery of the mouth 23. In the seventh embodiment, the rim 27 includes both the ring 61 and the following elements of the bin 21: a ledge 51, a frame 53, a bend 25, a horizontal lip 28, a vertical lip 29, and an oblique lip 20. (FIGS. 7A and 7B.)

The bin 21 of the seventh embodiment permits the attachment of the ring 61 with or without the liner 35. When the ring 61, or the ring 61 and liner 35, are attached to the bin 21, content information 8 on the oblique lip 20 remains accessible without interference of either the ring 61 or the ring 61 and liner 35. (FIGS. 7A and 7B.) If a liner 35 is attached, the liner 35 is wrapped over the ring 61 and the edge 38 of the liner 35 may be tucked into chamber 45 of the bin 21. (FIG. 7B.) Because edge 38 of the liner 35 is contained within the chamber 45 of the bin 21, neither the edge 38 nor the border 37 of the liner 35 interferes with the accessibility of content information 8 at the oblique lip 20.

Like all prior embodiments, the content information 8 of the seventh embodiment includes information in one or more of the six forms listed in the description of the first embodiment and pertains to the identity or character of the items that are contained or intended to be contained within the bin 21, as described immediately after the list of six forms in the description of the first embodiment.

To attach the ring 61 and the liner 35 to the bin 21 so that the liner 35 does not interfere with the accessibility of the content information 8, the ring 61 and bin 21 facilitate (1) wrapping the liner 35 over and under the ring 61 and (2) tucking the edge 38 of the liner 35 into the chamber 45 of the bin 21. (FIGS. 7A, 7B, and 7J through 7M.) To facilitate convenient installation of the liner 35, the ring 61 may be rested in a stable but unengaged position on the bin 21. (FIGS. 7J, 7K, and 7M.)

As depicted in FIG. 7C, when the ring 61 and liner 35 are attached to the bin 21, the ring 61 does not hinder or interrupt the flow of items or materials in or out of the bin 21, and the bin 21 may be emptied by overturning and shaking the bin 21 without detaching the ring 61 or the liner 35 from the bin 21. As depicted in FIG. 7R, the ring 61 may be deliberately disengaged from the bin 21, thus allowing replacement of the liner 35. Accordingly, while in some circumstances safety or sanitation may require disposal of a liner with its contents, repeated reuse and ultimate recycling of the liner itself may save time, energy, material and disposal costs.

The ring 61 engages with the bin 21 in an interference fit. When the liner 35 is installed in the bin 21 and secured, the liner 35 is clamped between the ring 61 and the bin 21. The interference fit occurs between interfacing vertical surfaces of the bin 21 and ring 61. The presence of the liner 35 between the two interfacing vertical surfaces tightens but does not prevent the interference fit. (FIGS. 7A, 7P and 7Q.)

As shown in FIGS. 7B and 7E, and in cross-sectional views 7H1 and 7H2, the ring 61 has two elements, a riser 69 and a cap 67. The riser 69 (a type of flange) is vertical and the cap 67 is horizontal.

As shown in FIG. 7D, a top view of the bin 21, and in FIG. 7G1, a cross section of the upper portion of the bin 21, on the three non-front sides, the portion of the bin 21 above or to the exterior of the wall 31 includes five basic elements: a ledge 51, a frame 53, a bend 25, a horizontal lip 28, and a vertical lip 29. The ledge 51 is horizontal and joins the frame 53, which is vertical and joins the bend 25. The bend 25 joins the horizontal lip 28, which extends outward and joins the vertical lip 29, which extends downward.

On the front 11, the portion of the bin 21 above the exterior of the wall 31 again includes five basic elements: the ledge 51, the frame 53, the bend 25, the horizontal lip 28, and the oblique lip 20. (FIGS. 7A, 7B, and 7D.) As on the other three sides, the ledge 51 is horizontal, and the frame 53 is vertical. (FIGS. 7D and 7G1.)

The interference fit of the ring 61 and the bin 21 occurs between the riser 69 and the frame 53. (FIGS. 7H1 and 7G1, and 7H2 and 7G2.) On all sides of the bin 21, the frame 53 joins the horizontal lip 28 at bend 25, (FIGS. 7G1 and 7D.) The bend 25 is rounded to facilitate the engagement of two vertical elements, the riser 69 and the frame 53. (FIGS. 7G1 and 7I1.)

As shown in FIG. 7D, a slot 43, a type of aperture, is found on each of the two opposing non-front sides of the bin 21. The slots 43 are visual cues that signal a method of disengaging the ring 61 and removing the liner 35. The slots 43 are also means for disengaging the ring 61 and removing the liner 35. When installing the liner 35, the slots 43 also facilitate venting of the bin 21.

Within each of the slots 43, a base 49 lies between the frame 53 and the vertical lip 29. (FIGS. 7D and 7G2.) At each of the two ends of each slot 43, a panel 46 connects the horizontal lip 28 with the base 49. The panels 46 also connect the frame 53 with the vertical lip 29. (FIGS. 7B, 7D and 7G1.)

A method for installing and securing the liner 35 is shown in FIGS. 7F through 7Q.

First, as shown in FIG. 7J, the ring 61 is placed on the bin 21 in a stable but unengaged position. A top view of this position is shown in FIG. 7F and, as shown in cross-sectional FIGS. 7I1 and 7I3, in this position the riser 69 rests at the bend 25. However, as depicted in FIG. 7I2, the riser 69 is suspended across the slots 43.

Second, as shown in FIG. 7K, an appropriately-sized liner 35 is inserted in the bin 21 so that the liner 35 lines the bottom 33 and wall 31 of the bin 21 and the edge 38 and border 37 of the liner 35 drape over the ring 61 while the ring 61 remains in the stable but unengaged position. In this position, at three sides of the bin 21, the edge 38 and border 37 hang loosely from the cap 67; on the front 11, the edge 38 rests on the oblique lip 20.

Third, as shown in FIG. 7L, the ring 61 and liner 35 are raised and the edge 38 is tucked under the ring 61 and into the bin 21's chamber 45. (FIGS. 7L and 7B.)

Fourth, as shown in FIG. 7M, the ring 61, with the overdraped and undertucked liner 35, is returned to the stable but unengaged position on the bin 21.

Fifth, before engaging the ring 61 and securing the liner 35, the liner 35 and bin 21 may be vented, thus allowing air trapped between the liner 35 and the bin 21 to escape. (FIGS. 7M and 7N3.) To do so, the ring 61 and undertucked liner 35 may be slightly lifted with one hand from the bend 25 on one side one of the bin 21 while the other hand collapses the liner 35 against bottom 33 and wall 31. Additionally, at one or both slots 43, the edge 38 of the liner 35 and a portion of the border 37 of the liner 35 maybe tucked up and between the liner 35 and the ring 61 so that the border 37 does not block air from escaping through the slot(s) 43. (FIG. 7N2.) Tucking the edge 38 and border 37 upward at the slot 43 may cause similar but less pronounced upward tucking in close proximity to the slot 43. (FIGS. 7N1 and 7F.) Elsewhere, the edge 38 and border 37 hang loosely between the bin 21 and the liner 35 lining the bin 21. (FIG. 7N3.)

Sixth, from the stable but unengaged position with an overdraped and undertucked liner 35, the ring 61 is engaged with the bin 21, and the liner 35 is secured, by exerting a downward force on the cap 67 of the ring 61. (FIGS. 7M and 7P.) Pushed downward, the ring 61 is stopped by the cap 67 abutting the horizontal lip 28 and, simultaneously, the riser 69 abutting the ledge 51. (FIGS. 7P and 7Q.) In this position, the liner 35 is clamped between these abutting elements as well as between the elements forming the interference fit, the riser 69 and the frame 53. (FIGS. 7P and 7Q.)

Seventh, if there is any excess liner 35 visible on the exterior of the bin assembly, the excess liner 35 is slid into the bin 21, so that excess liner 35 does not extend below the cap 67 on the visible exterior of bin 21. (FIG. 7A.)

To remove the ring 61 and the liner 35 from the bin assembly, the ring 61 may be deliberately pried from the bin 21. The slots 43 are directly observable from the exterior of the bin 21 and provide convenient means of prying the ring 61 from the bin 21. One or more fingers of each of two hands may be inserted in the opposing slots 43 so that the nails of the fingers lie against the bases 49. (FIGS. 7B, 7D, 7P and 7Q.) By bending the tips of the fingers upward at each of the two slots 43, thus exerting upward forces on the caps 67 and downward forces on the bases 49, the ring 61 is disengaged from the bin 21, thus allowing removal and replacement of the liner 35. (FIG. 7R.) In removing a used liner 35, or a used liner 35 and its contents, it is not necessary to touch any surface of the mouth 23 or chamber 45 or to touch any surface that lined the mouth 23 or chamber 45.

An engaged ring and bin assembly of the seventh embodiment nests in an identical ring and bin assembly in which the ring 61 and the bin 21 are also engaged. (FIG. 7S.) As depicted in 7T, when two bin assemblies of the seventh embodiment nest one inside the other, the wall 31 of the upper bin assembly fits within the ring 61 of the lower bin assembly.

Where a set of two or more bins 21 of the seventh embodiment have oblique lips 20 positioned at the same height and angle and these bins 21 are arranged side by side with their fronts 11 facing in the same direction, the oblique lips 20 form a side-by-side array for convenient comparison of their respective content information 8. (FIG. 7A; compare with FIG. 1F.)

An engaged bin assembly of the seventh embodiment, regardless of whether a liner 35 is also present, may be lifted by the rim 27 with one hand in a sanitary manner. (FIGS. 7A, 7B, and 7Q). Specifically, fingers or ends of fingers, with palm facing up, may be inserted into a channel 79, which, in the seventh embodiment, is found between the vertical lip 29 and the frame 53 (FIG. 7Q) and, at the front of the bin 21, between the oblique lip 20 and the wall 31 (FIG. 7P). By grasping the rim 27 with fingers or parts of fingers inserted in the channel 79 in this manner, the bin assembly may be lifted with one hand without touching the lined or unlined wall 31 that faces the chamber 45 or otherwise touching the lined or unlined chamber 45, which may be soiled or contaminated by bin contents.

The content information 8 of the seventh embodiment identifies the bin content or intended content. For example, like the content information 8 of the bin III of the first embodiment, the content information 8 of the bin 21 of the bin assembly of the seventh embodiment may identify the bin content as trash. (FIGS. 1F, 7A, and 7B.)

Figure 8:
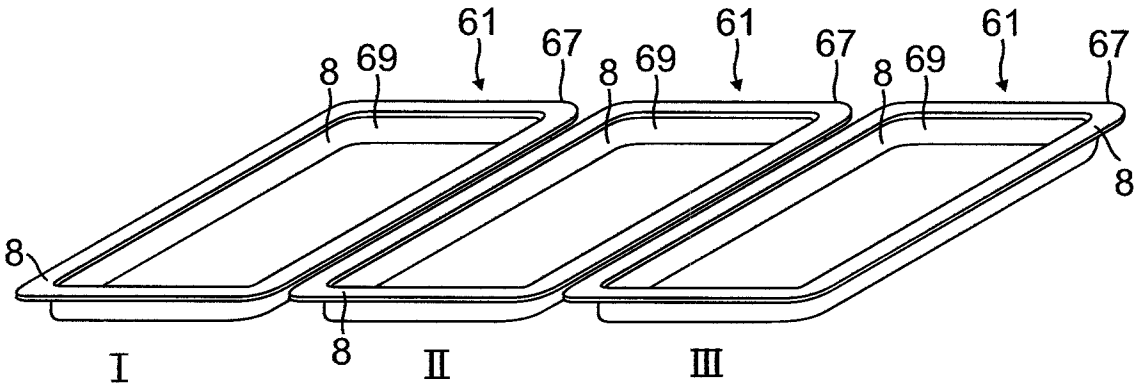
FIG. 8 is a perspective view of three rings of an eighth embodiment in which each ring is part of a bin assembly, the bin of which is depicted in FIG. 7B.

The eighth embodiment, shown in FIGS. 8 and 7B, is a set of rings 61 with content information 8 and a bin 21 of the seventh embodiment such that (1) the content information 8 of each ring 61 is distinguishable from the content information 8 of every other ring 61 of the set and (2) the bin 21 and each ring 61 forms a bin assembly.

The three rings 61 of the eighth embodiment are depicted in FIG. 8 and the bin 21 is depicted in FIG. 7B. The eighth embodiment allows the formation of each of three bin assemblies, and each such assembly is further shown in FIGS. 7A through 7T and described in the description of seventh embodiment.

The set of three rings 61 of the eighth embodiment, as depicted in FIG. 8, are rings I, II, and III. The content information 8 of rings I, II, and III are found at their caps 67 and risers 69 and include information in one or both of the two following forms:

a. a color which, through use at the bin 21 or otherwise, is associated with a bin content or intended content identified by a writing, a picture, a symbol, or a form of machine-readable information on the bin 21 or on an attachment attached to the bin 21;

b. a visually recognizable surface or material characteristic which, through use at the bin 21 or otherwise, is associated with a bin content or intended content identified by a writing, a picture, a symbol, or a form of machine-readable information on the bin 21 or on an attachment attached to the bin 21.

Like all prior embodiments, the content information 8 of the eighth embodiment includes information that pertains to the identity or character of the items that are contained or intended to be contained within the bin 21, as described immediately after the list of six forms in the description of the first embodiment.

The content information 8 of each of the rings 61 may be associated with a different bin content or intended content. For example, the content information 8 of ring I may be a color associated with composting, the content information 8 of ring II may be a color associated with recycling plastic bottles and aluminum cans, and the content information 8 of ring III may be a color and texture associated with recycling dry cardboard. In this example, rings I and II may secure liners 35 and these liners 35 would be transparent, while ring III may be attached directly to the bin 21 without the use of any liner 35.

Figure 9A:
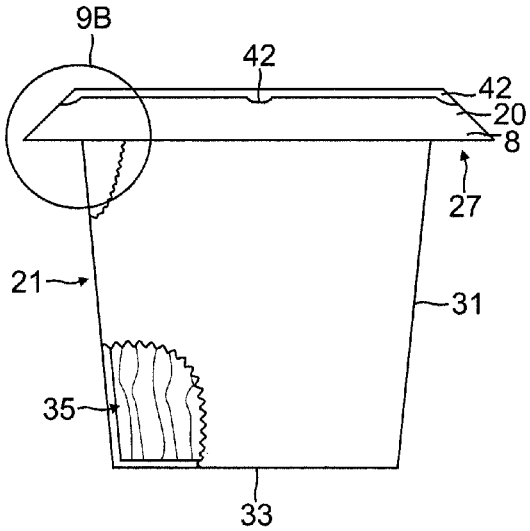
FIG. 9A is a side view of a ninth embodiment, a bin assembly, shown with a liner lining the bin and secured by the ring.

The ninth embodiment, shown in FIGS. 9A through 9J, is a bin assembly that includes a bin and a ring. The following ring-related characteristics of the ninth embodiment are shared by the seventh embodiment as well as other embodiments not yet described in detail:

1. The ring 61 engages with the bin 21. (FIGS. 9C, 9E, 9G, and 9I; compare with FIGS. 7A and 7B.)
2. When the ring 61 is engaged with the bin 21, the engaged bin assembly nests in an identical bin assembly in which the ring 61 and bin 21 are also engaged. (FIGS. 9A, 9C, and 9I; compare with FIGS. 7S and 7T.)
3. When the ring 61 is engaged with the bin 21 and the bin 21 is overturned for emptying, the ring 61 does not block or interfere with the flow of articles out of the bin. (FIGS. 9A, 9C, and 9I; compare with FIG. 7C.)
4. In a bin assembly that is capable of securing a liner 35, the liner 35 is installed in the bin 21 so that, upon the ring 61's engagement with the bin 21, the liner 35 is secured between the engaged ring 61 and bin 21. (FIG. 9I; compare with FIGS. 7P and 7Q.)
5. When the liner 35 is secured between the ring 61 and the bin 21, the edge 38 of the liner 35 is contained within the chamber 45 or within the bin's rim 27. (FIGS. 9A and 9I; compare with FIGS. 7A, 7M and 7Q.)
6. When the liner 35 is properly installed in the bin and secured between the ring 61 and the bin 21, the liner 35 covers part of the rim 27 but does not interfere with the visibility or accessibility of content information 8 located on the rim 27. (FIGS. 9A, 9B, and 9I; compare with FIGS. 7A and 7B.)
7. When the liner 35 is secured between the ring 61 and the bin 21, the lined bin 21 may be overturned and emptied without disengaging the ring 61 or detaching the liner 35. FIG. 9A; compare with FIG. 7C.)
8. When the liner 35 is secured between the ring 61 and the bin 21, no interior-facing surface of the ring 61 or bin 21 is unprotected by the liner 35. (FIGS. 9A, 9I and 9J; compare with FIGS. 7A and 7Q.)
9. When the ring 61 is engaged with the bin 21, the bin 21 may be grasped by the rim 27 by inserting all or part of the fingers of a hand, palm up, into a channel 79 which, in the ninth embodiment, is found between oblique lip 20 and the wall 31, and thereby lifting the bin 21 with one hand without touching the lined or unlined chamber 45. (FIGS. 9I and 9J; compare with FIGS. 7P and 7Q.)
10. When the ring 61 is engaged with the bin 21, regardless of whether a liner 35 is also present, the means of disengagement include a discrete, non-continuous feature that is located on the rim 27, that is directly observable from the exterior of the rim 27, and provides or indicates a point of contact for disengaging the ring 61 from the bin 21. (FIGS. 9A and 9B; compare with FIGS. 7P and 7R.)
11. When the ring 61 is engaged with the bin 21, regardless of whether a liner 35 is also present, a user may disengage the ring 61 from the bin 21 without touching the lined or unlined chamber 45 and, similarly, a user may remove any liner 35 from the bin 21 without touching a surface that directly faced the chamber 45 of the bin 21. (FIGS. 9A, 9I and 9J; compare with FIGS. 7A, 7B, 7D, 7G1 and 7G2.)

In addition to the above enumerated characteristics that the ninth and seventh embodiments share with other embodiments not yet described in detail, the ninth embodiment shares four other characteristics with the seventh embodiment:

a) The ring 61 engages with the bin 21 by an interference fit. (FIGS. 9C, 9E, 9G, and 9I; compare with FIGS. 7I1, 7I2, 7I3, 7P and 7Q.)
b) in securing a liner 35, the ring 61 may be rested on the bin 21 in a stable but unengaged position. (FIGS. 9E through 9H; compare with FIGS. 7I1 through 7N3.)
c) In securing a liner 35, the liner 35 is wrapped over and under the ring 61 before the ring 61 is engaged with the bin 21. (FIGS. 9E through 9J; compare with FIGS. 7I1 through 7P.)
d) The content information 8 of the rim 27 is found at the oblique lip 20. (FIGS. 9A, 9B and 9C; compare with FIG. 7B.)

The content information 8 of the ninth embodiment includes information in one or more of the six forms listed in the description of the first embodiment and pertains to the identity or character of the items that are contained or intended to be contained within the bin 21, as described immediately after the list of six forms in the description of the first embodiment.

Figure 9B:
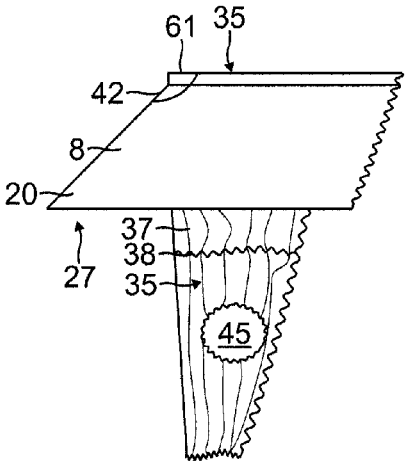
FIG. 9B depicts an enlarged side view of a portion of the bin assembly of the ninth embodiment.
Figure 9C:
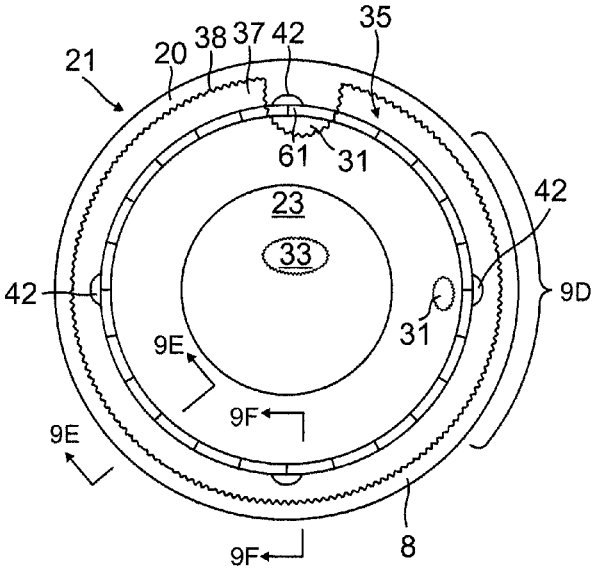
FIG. 9C is a top view of the bin of the ninth embodiment in which the ring is resting on the bin in a stable but unengaged position and a liner has been inserted in the bin so that the liner lines the bin and drapes over the ring and a portion of the lip.
Figure 9D:
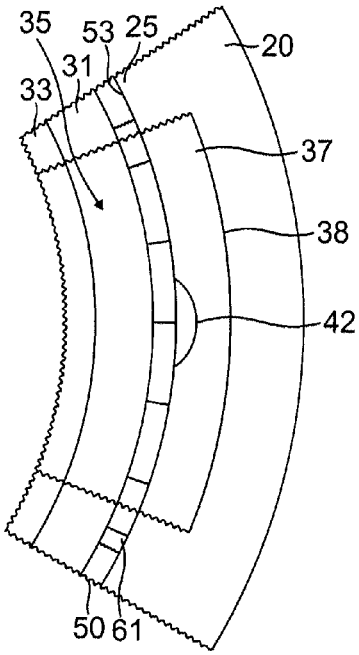
FIG. 9D depicts an enlarged top view of a portion of the ninth embodiment depicted in FIG. 9C.
Figure 9E:
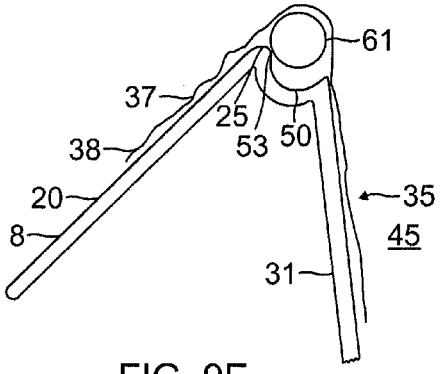
FIG. 9E is a cross section of the rim of the ninth embodiment shown in FIG. 9C with an overdraped liner and the ring resting beneath the overdraped liner in a stable but unengaged position.
Figure 9F:
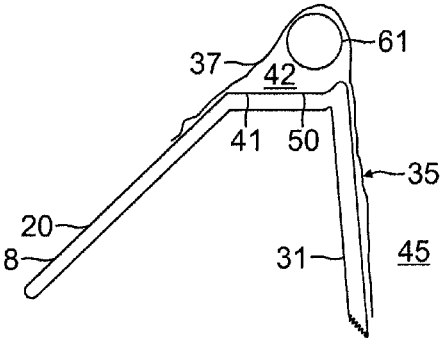
FIG. 9F is another cross section of the rim of the ninth embodiment shown in FIG. 9C with an overdraped liner and the ring resting beneath the overdraped liner in a stable but unengaged position.

As shown in FIG. 9C, both the bottom 33 and the mouth 23 of the bin 21 are circular. The portion of the bin 21 that surrounds the mouth 23 is also circular and has four basic elements, each of which is also circular: a bed 50, a frame 53, a bend 25, and an oblique lip 20. (FIGS. 9A through 9E.) The bed 50 connects to the wall 31. (FIG. 9C.) Proceeding outward, the bed 50 joins the frame 53, which is vertical. (FIGS. 9C, 9D, and 9E.) The bend 25 connects the frame 53 to the oblique lip 20. (FIGS. 9C, 9D, and 9E.) At 90 degree intervals, each of four grooves 42, a type of aperture, is formed by coving 41, which interrupts the upper portion of the oblique lip 20 and joins the bed 50. (FIGS. 9B, 9C, 9D, and 9F.)

Figure 9G:
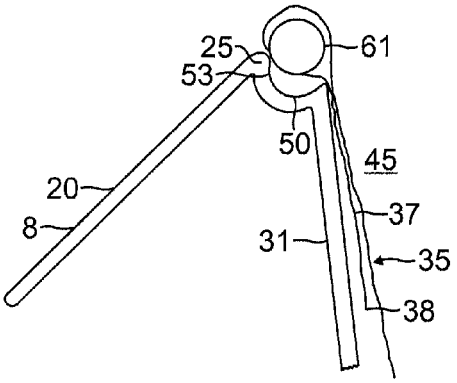
FIG. 9G is a cross section of the rim of the ninth embodiment shown in FIG. 9E but with the overdraped liner now tucked beneath the ring and the ring resting in a stable but unengaged position directly on the undertucked liner and indirectly on the bin.
Figure 9H:
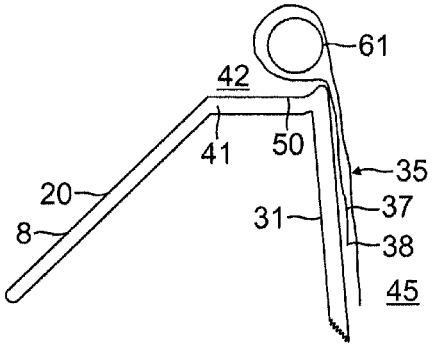
FIG. 9H is a cross section of the rim of the ninth embodiment shown in FIG. 9F but with the overdraped liner now tucked beneath the ring and the ring resting in a stable but unengaged position directly on the undertucked liner and indirectly on the bin.
Figure 9I:
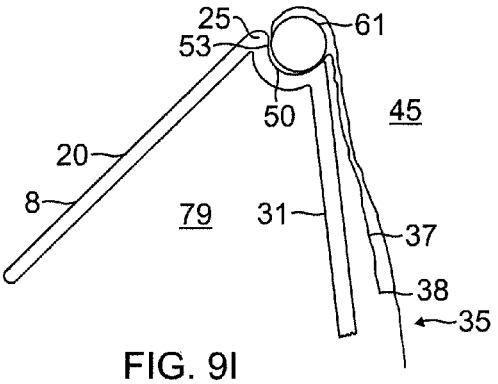
FIG. 9I is a cross section of the rim of the ninth embodiment shown in FIG. 9G, but the ring has now been pushed downward so that the ring is engaged with the bin and secures the liner.
Figure 9J:
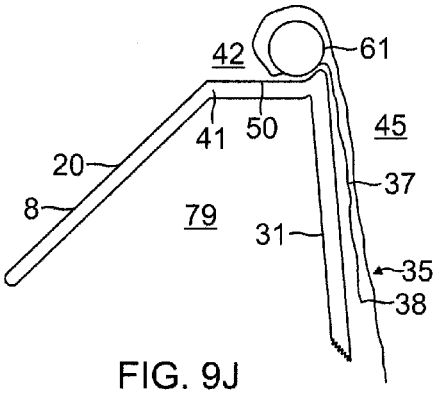
FIG. 9J is a cross section of the rim of the ninth embodiment shown in FIG. 9H, but the ring has now been pushed downward so that the ring is engaged with the bin and secures the liner.

The method of installing and securing the liner 35, which is essentially the same as the method depicted and described for the seventh embodiment, is depicted in FIGS. 9C through 9I. The ring 61 is placed at the bend 25 in a stable but unengaged position and the liner 35 is inserted in the bin 21 so that the liner 35 lines the base 33 and wall 31 of the bin 21, and the edge 38 and the border 37 of the liner 35 drape over the ring 61 onto the oblique lip 20. (FIGS. 9C, 9D, 9E and 9F.) The ring 61 and liner 35 are lifted from the positions shown in FIGS. 9E and 9F, and the edge of the liner 35 is tucked beneath the ring 61 and the ring 61 is returned to its stable but unengaged position with the liner 35 tucked beneath the ring 61 and extending into the bin 21. (FIGS. 9G and 9H.) Before engaging the ring 61 and securing the liner 35, the bin 21 may be vented to allow any air trapped between the liner 35 and the bin 21 to escape. Upon venting the bin 21, the ring 61, with the overwrapped and undertucked liner 35, may be returned to a stable but unengaged position at the bend 25. (FIGS. 9G and 9H.) Downward forces on the ring 61, which is wrapped in the overdraped and undertucked liner 35, push the ring 61 to the bed 50 with the liner 35 clamped between the ring 61 and the bed 50. (FIGS. 9I and 9J.)

A groove 42, like a slot 43 of the seventh embodiment, is a type of aperture and a non-continuous means of disengagement at discrete locations on the rim 27. The grooves 42 are directly observable from the exterior of the bin and provide a user with a discrete point of contact for disengaging the ring 61 from the bin 21 and for removal of any liner 35. (FIGS. 9A, 9B, and 9I; compare with FIG. 7R.) To disengage the ring 61, a thumb is inserted, with the thumbnail facing up, in one or more of the grooves 42. (FIG. 9J.) By sliding the thumbnail beneath the ring 61 and undertucked liner 35, an upward force may be exerted on the ring 61 and a downward force on the coving 41 causing the ring 61 to be lifted at the groove 42. (FIGS. 9J and 9H.) By thus prying the ring 61 upward at one or more of the grooves 42, the ring 61 is lifted above the frame 53, thus allowing for the removal of the ring 61 and replacement of the liner 35. (FIG. 9G.)

The tenth embodiment, shown in FIGS. 10 and 9A through 9J, is a set of rings 61 with content information 8 and a bin 21 of the ninth embodiment such that (1) the content information 8 of each ring 61 is distinguishable from the content information 8 of every other ring 61 of the set and (2) the bin 21 and each ring 61 form a bin assembly.

Figure 10:
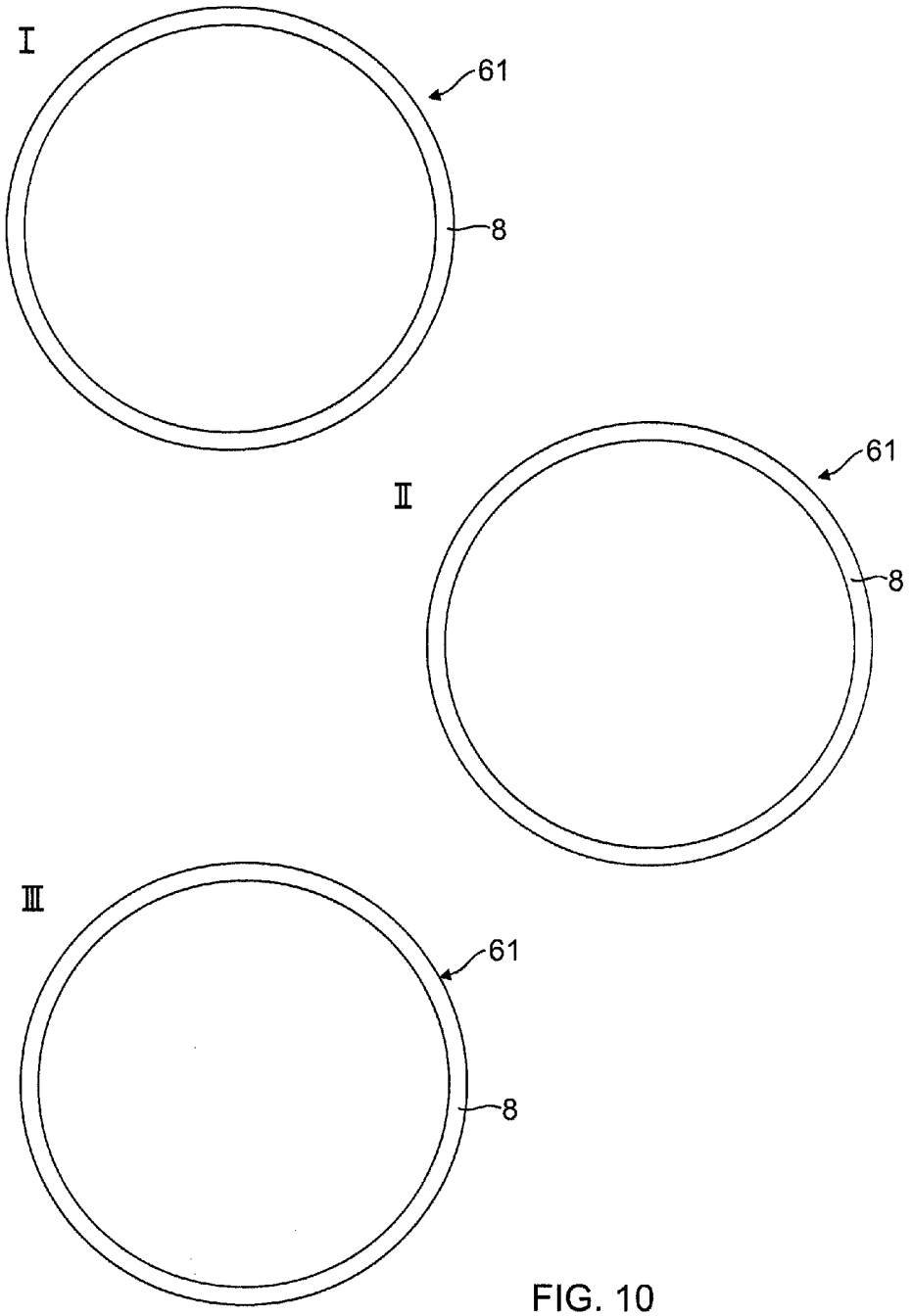
FIG. 10 is a top view of three rings of a tenth embodiment in which each ring is part of a bin assembly, the bin of which is depicted in FIG. 9A.

The three rings 61 of the tenth embodiment are shown in a top view in FIG. 10 and the bin 21 is depicted in FIG. 9. The tenth embodiment allows the formation of three bin assemblies and each such assembly is further shown in FIGS. 9A through 9J and described in the description of the ninth embodiment.

The set of three rings 61 of the tenth embodiment, as depicted in FIG. 10, are rings I, II, and III. The content information 8 of rings I, II, and III includes information in one or both of the two forms listed at "a" and "b" in the description of the eighth embodiment, and pertains to the identity or character of the items that are contained or intended to be contained within the bin 21, as described immediately after the list of six forms in the description of the first embodiment.

The content information 8 of each of the rings 61 may be associated with a different bin content or intended content. For example, the content information 8 of ring I may be a pattern associated with electronics for recycling, the content information 8 of ring II may be a color and gloss associated with batteries for recycling, the content information 8 of ring III may be a color and degree of transparency associated with the safe disposal of compact fluorescent lamps. In this example, each of the three rings I, II, and III may secure liners 35 and these liners 35 would be transparent.

Figure 11:
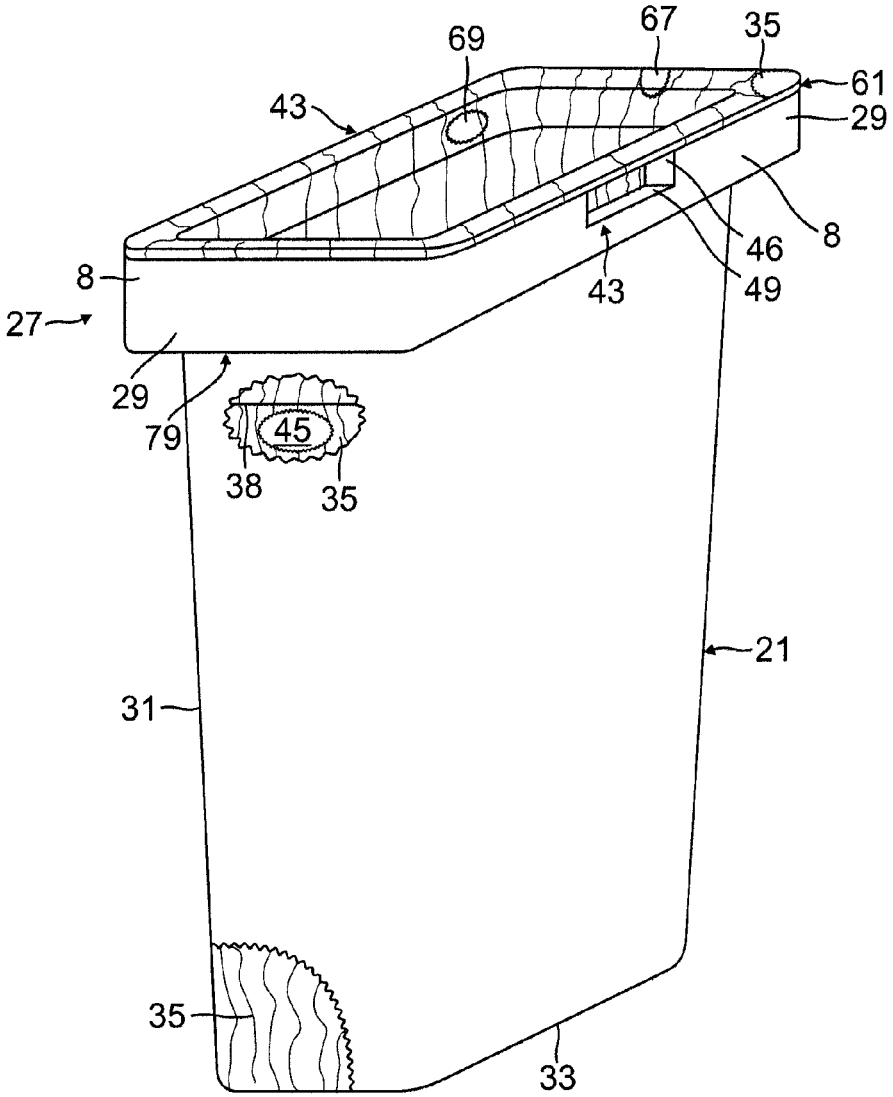
FIG. 11 is perspective view of an eleventh embodiment, a bin assembly, shown with a liner lining the bin and secured by the ring.

The eleventh embodiment, shown in FIG. 11, is a bin assembly in which content information 8 is found at the vertical lip 29. All eleven characteristics shared by the seventh and ninth embodiments and enumerated as "1" through "11" in the above description of the ninth embodiment are also shared by the eleventh embodiment. Further, like the seventh and ninth embodiments, the eleventh embodiment shares the first three additional characteristics shared by the seventh and ninth embodiments and listed in the description of the ninth embodiment as "a" through "c." However, unlike the seventh and ninth embodiments, the eleventh embodiment has no oblique lip 20, and the channel 79 for grasping the rim 27 and lifting the bin 21 is found between the vertical lip 29 and the frame 53. (FIG. 11; compare with 7P and 7Q.)

The content information 8 of the eleventh embodiment includes information in one or more of the six forms listed in the description of the first embodiment and pertains to the identity or character of the items that are contained or intended to be contained within the bin 21, as described immediately after the list of six forms in the description of the first embodiment.

As in the seventh and ninth embodiments, the rim 27 of the eleventh embodiment includes a ring 61. (FIG. 11.) In addition to the ring 61, the rim 27 includes five basic elements of the bin 21: a vertical lip 29, a horizontal lip 28, a bend 25, a frame 53, which is vertical, and a ledge 51, which is horizontal. (FIG. 11; compare with FIGS. 7D and 7G1.) As in the seventh embodiment, on all sides of the bin 21, the frame 53 joins the horizontal lip 28 at bend 25. (FIG. 11; compare with FIGS. 7B, 7D, and 7G1.)

Like the ring 61 of the seventh embodiment, the ring 61 of the eleventh embodiment has two structural elements, a riser 69, which is vertical, and a cap 67, which is horizontal. (FIG. 11; compare with FIGS. 7A, 7B, 7P and 7Q.) As in the seventh and eighth embodiments, the riser 16 of the eleventh embodiment is a type of flange.

The method of installing and securing the liner 35 includes each of the enumerated steps of the method described for the seventh embodiment. However, because the eleventh embodiment does not include an oblique lip 20, in the second step the edge 38 and border 37 of the liner 35 hang loosely from the cap 67 of the ring 61 on all sides of the bin 21. (FIG. 11; compare with FIG. 7K.)

The ring 61 and any liner 35 are removed from the ring and bin assembly of the eleventh embodiment in the same manner that the liner 35 is removed from the bin assembly of the seventh embodiment. (FIG. 11; compare with FIG. 7R.) The two slots 43, at opposing sides of the ring 61, perform the same functions as the two slots 43 of the seventh embodiment. As in the seventh embodiment, a slot 43 is a type of aperture.

Figure 12:
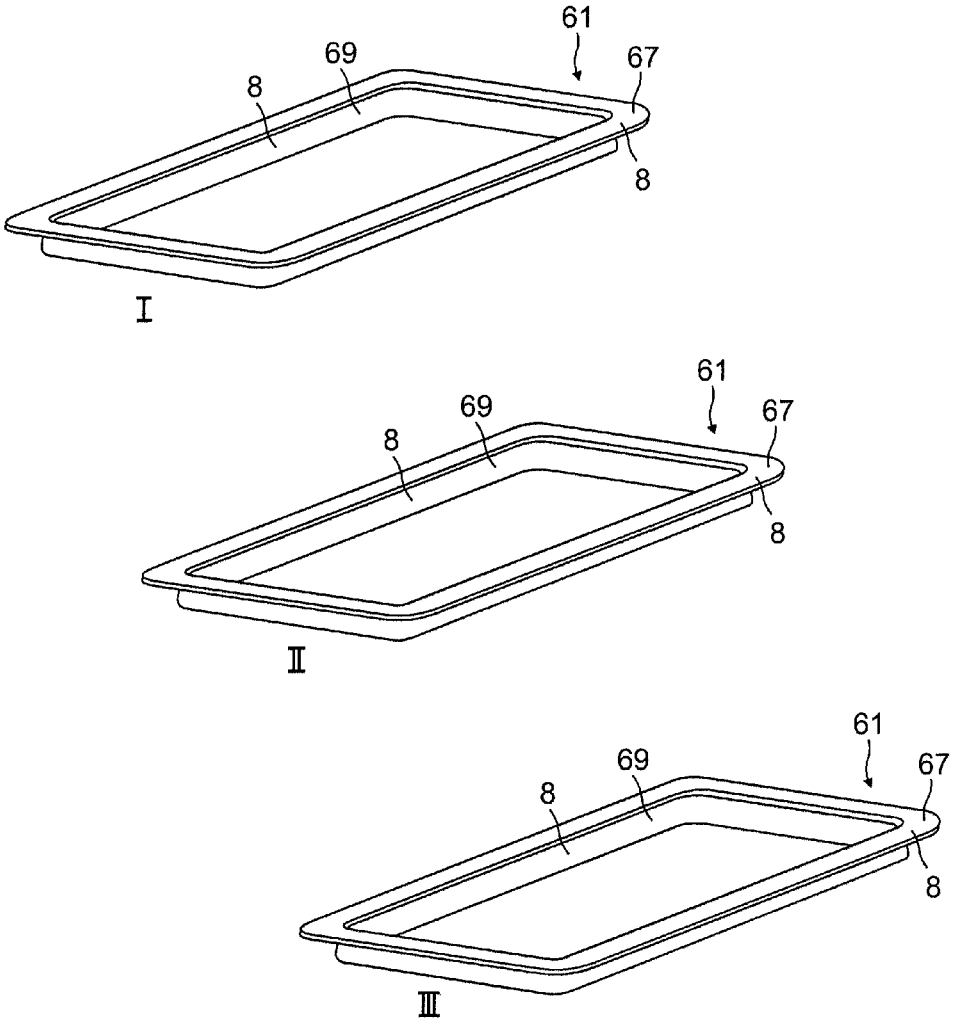
FIG. 12 is a perspective view of three rings of a twelfth embodiment in which each ring is part of a bin assembly, the bin of which is structurally identical to the bin depicted in FIG. 11.

The twelfth embodiment, shown in FIGS. 12 and 11, is a set of rings 61 with content information 8 and a bin 21 structurally identical to the bin of the eleventh embodiment such that (1) the content information 8 of each ring 61 is distinguishable from the content information 8 of every other ring 61 of the set and (2) the bin 21 and each ring 61 forms a bin assembly.

The three rings 61 of the twelfth embodiment are depicted in FIG. 12, and the bin 21 is depicted in FIG. 11. The twelfth embodiment allows the formation of three bin assemblies, each of which is described structurally in the description of the eleventh embodiment.

The set of three rings 61 of the twelfth embodiment, as depicted in FIG. 12, are rings I, II, and III. The content information 8 of rings I, II, and III, found at their caps 67 and risers 69, includes information in one or more of the following six forms:

a. a writing;
b. a picture;
c. a symbol;
d. a form of machine-readable information, for example, a bar code, a Quick Response code, or an RFID tag;
e. a color which, through use at the bin 21 or otherwise, is associated with a bin content or intended content identified by a writing, a picture, a symbol, or a form of machine-readable information on the bin 21 or on an attachment attached to the bin 21; and
f. a visually recognizable surface or material characteristic which, through use at the bin 21 or otherwise, is associated with a bin content or intended content identified by a writing, a picture, a symbol, or a form of machine-readable information on the bin 21 or on an attachment attached to the bin 21.

The content information 8 pertains to the identity or character of the items that are contained or intended to be contained within the bin 21, as described immediately after the list of six forms in the description of the first embodiment.

The content information 8 of each of the rings 61 may identify a different bin content or intended content. For example, the content information 8 of ring I may identify its bin contents as unshelled peanuts for sale, the content information 8 of ring II may identify its bin contents as unshelled walnuts for sale, and the content information 8 of ring III may identifies its bin contents as unshelled almonds for sale. In this example, each of the three rings I, II, and III may secure liners 35 and these liners 35 would be transparent.

Figure 13A:
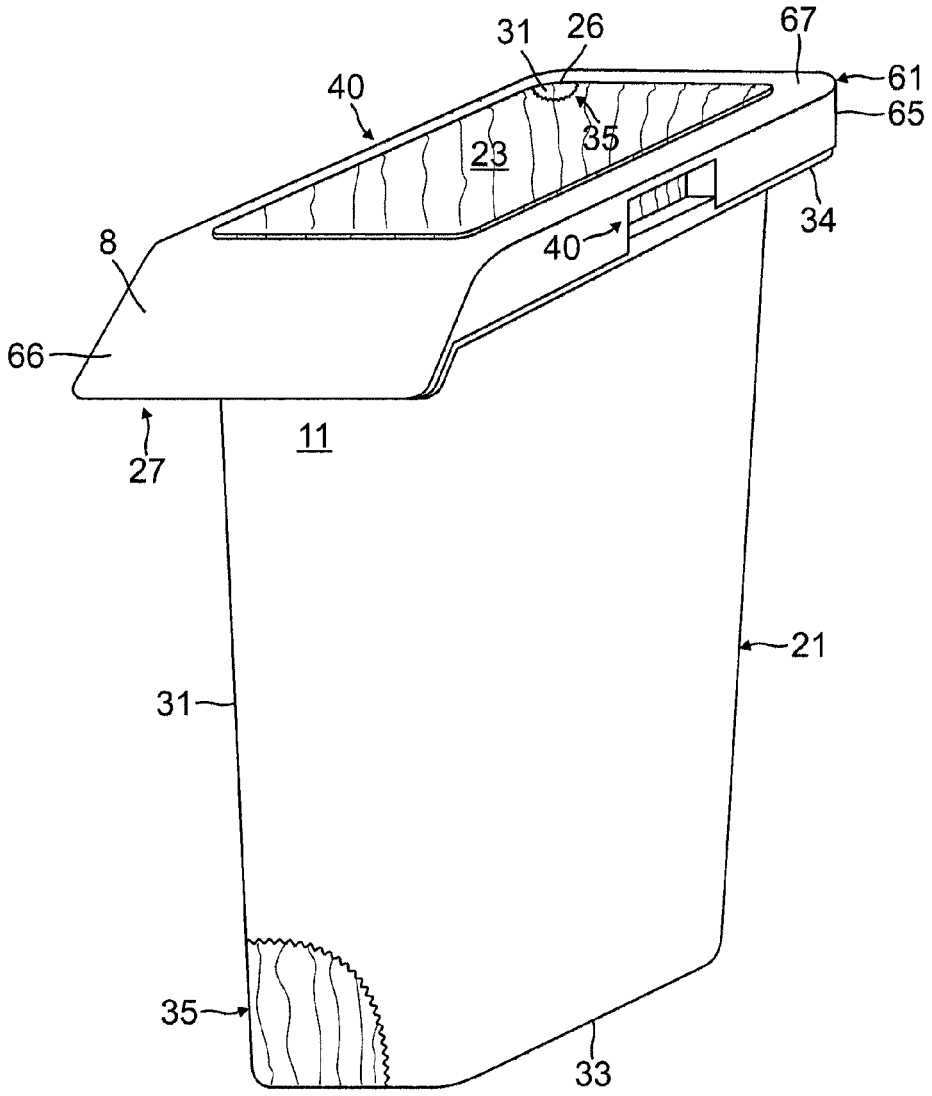
FIG. 13A is a perspective view of a thirteenth embodiment, a bin assembly, shown with a liner lining the bin and secured by the ring, and shown without information.
Figure 13B:
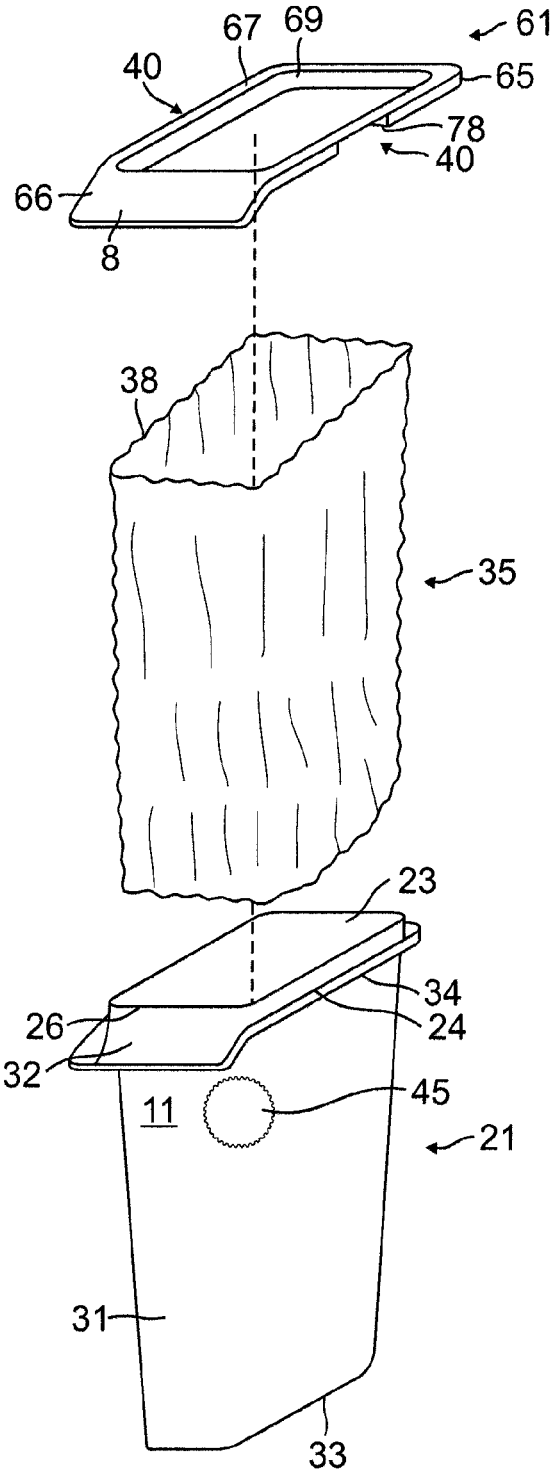
FIG. 13B is an exploded perspective view of the ring and bin of the thirteenth embodiment shown with a liner.

The thirteenth embodiment, shown in FIGS. 13A through 13G3, is a bin assembly in which content information 8 is found at the ring 61, specifically on the oblique face 66. (FIGS. 13A and 13B.) Although the content information 8 of the thirteenth embodiment is found on the ring 61 rather than the bin 21, the thirteenth embodiment has all same information visibility and accessibility characteristics as the bin 21 of the first embodiment, including its structurally related capacity to permit side-by-side comparison of the content information 8 of similar bins. (FIG. 13A; compare with FIGS. 1A and 1F.)

Figure 13C:
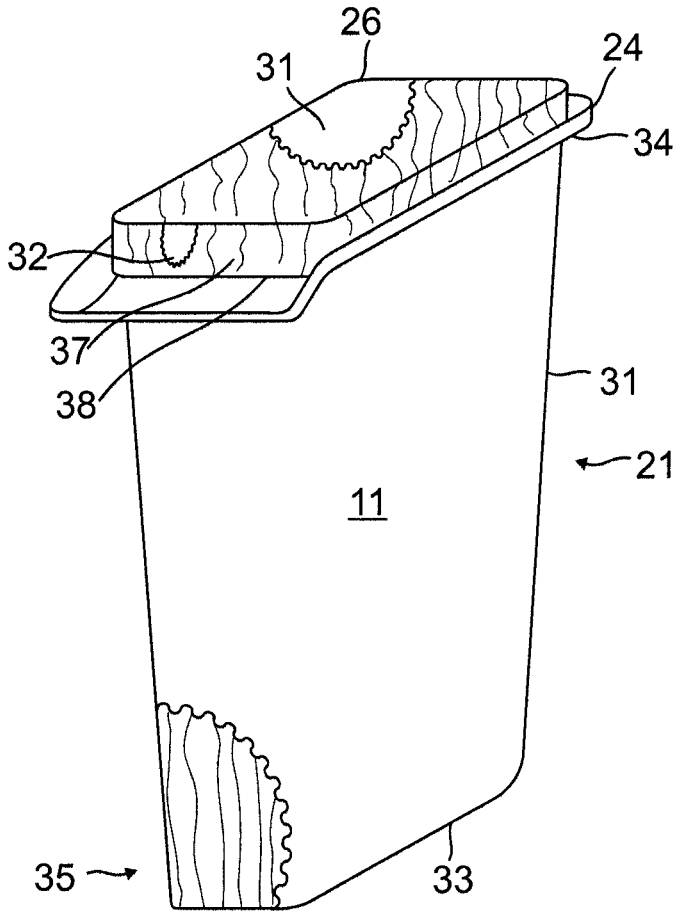
FIG. 13C is a perspective view of the bin of the thirteenth embodiment shown with a liner lining the bin.
Figure 13D:
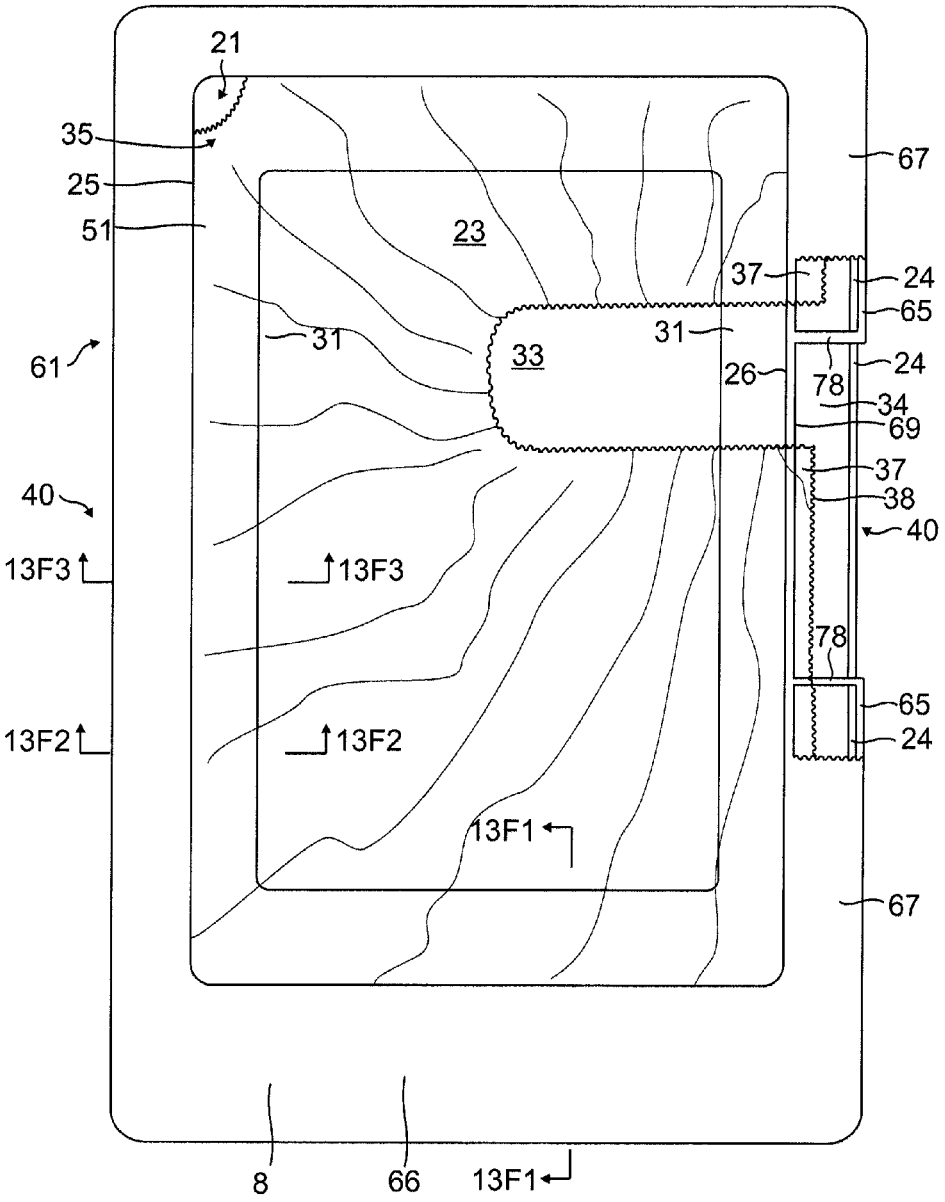
FIG. 13D is a top view of the bin of the thirteenth embodiment together with a liner that lines the bin, with the ring resting directly on the liner and indirectly on the bin in a stable but unengaged position.
Figure 13F:
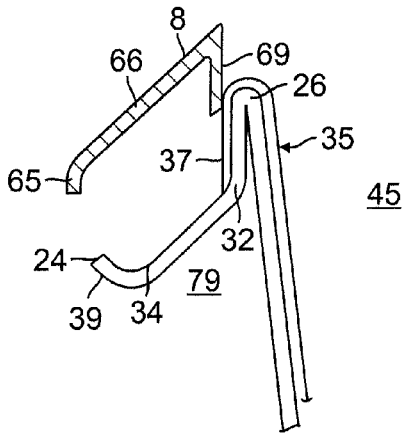
FIG. 13F is a side view of a portion of the ring and bin of the thirteenth embodiment together with the liner as shown in FIG. 13D, but the ring has now been pushed downward so that the ring is engaged with the bin and secures the liner.
Figure 13F:
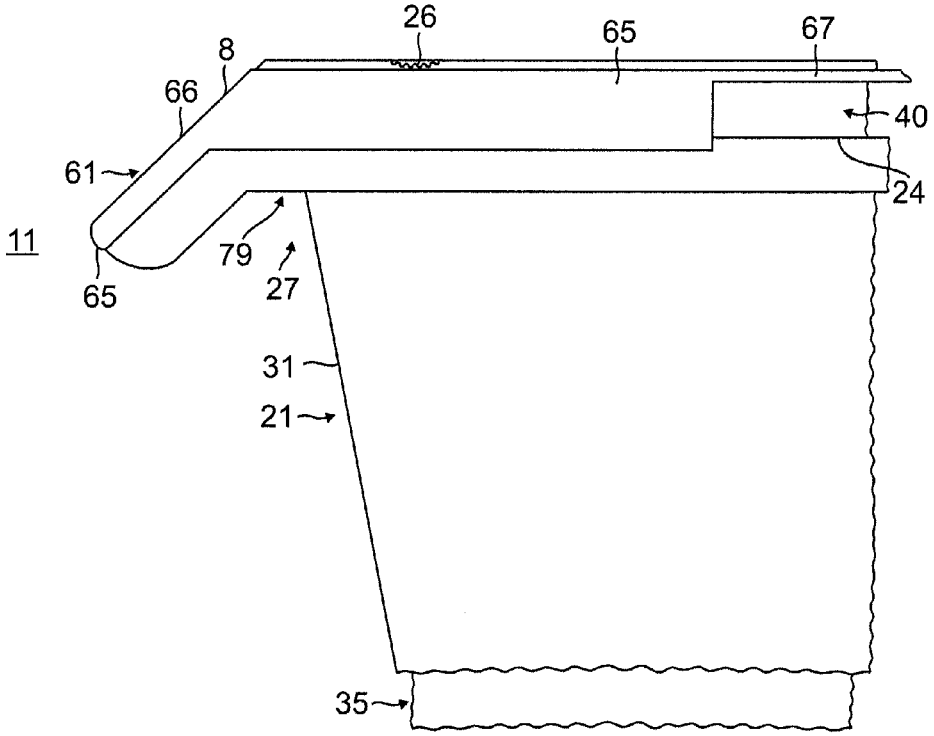

All eleven characteristics shared by the seventh and ninth embodiments and enumerated as "1" through "11" in the above description of the ninth embodiment are also shared by the thirteenth embodiment (FIGS. 13A through 13G3.) Further, the thirteenth embodiment shares two of the four additional characteristics shared by the seventh and ninth embodiments and listed in the description of the ninth embodiment as "a" and "b": (a) the ring 61 engages with the bin 21 by an interference fit (FIGS. 13E1, 13E2, 13E3, 13G2 and 13G3) and (b) in securing a liner 35, the ring 61 may be rested on the bin 21 in a stable but unengaged position (FIGS. 13F1 through 13F3.)

In the thirteenth embodiment, the edge 38 of the liner 35, rather than being contained in the chamber 45 of the bin assembly (as in the seventh, ninth, and eleventh embodiments) is contained below the ring 61 and in or above a trough 34. (FIGS. 13A, 13B and 13C.) Both the ring 61 and the trough 34 are part of the rim 27 and not within the chamber 45. (FIG. 13A.) When the liner 35 is installed in the bin 21 and secured by the ring 61, the liner 35 is clamped between the ring 61 and the bin 21. (FIGS. 13G2 and 13G3.) The trough 34 and its position within the rim 27 allow fingers, or parts of fingers, to be inserted into the channel 79 between the wall 31 and the trough 34 and fall 32 and to grasp the rim 27 and lift the bin 21 without inserting any part of a hand within the chamber 45 of the bin assembly. (FIGS. 13E1, 13F, 13G2, and 13G3.)

The content information 8 includes information in one or more of the six forms listed in the description of the twelfth embodiment and pertains to the identity or character of the items that are contained or intended to be contained within the bin 21, as described immediately after the list of six forms in the description of the first embodiment.

As shown in FIGS. 13B and 13E2, the ring 61 has six elements, a riser 69, a cap 67, an oblique face 66, a vertical face 65, gaps 40, and ribs 78. On three sides of ring 61, the riser 69 joins the cap 67 which in turn joins the vertical face 65. The riser 69 (a type of flange) is vertical and the cap 67 is horizontal. (FIGS. 13C, 13E2, and 13E3.) On the fourth side, the riser 69 joins the oblique face 66 which in turn joins the vertical face 65. (FIGS. 13B and 13E1.) The oblique face 66 angles outward and downward at an angle of approximately 45° below horizontal. (FIG. 13E1.) In one or more alternate embodiments, the oblique face 66 may be angled at any other suitable angle within the range of less than approximately vertical (i.e., approximately 90° from horizontal) and more than approximately horizontal.

Content information 8 is found at the oblique face 66. (FIG. 13A.) On each of the two opposing sides adjacent to the front 11, a gap 40, which is a type of aperture, interrupts the vertical face 65. (FIGS. 13A, 13B, 13D and 13F.) At each of the two ends of the two gaps 40, a rib 78 connects the vertical face 65 with the riser 69. (FIGS. 13E and 13E2.) On all sides of the ring 61, except at the two gaps 40, the vertical face 65 provides the outermost surface of the ring 61. (FIGS. 13A, 13B, 13E1, 13E2 and 13E3.)

Turning to the bin 21 of the thirteenth embodiment, both the bottom 33 and mouth 23 are essentially rectangular. (FIGS. 13A, 13B and 13D.) The rim 27 surrounds the wall 31 and includes the ring 61. (FIG. 13A.) Apart from ring 61, the rim 27 includes five named elements: a crest 26, a fall 32, and a trough 34, which includes a rise 39 and a brim 24. Proceeding outward from the chamber 45, the wall 31 joins the crest 26, which is curved and joins the fall 32. (FIGS. 13B, 13E1, 13E2 and 13E3.) The fall 32 joins the trough 34, which, when viewed from above, is concave. (FIGS. 13B, 13E1, 13E2, and 13E3.) Continuing away from the chamber 45, the trough 34 includes the rise 39 which extends upward and terminates at the brim 24. (FIGS. 13B, 13E1, 13E2, and 13E3.)

On the front 11 of the bin 21, the trough 34 extends farther downward and outward than on the other three sides. (FIGS. 13B, 13E1, 13E2 and 13E3.) At the front 11, the brim 24 is lower than on the other three sides. (FIG. 13B.) At the front 11, when the ring 61 is engaged with the bin 21, the oblique face 66 lays over the trough 34 and the brim 24. (FIGS. 13B, 13D, 13E1 and 13G.)

A method of installing and securing the liner 35 is shown in FIGS. 13B through 13G3.

First, an appropriately sized liner 35 is inserted in the bin 21 so that the liner 35 lines the bottom 33 and wall 31 of the bin 21 and the edge 38 and the border 37 of the liner 35 fit loosely over the crest 26 and down the fall 32. (FIGS. 13B and 13D.)

Second, the bin 21 and the liner 35 may be vented to allow any air trapped between the liner 35 and the bin 21 to escape. With the liner 35 fitting loosely over the crest 26, trapped air may be vented by collapsing the liner 35 against the bottom 33 and the wall 31. (FIG. 13D.)

Third, the ring 61 is placed on the bin 21 so that the riser 69 rests directly on the liner 35 and indirectly on the bin 21. (FIGS. 13D, 13E1, 13E2 and 13E3.)

Fourth, downward forces exerted on the cap 67 push the ring 61 downward until stopped by the four ribs 78 abutting the brim 24. The riser 69 and the fall 32 form a friction fit in which the border 37 of liner the 35 is clamped between the riser 69 and the fall 32. (FIGS. 13G2 and 13G3.)

To remove the ring 61 and the liner 35 from the bin 21, the ring 61 may be deliberately pried from the bin 21, freeing the liner 35 for removal and permitting installation of a replacement liner 35. The removal of the ring 61 also permits installation of an alternative ring 61.

The two gaps 40, each at an opposing side of the ring 61, permit manual disengagement of the ring 61 from the bin 21. One or more fingers may be inserted in each of the two opposing gaps 40 so that the nails of the fingers face downward while the thumb of each hand may be placed on the crest 26. (FIGS. 13F and 13G3.) By exerting an upward force with the fingers and a downward force with the thumbs, the ring 61 is lifted and disengaged from the bin 21 and the liner 35 is freed from the clamping action at the fall 32. (FIG. 13G3; compare with FIG. 7R.)

Figure 14:
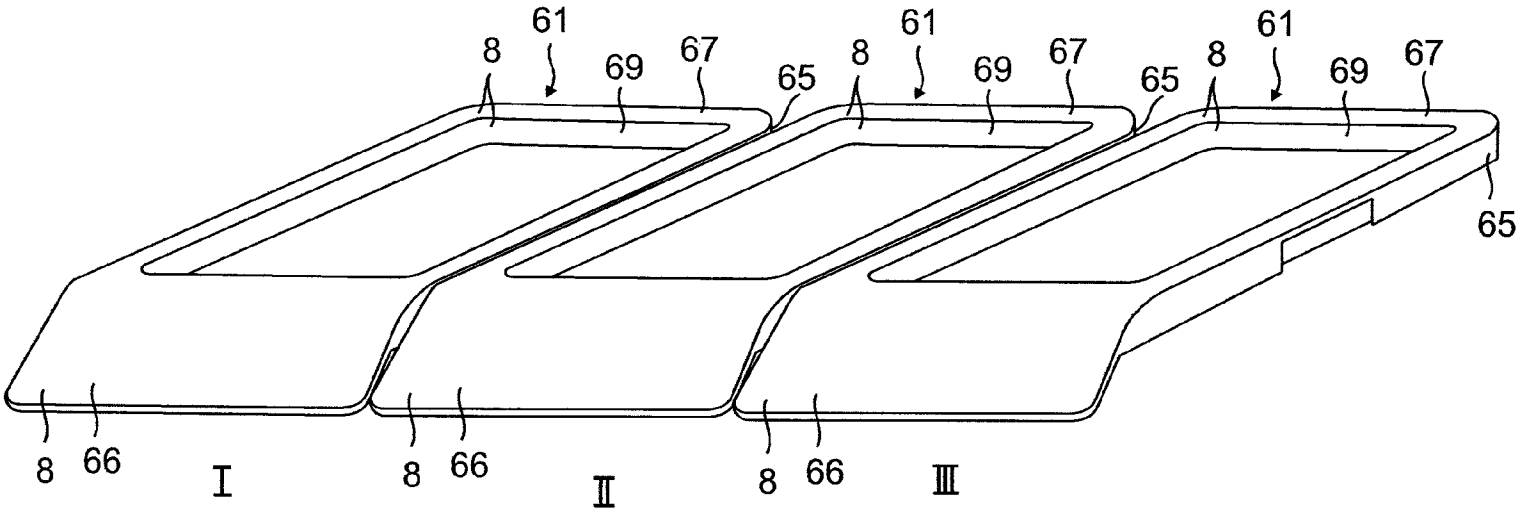
FIG. 14 is a perspective view of three rings of a fourteenth embodiment in which each ring is part of a bin assembly, the bin of which is depicted in FIG. 13B.

The fourteenth embodiment, shown in FIGS. 14 and 13B, is a set of rings 61 and a bin 21 of the thirteenth embodiment such that (1) the content information 8 of each ring 61 is distinguishable from the content information 8 of every other ring 61 of the set and (2) the bin 21 and each ring 61 forms a bin assembly.

The fourteenth embodiment allows the formation of three bin assemblies and each such bin assembly is further shown in FIGS. 13A through 13G3 and described in the description of the thirteenth embodiment.

The set of three rings 61 of the fourteenth embodiment, as depicted in FIG. 14, are rings I, II, and III. The content information 8 includes information in one or more of the six forms listed in the description of the twelfth embodiment and pertains to the identity or character of the items that are contained or intended to be contained within the bin 21, as described immediately after the list of six forms in the description of the first embodiment.

The content information 8 of each of the rings 61 may identify a different bin content or intended content. For example, the content information 8 of ring I may identify the content of its bin 21 as drink pouches for repurposing. The content information 8 of ring II may identify the content of its bin 21 as canned foods for donation. The content information 8 of ring III may identify the content of its bin 21 as clothes for reuse. In this example, rings I and III may secure liners 35, while ring II may be attached directly to the bin 21 without the use of any liner 35.

The fifteenth embodiment, shown in FIGS. 15A through 15C, 15F1 through 15F5, and 15H1 through 15H3, like the thirteenth embodiment, is a bin assembly in which content information 8 is found at the oblique face 66 of a ring 61. Like the thirteenth embodiment, the fifteenth embodiment has the same information visibility and accessibility characteristics as the first embodiment, including its structurally related capacity to permit side-by-side comparison of the content information 8 of similar bins. (FIGS. 9A and 9B; compare with FIG. 1F.)

Figure 15A:
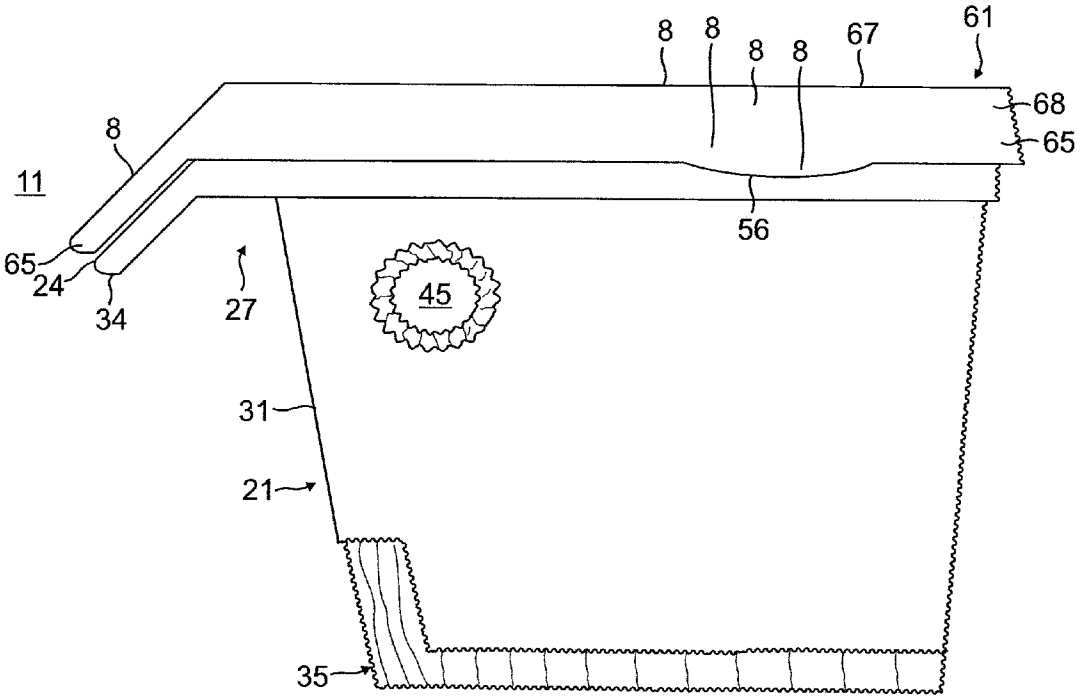
FIG. 15A is a side view of a portion of a fifteenth embodiment, a ring and bin assembly, shown with a liner lining the bin and the ring resting on the bin in a stable but unengaged position.

All eleven characteristics shared by the seventh, ninth, and other embodiments and enumerated as "1" through "11" in the above description of the ninth embodiment are also shared by the fifteenth embodiment (FIGS. 15A through 15F5.) As in the thirteenth embodiment, in the fifteenth embodiment, the edge 38 of the liner 35 is contained below the ring 61 and in or above the trough 34. (FIGS. 15H1, 15H2 and 15H3.) Both the ring 61 and the trough 34 are part of the rim 27 and not within the chamber 45. (FIGS. 15F1 through 15H3.) The channel 79 which, in the fifteenth embodiment, is found between wall 31 and the trough 34 and fall 32 may be used to grasp the rim 27 and lift the bin 21 with one hand without inserting any part of the hand into the chamber 45. (FIGS. 15F1, 15H2, and 15H3.)

Unlike the bin assemblies of prior embodiments, the ring 61 of the fifteenth embodiment engages with the bin 21 by a snap fit. The visual cues to the means of disengaging the ring 61 are two tabs 56, each at an opposing side of the ring 61. (FIGS. 15B, 15C, 15F3 and 15H3.)

The content information 8 found on the oblique face 66 of the ring 61 of the fifteenth embodiment includes information in one or more of the six forms listed in the description of the twelfth embodiment. The content information 8 found at the cap 67, the curved face 68, the vertical face 65, and the tab 56 of the ring 61 includes information in one or more of the two forms listed at "a" and "b" in the description of the eighth embodiment. (FIGS. 15A and 15C.) All content information pertains to the identity or character of the items that are contained or intended to be contained within the bin 21, as described immediately after the list of six forms in the description of the first embodiment.

As depicted in FIGS. 15A and 15F1, the ring 61 is resting on the bin 21 in an unengaged position; if the ring 61 were engaged with the bin 21, the ring 61 would sit lower so that, as shown in FIG. 15H1, the vertical face 65 would extend below the brim 24.

As in the thirteenth embodiment, the trough 34 contributes to the containment of the edge 38 and the border 37 of an appropriately sized liner 35 outside the chamber 45. (FIGS. 15C and 15F2 through 15F5.) After the edge 38 has been moved over the crest 26 and downward into or above the trough 34, the ring 61 is engaged. (FIGS. 15A through 15H3; compare with FIG. 13B.)

When the liner 35 is installed in the receptacle 21 and secured by the ring 61, the liner 35 is clamped between non-vertical surfaces of the ring 61 and the rim 27.

As shown in FIGS. 15A, 15B, 15C, 15F2 and 15F3, the ring 61 has seven elements, an oblique face 66, a cap 67, a curved face 68, a vertical face 65, tabs 56, protuberances 58 (a type of protrusion), and a retainer 71. The retainer 71 (a type of flange) extends around all four sides of the ring 61. (FIGS. 15A, 15C and 15F1 through 15F5.) On three sides of the ring 61, the retainer 71 joins the cap 67, which joins the curved face 68, which joins the vertical face 65. (FIGS. 15A, 15C and 15F2 through 15F5.) On the fourth side, the retainer 71 joins the cap 67, which joins the oblique face 66. (FIG. 15F1.) The oblique face 66 angles outward and downward at an angle of approximately 45' below horizontal. The oblique face 66 ultimately joins the vertical face 65. (FIGS. 15A and 15F1.) The vertical face 65, like the retainer 71, extends around all four sides of the ring 61. (FIGS. 15A, 15C and 15F1 through 15F5.)

Figure 15B:
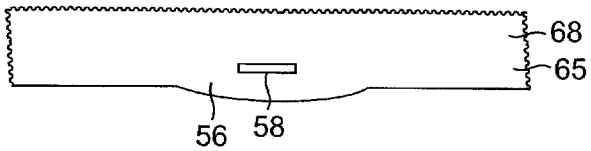
FIG. 15B is an interior view of a portion of the ring of the fifteenth embodiment.
Figure 15C:
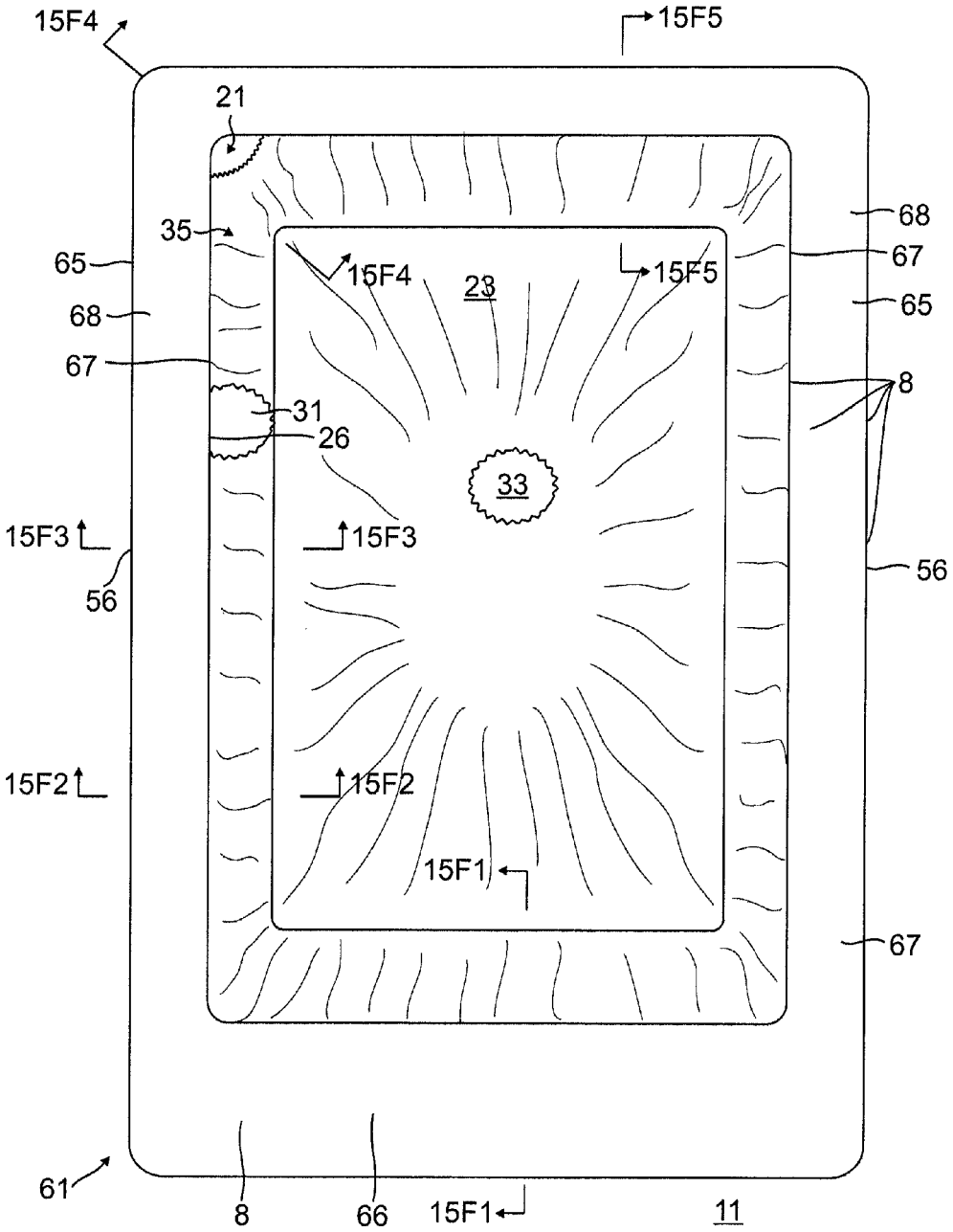
FIG. 15C is a top view of the ring and bin of the fifteenth embodiment together with a liner that lines the bin, with the ring resting on the bin in a stable but unengaged position.

As shown in FIGS. 15A, 15B, and 15C, on each opposing side adjacent to the side with the oblique face 66, a tab 56 joins the vertical face 65. As shown in FIGS. 15B and 15F3, a protuberance 58 protrudes inward from the vertical face 65 above the tab 56.

The rim 27 joins and surrounds the wall 31. (FIGS. 15A, 15C and 15F1 and 15F2.) Apart from the ring 61, the rim 27 includes nine named elements: a crest 26, a seat wall 70, a seat 72, a collar 73, a bevel 74, a fall 32, and a trough 34, which includes the rise 39, which extends upward and terminates at the brim 24. (FIGS. 15C, 15F1 and 15F2.) Proceeding from the chamber 45 outward on all sides, the wall 31 joins the crest 26, which curves to horizontal as it joins the seat wall 70. The seat wall 70 in turn joins the seat 72. On all sides except the front 11, the seat 72 joins the collar 73, which extends upward and is rounded and joins the fall 32. (FIGS. 15C and 15F2 through 15F5.) On the front 11, the seat 72 joins the bevel 74 which joins the fall 32. (FIG. 15F1.) On all sides, the fall 32 extends downward to the trough 34, which, when viewed from above, is concave, and extends upward through the rise 39 to the brim 24. (FIGS. 15C and 15F1 through 15F5.)

On the front 11 of the bin 21, the trough 34 extends farther both downward and outward than on the other three sides. (FIGS. 15A, 15C and 15F through 15F5.) When the ring 61 is attached to the bin 21, the oblique face 66 with its content information 8 lays over this deeper and more extended portion of the trough 34, contributing to the assembly's obvious directionality. (FIGS. 15A and 15H1.)

A method of installing and securing the liner 35 is shown in FIGS. 15C, 15F1 through 15F5, and 15H1 through 15H3.

The first and second steps, which provide for the insertion of an appropriately sized liner 35 and the venting of air trapped between the liner 35 and the bottom 33 and the wall 31 are the same as those described for the thirteenth embodiment. (FIGS. 13B and 13C.)

In the third step, the ring 61 is placed on the bin 21 so that the protuberance 58 rests on the brim 24. (FIGS. 15C and 15F3.)

In the fourth and final step, a downward force exerted on the cap 67 pushes the ring 61 downward so that the protuberance 58 snaps over and under the brim 24. (FIG. 15H3.) With the ring 61 in this engaged position, the liner 35 is clamped between the retainer 71 and the seat 72, between the curved face 68 and the collar 73, and between the oblique face 66 and the bevel 74. (FIGS. 15H1, 15H2 and 15H3.)

To allow flexibility for disengagement, the ring 61 and the bin 21 leave a space 75 between the vertical face 65 and the brim 24 at the two corners of the side opposite the oblique face 66. (FIGS. 15C and 15F4.)

To remove the ring 61 and liner 35 from the bin 21, the ring 61 may be deliberately disengaged and lifted from the bin 21. Here, as in the thirteenth and seventh embodiments, removal of the ring 61 frees the liner 35 for removal and permits installation of an alternative liner 35. (FIG. 15A; compare with FIGS. 13B and 7R.) Here, also, removal of the ring 61 permits installation of a ring 61 with different content information 8. (FIG. 15A; compare with FIG. 14.)

The tabs 56 provide visually identifiable, specific and discrete locations for disengaging the ring 61 from the bin 21. The fingers of each of two hands may be inserted behind the opposing tabs 56 and beneath the protuberances 58 (a type of protrusion) so that the palms of the hands face upward and the nails of the fingers face the troughs 34. (FIG. 15H3.) By pulling outward at the opposing tabs 56, the protuberances 58 are pulled from beneath the brim 24, thus allowing the ring 61 to be lifted from the bin 21 and the liner 35 to be freed from the clamping action of the ring 61 and the bin 21. (FIG. 15H3; compare with FIG. 7R.)

The sixteenth embodiment, shown in FIGS. 16A, 16F2 and 16F3, is a bin assembly in which the bin 21 and ring 61 are similar to the bin 21 and ring 61 of the fifteenth embodiment.

Figure 16A:
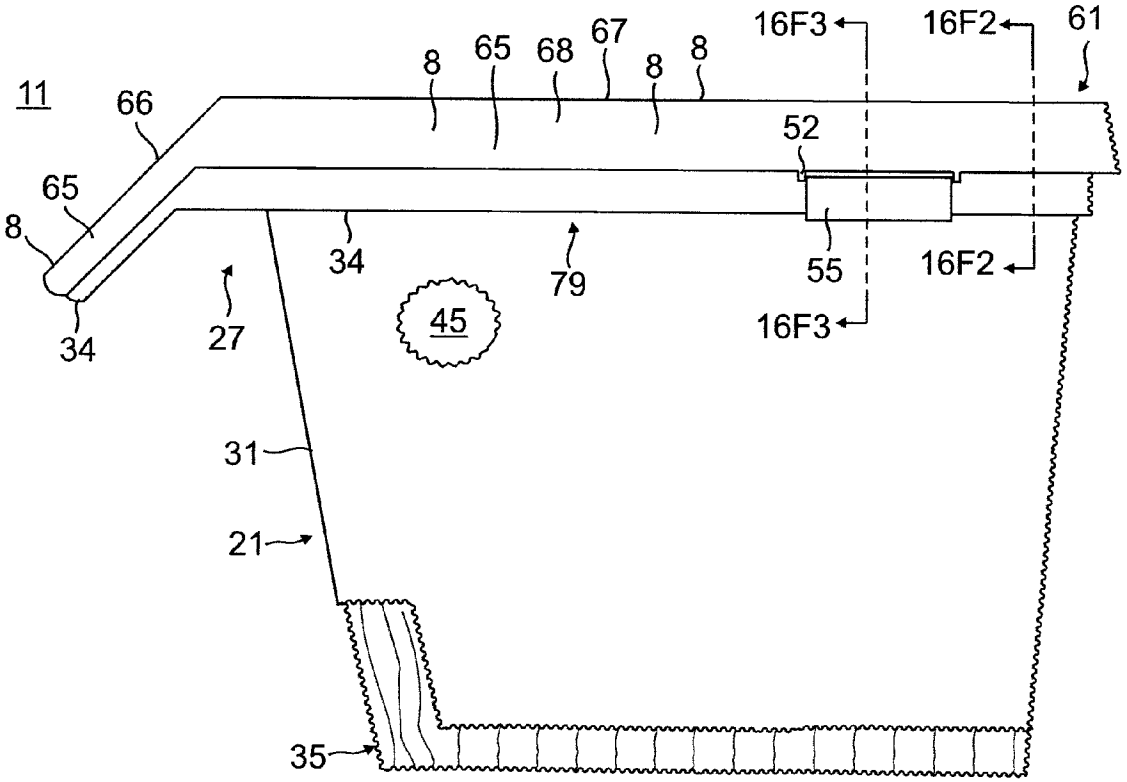
FIG. 16A is a side view of a portion of a sixteenth embodiment, a bin assembly, shown with a liner lining the bin, and the ring engaged with the bin and securing the liner.

All eleven characteristics shared by the seventh and ninth embodiments and enumerated as "1" through "11" in the above description of the ninth embodiment are also shared by the sixteenth embodiment (FIGS. 16A through 16F3.) Further, like the fifteen embodiment, the sixteenth embodiment has the same informational visibility and accessibility characteristics as the bin 21 of the first embodiment, including its structurally related capacity to permit side-by-side comparison of the content information 8 of similar bins (which in the case of the sixteenth embodiment, would include bins 21 and bin assemblies having an oblique lip 20 or an oblique face 66, respectively, at an angle approximately 45° below horizontal).

The content information 8 includes information in one or more of the six forms listed in the description of the twelfth embodiment and pertains to the identity or character of the items that are contained or intended to be contained within the bin 21, as described immediately after the list of six forms in the first embodiment.

In the sixteenth embodiment, as in the fifteenth, the edge 38 of the liner 35 is contained below the ring 61 and in or above the trough 34, which has the same grasping and sanitation characteristics as the thirteenth and fifteenth embodiments. (FIGS. 16A through 16F3.) Both the ring 61 and the trough 34 are part of the rim 27 and not within the chamber 45. (FIGS. 16A through 16F3.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIGS. 16F2 and 16F3.)

The sixteenth embodiment, however, differs from the fifteenth embodiment in several respects. First, at the front 11 of the sixteenth embodiment, the angle of the oblique face 66 is approximately 60°, not 45°, below horizontal. Second, again at the front 11, the thickness of the portion of the engaged ring 61 and the bin 21 below the horizontal line of the trough 34 is less than in the fifteenth embodiment, thus permitting an engaged assembly of the sixteenth embodiment to nest squarely in an identical engaged assembly for efficient transport and storage. Third, the engagement means and disengagement means for the sixteenth embodiment, which are discussed in more detail below, are different than those of the fifteenth embodiment. Fourth, the curved face 68 occupies less of the ring 61 of the sixteenth embodiment than the ring 61 of the fifteenth embodiment. (FIGS. 16F2 and 16F3; compare with FIGS. 15F4 and 15F5.) Fifth, at the four corners of the sixteenth embodiment, the ring 61 does not leave spaces 75 between its vertical face 65 and the brim 24 of the bin 21. (FIG. 16F2; compare with FIGS. 15F4 and 15F5.)

The means of engagement for the sixteenth embodiment include hinges 52 and latches 55. (FIGS. 16A and 16F3.) More specifically, at each of two opposing sides of the ring 61, a pair of hinges 52 joins the vertical face 65. (FIGS. 16A and 16F3.) Each of the pair of hinges 52 holds a latch 55. (FIGS. 16A and 16F3.) Both latches 55 may be rotated beneath the trough 34. (FIGS. 16A and 16F3.) Each latch 55 is generally curved to conform to the exterior convex shape of the trough 34, however, as the latch 55 extends farther away from the hinge 52, the radius of its curve is less than the radius of the exterior of the trough 34 so that, when pushed into position beneath the trough 34 and at the fall 32, the portion of the latch 55 generally opposite the hinge 52 grips the fall 32 and holds the latch 55 in place, thus engaging the ring 61 to the bin 21.

To disengage the ring 61 from the bin 21 of the sixteenth embodiment, the end of one or more fingers are inserted between the latch 55 and the wall 31. (FIG. 16F3.) The latch 55 is then pulled down and away from the fall 32 and rotated away from the wall 31 and toward the exterior side of the vertical face 65. (FIG. 16F3.) When the latch 55 has been rotated out from under the trough 34, the ring 61 may be lifted from the bin 21, thus releasing any liner 35 for removal and possible replacement.

Figure 17A:
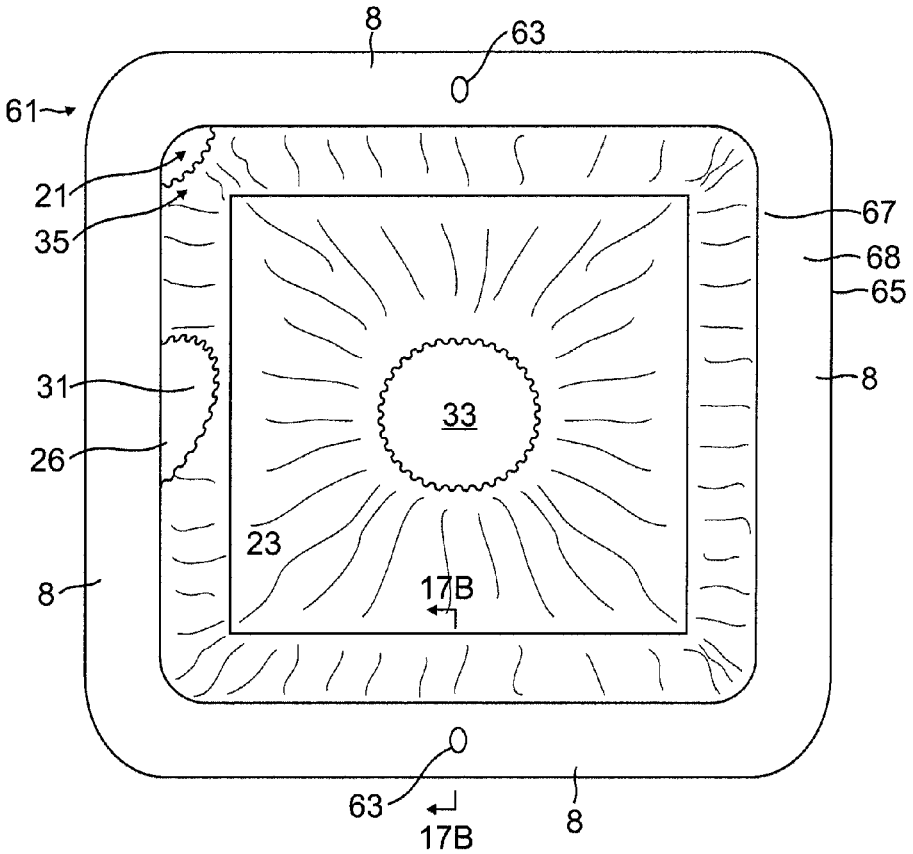
FIG. 17A is a top view of a seventeenth embodiment, a bin assembly, together with a liner lining the bin and secured by the ring.
Figure 17B:
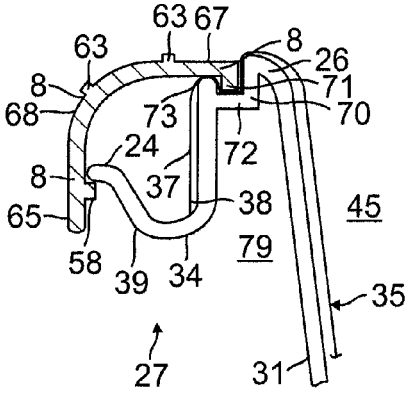
FIG. 17B is a cross section of the rim of the bin assembly of the seventeenth embodiment shown in FIG. 17A.

The seventeenth embodiment, shown in FIGS. 17A and 17B, is a bin assembly in which the ring 61, like the ring 61 of the fifteenth embodiment, engages with the bin 21 by a snap fit. (FIGS. 17A and 17B; compare with FIGS. 15C, 15F2, 15F3 and 15H3.) The bottom 33 and the mouth 23 of the bin 21 of the seventeenth embodiment are essentially rectangular. (FIG. 17A.)

Unlike the fifteenth embodiment, the seventeenth embodiment has no oblique face 66 and no front 11. (FIG. 17A.) Further, although the seventeenth embodiment has a discrete protuberance 58 (a type of protrusion) on the inner side of the vertical face 65 at opposing sides of the ring 61 (cross section of only one opposing side shown), the seventeenth embodiment has no tab 56. The means of disengagement, however, include disengagement indicia (e.g., two thumb marks 63), which are located on the exterior of the ring 61 above the protuberances 58. (FIGS. 17A and 17B). The thumb marks 63 at opposing sides of the ring 61 are intended to communicate to a user the approximate location to place the thumbs, and thus the hands, in disengaging the ring 61.

As in the thirteenth and fifteenth embodiments, the edge 38 of the liner 35 is contained below the ring 61 and in or above the trough 34. (FIGS. 17A and 17B; compare with FIGS. 13E2 through 13G3 and 15H1 through 15H3.) Both the ring 61 and the trough 34 are part of the rim 27 and not within the chamber 45. (FIG. 17B.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIG. 17B.)

Content information 8 is found at all sides of the ring 61. (FIG. 17A.) Further, this content information 8 is found at the cap 67, the curved face 68, and the vertical face 65. (FIGS. 17A and 17B.) In the seventeenth embodiment the removal of the ring 61 permits removal of the liner 35 and installation of an alternative liner 35, and the removal of the ring 61 permits installation of a ring 61 with different content information 8. (FIGS. 17A and 17B.)

The content information 8 includes information in one or more of the six forms listed in the description of the twelfth embodiment and pertains to the identity or character of the items that are contained or intended to be contained within the bin 21, as described immediately after the list of six forms in the first embodiment.

A liner 35 is installed and secured in the seventeenth embodiment by the same method used to install and secure a liner 35 in the fifteenth embodiment. (FIGS. 17A and 17B; compare with FIGS. 15C, 15F2, 15H2, 15F3, 15H3, 15F4 and 15F5.) While engagement of the ring 61, as in the fifteenth embodiment, is accomplished by a snap fit, the seventeenth embodiment, unlike the fifteenth, has no tab 56. However, at each of two opposing sides, on the curved face 68, above the protuberance 58, a thumb mark 63 indicates where the thumbs should be placed, and indirectly where the fingers should be placed to disengage the ring 61. Apart from the absence of the tabs 56 and the presence of the thumb marks 63, both the ring 61 and the liner 35 may be deliberately removed from the bin 21 of the seventeenth embodiment by essentially the same method used to remove the ring 61 and the liner 35 of the fifteenth embodiment. (FIGS. 17A and 17B; compare with FIGS. 15C, 15F2, 15H2, 15F3, 15H3, 15F4 and 15F5.) To allow flexibility for disengagement, the ring 61 and the bin 21 leave a space 75 between the vertical face 65 and the brim 24 at all four corners of the assembly. (FIG. 17A; compare with FIG. 15F4.)

Figure 18A:
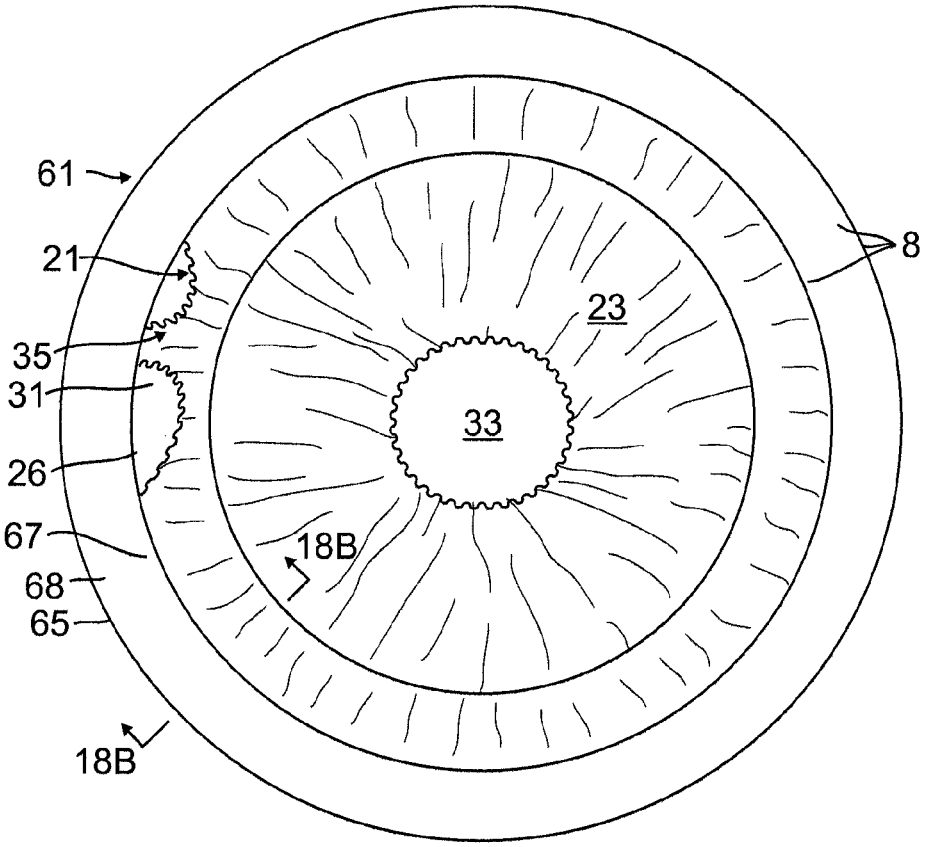
FIG. 18A is a top view of an eighteenth embodiment, a bin assembly, together with a liner lining the bin and secured by the ring.
Figure 18B:
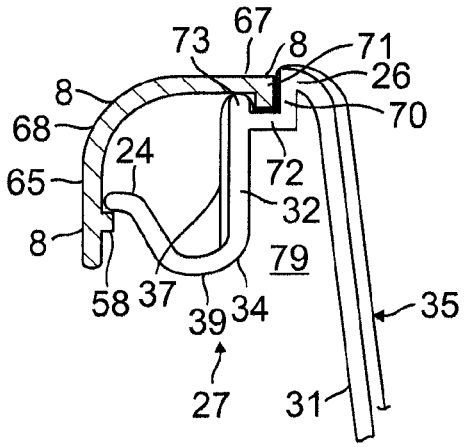
FIG. 18B is a cross section of the rim of the bin assembly of the eighteenth embodiment shown in FIG. 18A.

The eighteenth embodiment, shown in FIGS. 18A and 18B, is a bin assembly in which the ring 61, like the ring 61 of the fifteenth embodiment, engages with the bin 21 by snapping onto the bin 21. (FIGS. 18A and 18B; compare with FIGS. 15C, 15F2, 15F3 and 15H3.) Unlike the bin 21 of the seventeenth embodiment, the bottom 33 and the mouth 23 of the eighteenth embodiment are circular and the protuberance 58 (a type of protrusion) of the ring 61 of the eighteenth embodiment is continuous, thus forming a circle on the inside of the vertical face 65. Similarly, the brim 24 is continuous and circular. Like the seventeenth embodiment, the ring 61 of the eighteenth embodiment has no tab 56 and no oblique face 66. (FIGS. 18A and 18B; compare with FIGS. 15A, 15C, and 15H3.)

Of the eleven characteristics enumerated as "1" through "11" in the description of the ninth embodiment, only the first nine and the eleventh apply to the eighteenth embodiment. The tenth enumerated characteristic does not apply because the rim 27 of the eighteenth embodiment does not include any slot 43, groove 42, gap 40, tab 56, latch 55, thumb mark 63, pull 88, hole 85, or other discrete, non-continuous feature on the rim 27 which is directly observable from the exterior of the bin 21 and which provides or indicates a point of contact for disengaging the ring 61 from the bin 21. (FIGS. 18A and 18B; contrast with FIGS. 7A, 9A and 9B, 11, 13A, 15A, 16A, 17A, 19A, 20A, 21A, 22A, 24A and 24B, 25A, 26, 27A, 28A, 29A, 30A, 31A, 32A and 34A.)

As in the thirteenth, fifteenth, sixteenth and seventeenth embodiments, the edge 38 of the liner 35 is contained below the ring 61 and in or above the trough 34. (FIG. 17B; compare with FIGS. 15H1, 15H2 and 15H3.) Both the ring 61 and the trough 34 are part of the rim 27 and not within the chamber 45. (FIG. 18B.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIG. 18B.)

Content information 8 is found at the vertical face 65, the curved face 68, and the cap 67. (FIGS. 18A and 18B.) The content information 8 includes information in one or more of the six forms listed in the description of the twelfth embodiment and pertains to the identity or character of the items that are contained or intended to be contained within the bin 21, as described immediately after the list of six forms in the first embodiment.

Removal of the ring 61 permits removal of the liner 35 and installation of an alternative liner 35, and the removal of the ring 61 permits installation of a ring 61 with different content information 8. (FIGS. 18A and 18B; compare with FIGS. 7R, 13B, 13C and 14.)

A liner 35 is installed and secured in the eighteenth embodiment by a method similar in some respects to the method used to install and secure a liner 35 in the fifteenth embodiment. However, for the eighteenth embodiment, the protuberance 58, by indirect forces at the ring 61 and the bin 21 must be pushed over and under the brim 24 through all 360° of the bin 21. (FIGS. 18A and 18B.) This may require exertion of downward forces at frequent intervals.

Both the ring 61 and the liner 35 may be deliberately removed from the bin 21 of the eighteenth embodiment. By turning the palm of one hand upward, inserting the fingers of this hand beneath the protuberance 58, and placing the thumb of the same hand on the curved face 68, the inserted fingers may exert an outward force on the vertical face 65 while the thumb exerts a downward and inward force on the curved face 68. By thus pulling the protuberance 58 from beneath the brim 24 in the vicinity of the fingers and allowing the protuberance 58, first at that location and then over all 360°, to be lifted above the brim 24, the ring 61 may be disengaged from the bin 21. (FIGS. 18A and 18B.)

Figure 19A:
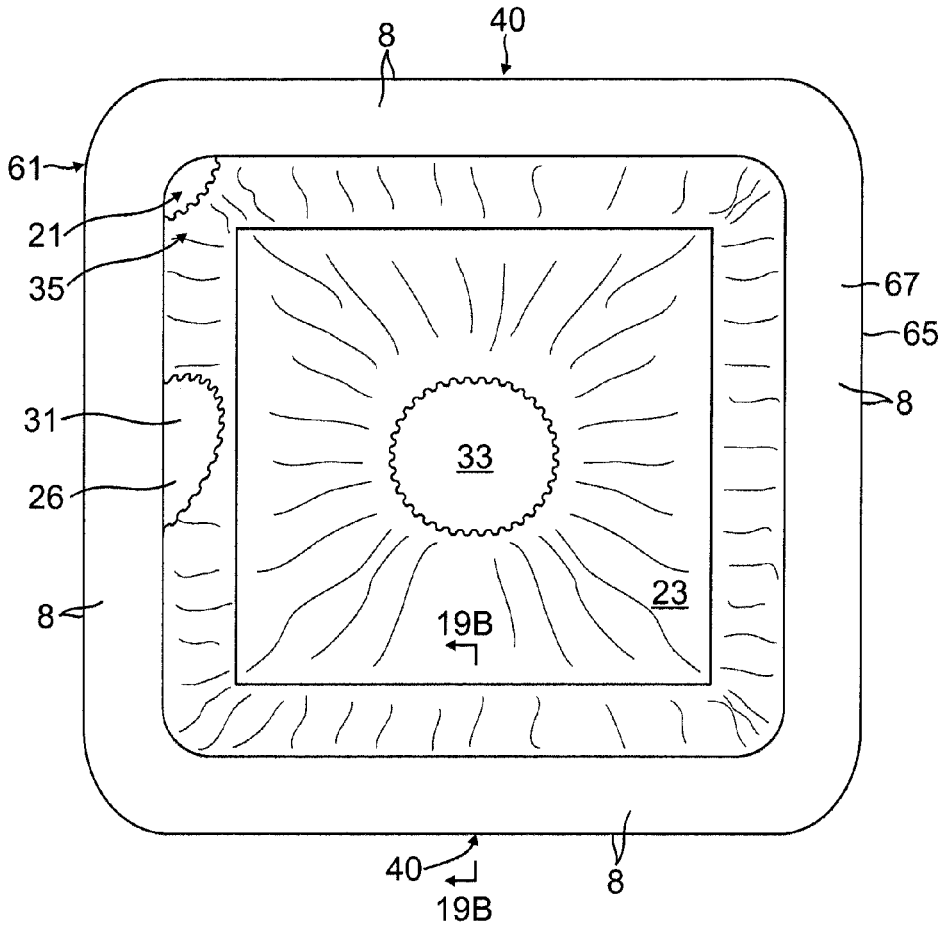
FIG. 19A is a top view of a nineteenth embodiment, a bin assembly, together with a liner lining the bin and secured by the ring.
Figure 19B:
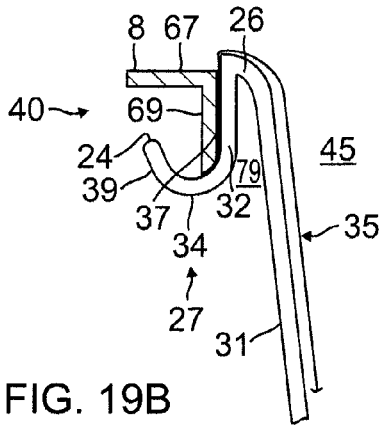
FIG. 19B is a cross section of the rim of the bin assembly of the nineteenth embodiment shown in FIG. 19A.

The nineteenth embodiment, shown in FIGS. 19A and 19B, is a bin assembly in which the ring 61, like the ring 61 of the thirteenth embodiment, engages with the bin 21 by an interference fit. (FIGS. 19A and 19B; compare with FIGS. 13E2, 13G2, 13E3 and 13G3.) The bottom 33 and the mouth 23 of the bin 21 of the nineteenth embodiment are essentially rectangular. (FIG. 19A.) However, unlike the thirteenth embodiment, the nineteenth embodiment has no oblique face 66 and no front 11. (FIG. 19A.)

As in the thirteenth embodiment, all eleven characteristics enumerated as "1" through "11" in the description of the ninth embodiment are shared by the nineteenth embodiment (FIGS. 19A and 19B; compare with FIGS. 15A through 15F5.) As in the thirteenth and fifteenth embodiments, the edge 38 of the liner 35 is contained below the ring 61 and in or above the trough 34. (FIGS. 19A and 19B; compare with FIGS. 13E2 through 13G3 and 15H1 through 15H3.) Both the ring 61 and the trough 34 are part of the rim 27 and not within the chamber 45, (FIG. 19B.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIG. 19B.)

The ring 61 has five elements: a riser 69, a cap 67, a vertical face 65, gaps 40, and ribs 78. The riser 16 is a type of flange. The ribs, though not shown in FIGS. 19A and 19B, have the same placement and function as the ribs 78 in the ring 61 of the thirteenth embodiment. (FIGS. 19A and 19B; compare with FIGS. 13D, 13E2 and 13G2.) On each of two opposing sides of the ring 61, the vertical face 65 is interrupted by a gap 40. (FIGS. 19A and 19B; compare with FIGS. 13D, 13F3 and 13G3.) At the two gaps 40, the cap 67 terminates without joining the vertical face 65. (FIG. 19B.)

Content information 8 is found at the cap 67 and the vertical face 65 and found at all sides of the ring 61. (FIG. 19A.) The content information 8 includes information in one or more of the six forms listed in the description of the twelfth embodiment and pertains to the identity or character of the items that are contained or intended to be contained within the bin 21, as described immediately after the list of six forms in the first embodiment.

Removal of the ring 61 permits removal of the liner 35 and installation of an alternative liner 35, and the removal of the ring 61 permits installation of a ring 61 with different content information 8. (FIGS. 19A and 19B; compare with FIGS. 7R, 13B, 13C and 14.)

A liner 35 is installed and secured in the nineteenth embodiment by the same method used to install and secure a liner 35 in the thirteenth embodiment, and both the ring 61 and the liner 35 may be deliberately removed from the bin 21 of the nineteenth embodiment by the same method used to remove the ring 61 and the liner 35 in the thirteenth embodiment. (FIGS. 19A and 19B; compare with FIGS. 13D, 13E2, 13G2, 13E3 and 13G3.)

Figure 20A:
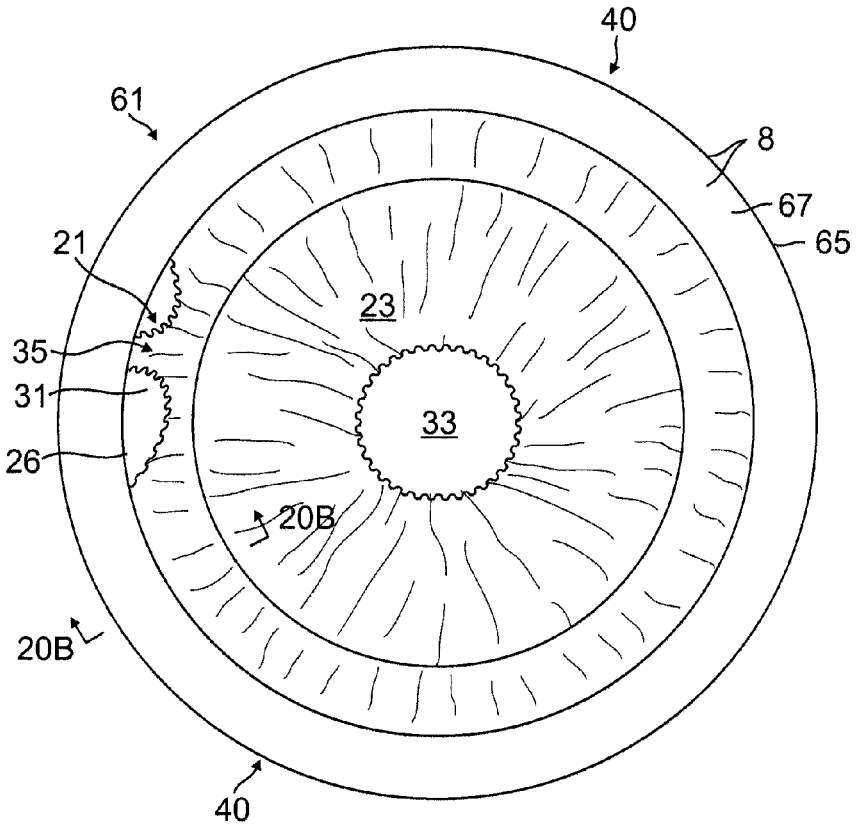
FIG. 20A is a top view of a twentieth embodiment, a bin assembly, together with a liner lining the bin and secured by the ring.
Figure 20B:
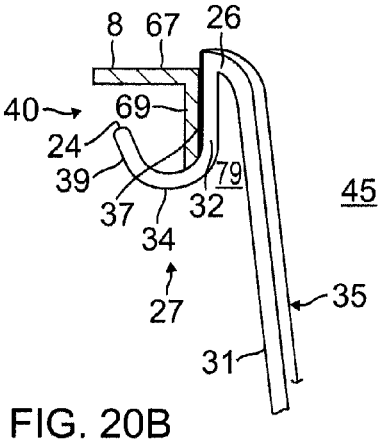
FIG. 20B is a cross section of the rim of the twentieth embodiment shown in FIG. 20A.

The twentieth embodiment, shown in FIGS. 20A and 20B, is a bin assembly in which the ring 61, like the ring 61 of the thirteenth embodiment, engages with the bin 21 by an interference fit. (FIGS. 20A and 20B; compare with FIGS. 13E2, 13G2, 13E3 and 13G3.) The twentieth embodiment is identical to the nineteenth embodiment, as described above, except for its shape. In the twentieth embodiment, the bottom 33 and the mouth 23 of the bin 21 are circular and the rim 27, including the ring 61, is also circular (FIG. 20A.) With this exception, the description of the nineteenth embodiment applies equally to the twentieth embodiment.

Figure 21A:
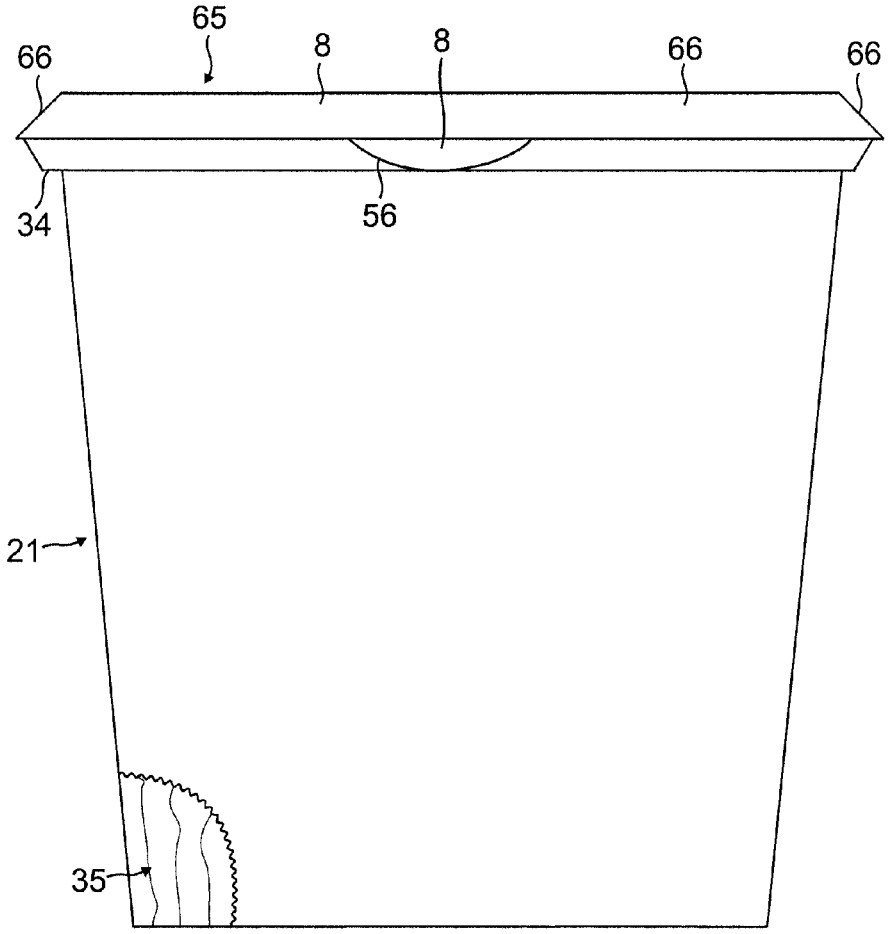
FIG. 21A is a side view of a twenty-first embodiment, a bin assembly, together with a liner lining the bin and secured by the ring.
Figure 21B:
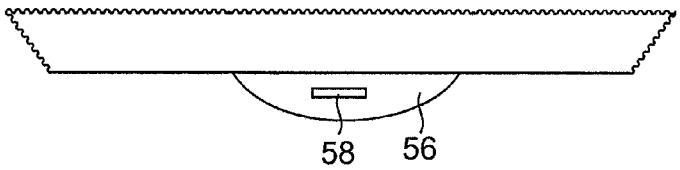
FIG. 21B is an interior view of a portion of the ring of the twenty-first embodiment.
Figure 21C:
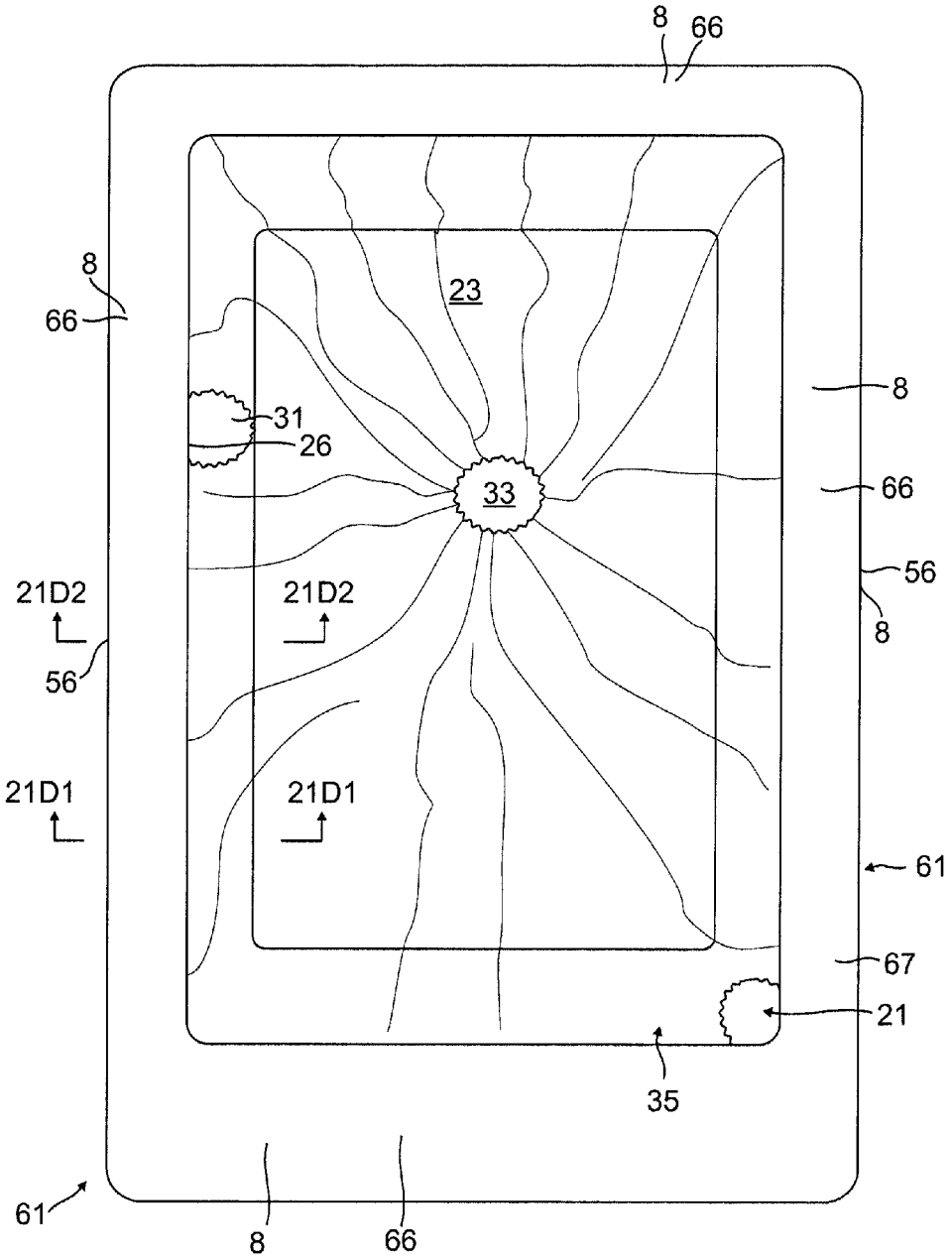
FIG. 21C is a top view of the bin assembly of the twenty-first embodiment, together with a liner lining the bin, and the ring resting on the bin in a stable but unengaged position.

The twenty-first embodiment, shown in FIGS. 21A and 21B, is a bin assembly in which the ring 61, like the ring 61 of the fifteenth embodiment, engages with the bin 21 by a snap fit (FIGS. 21A through 21E2.) The bottom 33 and the mouth 23 of the bin 21 of the twenty-first embodiment are essentially rectangular. (FIG. 21C.)

The twenty-first embodiment has an oblique face 66, however, unlike the fifteenth embodiment, the twenty-first embodiment has no front 11. (FIGS. 21A and 21C; compare with FIGS. 15A and 15C.) On all four sides and corners of the ring 61 of the twenty-first embodiment, the oblique face 66 extends downward and outward. (FIGS. 21A, 21B, 21C and 21D2.) On opposing sides of the ring 61, a tab 56 joins the oblique face 66. (FIGS. 21A, 21C and 21D2.) A protuberance 58 (a type of protrusion) protrudes inward from each of the two tabs 56. (FIGS. 21B, 21C and 21D2.)

As in the fifteenth embodiment, all eleven characteristics enumerated as "1" through "11" in the description of the ninth embodiment are shared by the twenty-first embodiment (FIGS. 21A through 21E2; compare with FIGS. 15A through 15F5.) As in the thirteenth and fifteenth embodiments, the edge 38 of the liner 35 is contained below the ring 61 and in or above the trough 34. (FIGS. 21E1 and 21E2; compare with FIGS. 13E2 through 13G3 and 15H through 15H3.) Both the ring 61 and the trough 34 are part of the rim 27 and not within the chamber 45. (FIGS. 21E1 and 21E2.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIGS. 21E1 and 21E2.)

Content information 8 is found at all sides and corners of the ring 61 of the twenty-first embodiment. (FIGS. 21A, 21C, 21D1 and 21D2.) Content information 8 is found at the oblique face 66 and the two tabs 56. (FIGS. 21A, 21C, 21D1 and 21D2.) The content information 8 includes information in one or more of the six forms listed in the description of the twelfth embodiment and pertains to the identity or character of the items that are contained or intended to be contained within the bin 21, as described immediately after the list of six forms in the first embodiment.

Removal of the ring 61 permits removal of the liner 35 and installation of an alternative liner 35, and the removal of the ring 61 permits installation of a ring 61 with different content information 8. (FIGS. 21A and 21E2; compare with FIGS. 7R, 13B, 13C and 14.)

In the twenty-first embodiment, rather than terminating in the brim 24 (as in the thirteenth and fifteenth through twentieth embodiments, the rise 39 turns downward, forming a turn 60 and terminating at an end 62. (FIGS. 21D1 and 21D2.)

A liner 35 is installed and secured in the bin 21 of the twenty-first embodiment by essentially the same method as that used to install and secure a liner 35 in the fifteenth embodiment, and both the ring 61 and a liner 35 may be deliberately removed from the bin 21 of the twenty-first embodiment by essentially the same method used to remove the ring 61 and a liner 35 in the fifteenth embodiment. However, in the twenty-first embodiment, before the ring 61 is pushed downward into an engaged position, the protuberance 58 rests upon the turn 60. When the ring 61 is engaged, the protuberance 58 is locked beneath the end 62. (FIGS. 21C, 21D1, 21E1, 21D2 and 21E1; compare with FIGS. 15C, 15F2, 15H2, 15F3, 15H3, 15F4 and 15F5.)

In the twenty-first embodiment, the ring 61 is disengaged in the same manner as the ring in the fifteenth embodiment.

Figure 22A:
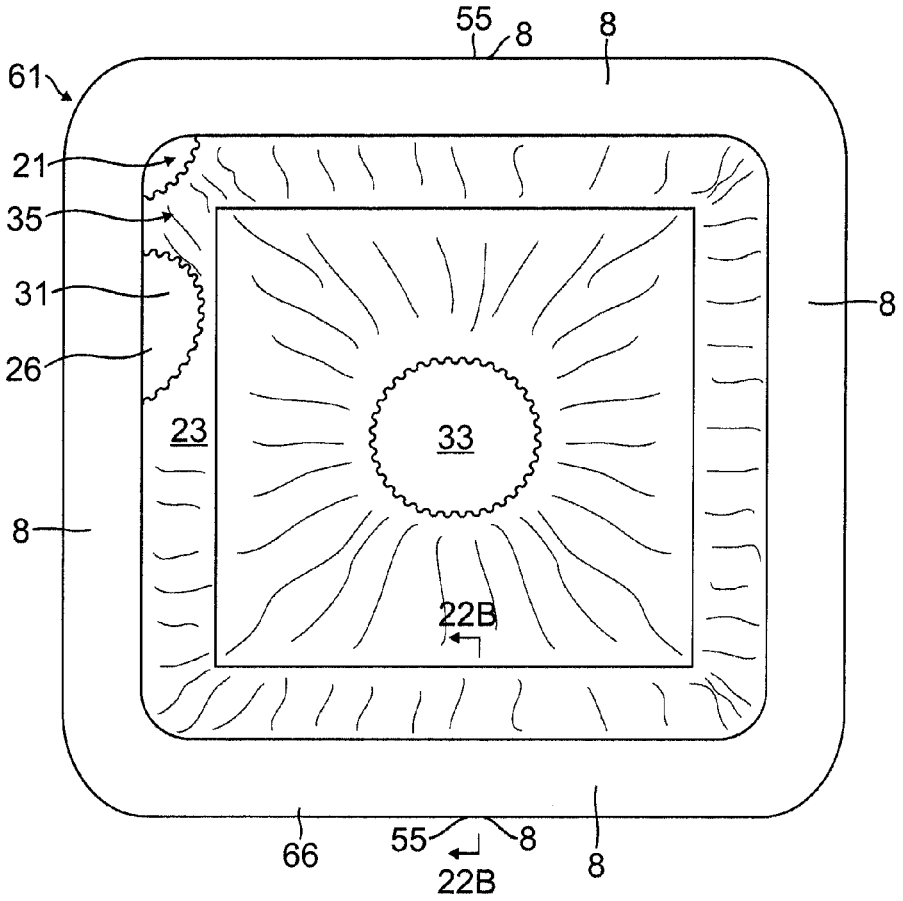
FIG. 22A is a top view of a twenty-second embodiment, a bin assembly, together with a liner lining the bin and secured by the ring resting in a stable but unengaged position.
Figure 22B:
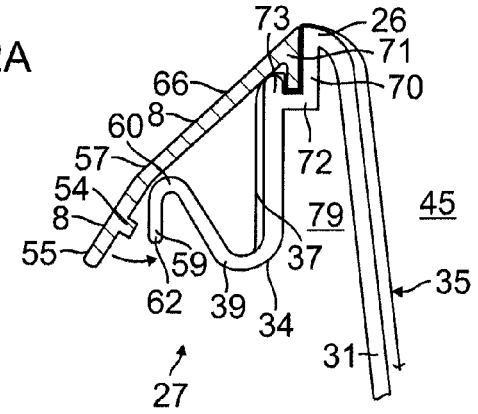
FIG. 22B is a cross section of the rim of the twenty-second embodiment shown in FIG. 22A.
Figure 22C:
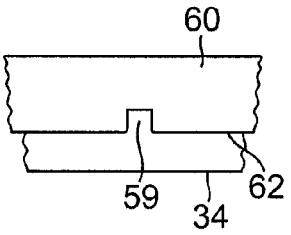
FIG. 22C is a side view of a portion of the rim of bin of the twenty-second embodiment.

The twenty-second embodiment, shown in FIGS. 22A and 22B, is a bin assembly in which the ring 61 engages with the bin 21 by the closing of two latches 55. (FIGS. 22A through 22C.) The bottom 33 and the mouth 23 of the bin 21 of the twenty-second embodiment are essentially rectangular. (FIG. 22A.)

As in the fifteenth embodiment, all eleven characteristics enumerated as "1" through "11" in the description of the ninth embodiment are shared by the twenty-second embodiment (FIGS. 22A through 22C; compare with FIGS. 15A through 15F5.) As in the thirteenth embodiment and fifteenth embodiments, the edge 38 of the liner 35 is contained below the ring 61 and in or above the trough 34. (FIG. 22B; compare with FIGS. 13E2 through 13G3 and 15H1 through 15H3.) Both the ring 61 and the trough 34 are part of the rim 27 and not within the chamber 45. (FIG. 22B.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIG. 22B.)

Content information 8 is found at all four sides of the ring 61 of the twenty-second embodiment. (FIGS. 22A and 22B.) Content information 8 is found at the oblique face 66 and the two tabs 56. (FIGS. 22A and 22B.) The content information 8 includes information in one or more of the six forms listed in the description of the twelfth embodiment and pertains to the identity or character of the items that are contained or intended to be contained within the bin 21, as described immediately after the list of six forms in the first embodiment.

Removal of the ring 61 permits removal of the liner 35 and installation of an alternative liner 35, and the removal of the ring 61 permits installation of a ring 61 with different content information 8. (FIGS. 22A through 22C; compare with FIGS. 7R, 13B, 13C and 14.)

The twenty-second embodiment is similar to the twenty-first embodiment but the means of engagement differ. As in the twenty-first embodiment, on all sides and corners of the ring 61 of the twenty-second embodiment, an oblique face 66 extends downward and outward. (FIGS. 22A and 22B.) However, in the twenty-second embodiment, at two opposing sides of the ring 61, a live hinge 57 joins a latch 55 to the oblique face 66. (FIG. 22A.) Each latch 55 includes an insert 54 (a type of protrusion) that engages with the bin 21. (FIGS. 22A through 22C.)

In the twenty-second embodiment, as in the twenty-first, the rise 39 of the trough 34 bends downward, forming a turn 60 and terminating at an end 62. In the twenty-second embodiment, however, the end 62 includes a notch 59 that corresponds to the insert 54 on the latch 55 and permits insertion of the insert 54 and engagement of the ring 61 and bin 21. (FIG. 22B; compare with FIGS. 21D1 and 21D2.)

A liner 35 is installed and secured in the twenty-second embodiment by a method similar to that used to install and secure a liner 35 in the sixteenth embodiment, which also relies upon the closing of latches 55. (FIGS. 22A through 22C; compare with FIGS. 16A and 16F2.) However, in the twenty-second embodiment, the oblique face 66 rests upon the turn 60 before and after the ring 61 is engaged. Further, in the twenty-second embodiment engagement occurs by locking the insert 54 in the notch 59 at the end 62. (FIGS. 22A through 22C; compare with FIGS. 16A and 16F2.)

As in the sixteenth embodiment, the two latches 55 are directly observable from the exterior of the bin 21. (FIGS. 22A and 22B.) To disengage the ring 61 of the twenty-second embodiment, the two latches 55 are pulled open by inserting the ends of fingers beneath the end 62 and rotating the latches 55 upward, thereby freeing the ring 61 for removal. (FIG. 22B.)

Figure 23A:
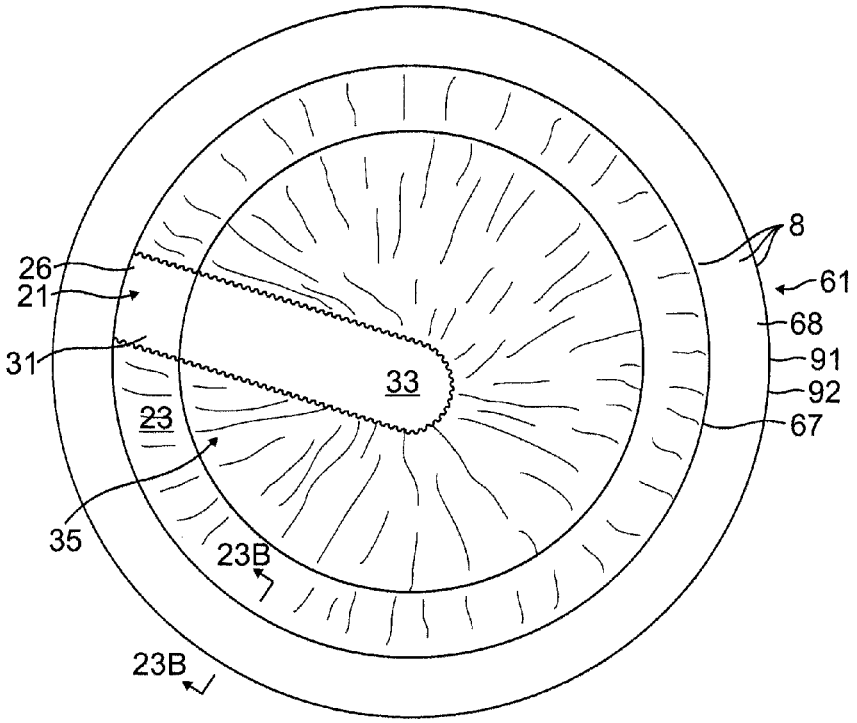
FIG. 23A is a top view of a twenty-third embodiment, a bin assembly, together with a liner lining the bin and secured by the ring.
Figure 23B:
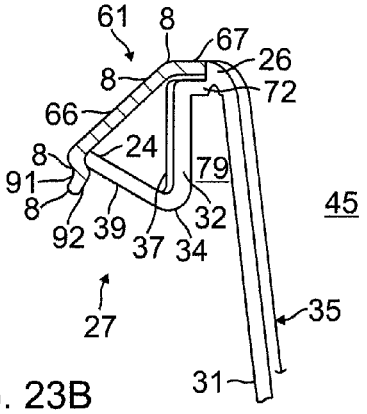
FIG. 23B is a cross section of the rim of the twenty-third embodiment shown in FIG. 23A.

The twenty-third embodiment, shown in FIGS. 23A and 23B, is a bin assembly in which the ring 61 is formed of an elastic polymer, such as rubber, a synthetic rubber, or a thermoplastic elastomer. The ring 61 engages with the bin 21 and secures a liner 35. (FIGS. 23A and 22B.) The bottom 33 and the mouth 23 of the bin 21 of the twenty-third embodiment are circular, as are the crest 26 and the brim 24, which surround the mouth 23. (FIGS. 23A and 23B.) The ring 61 is sufficiently expandable to fit the bin 21 at the exterior of the crest 26 and the exterior of the brim 24 and to be removed from the bin 21. (FIGS. 23A and 23B.) The ring 61 is sufficiently retractable to grip the bin 21 at the exterior of the brim 24 and the exterior of the crest 26 and, when a liner 35 is present, to secure the liner 35 at the exterior of the crest 26 and at the seat 72. (FIGS. 23A and 23B.)

Of the eleven characteristics enumerated as "1" through "11" in the description of the ninth embodiment, only the first nine and the eleventh are shared by the twenty-third embodiment. (FIGS. 23A and 23B; compare with FIGS. 15A through 15F5.) The tenth enumerated characteristic does not apply because the rim 27 of the twenty-third embodiment does not include any slot 43, groove 42, gap 40, tab 56, latch 55, thumb mark 63, pull 88, hole 85, or other discrete, non-continuous feature on the rim 27 which is directly observable from the exterior of the bin 21 and which provides or indicates a point of contact for disengaging the ring 61 from the bin 21. (FIGS. 23A and 23B; contrast with FIGS. 7A, 9A and 9B, 11, 13A, 15A, 16A, 17A, 19A, 20A, 21A, 22A, 24A and 24B, 25A, 26, 27A, 28A, 29A, 30A, 31A, 32A, and 34A.)

As in the thirteenth and fifteenth embodiments, the edge 38 of the liner 35 is contained below the ring 61 and in or above the trough 34. (FIG. 23B; compare with FIGS. 13E2 through 13G3, and 15H1 through 15H3.) Both the ring 61 and the trough 34 are part of the rim 27 and not within the chamber 45. (FIG. 23B.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIG. 23B.)

Throughout the circular ring 61 of the twenty-third embodiment, the ring 61 includes a cap 67 which joins an oblique face 66 which joins an indentation 91 which joins a return 92. (FIGS. 23A and 23B.)

Content information 8 is found at the oblique face 66, the cap 67, the indentation 91 and the return 92. (FIGS. 23A and 23B.) The content information 8 includes information in one or more of the six forms listed in the description of the twelfth embodiment and pertains to the identity or character of the items that are contained or intended to be contained within the bin 21, as described immediately after the list of six forms in the first embodiment.

Removal of the ring 61 permits removal of the liner 35 and installation of an alternative liner 35, and the removal of the ring 61 permits installation of a ring 61 with different content information 8. (FIGS. 23A and 23B; compare with FIGS. 7R, 13B, 13C and 14.)

To attach the ring 61 to the bin 21, the indentation 91 is pushed or pulled over the exterior of the brim 24 and the cap 67 is stretched to the exterior of the crest 26. (FIGS. 23A and 23B.) When no liner 35 is present and the ring 61 is fully installed, the cap 67 sits on the seat 72 and both the oblique face 66 and the indentation 91 grip the brim 24.

Installation of a liner 35 in the twenty-third embodiment begins with the steps that begin the installation of a liner 35 in the thirteenth embodiment: after lining the bin, the edge 38 and border 37 of the liner 35 are turned over the crest 26 and down the fall 32 of the rim 27, and the liner 35 is vented if necessary. (FIGS. 23A and 23B.) However, in engaging the ring 61 of the twenty-third embodiment, the ring 61 may initially be placed on the bin 21 so that the return 92 rests on the brim 24. The elastic ring 61 is then pushed or pulled over the brim 24, so that (1) the oblique face 66 and the indentation 91 grip the brim 24 and (2) the horizontal cap 67 grips the liner 35 at the crest 26 and the seat 72. (FIGS. 23A and 23B.)

Disengagement of the ring 61 and removal of any liner 35 may begin at any point on the continuous return 92 or continuous indentation 91. The return 92 or indentation 91 of the ring 61 may be deliberately pulled outward and upward so that the indentation 91 is pulled above the brim 24. By pulling the oblique face 66 and cap 67 outward and upward, the cap 67 may be lifted over the crest 26. Once the ring 61 has been disengaged from the brim 24 and crest 26, the ring 61 and liner 35 may be removed. (FIGS. 23A and 23B.)

Figure 24A:
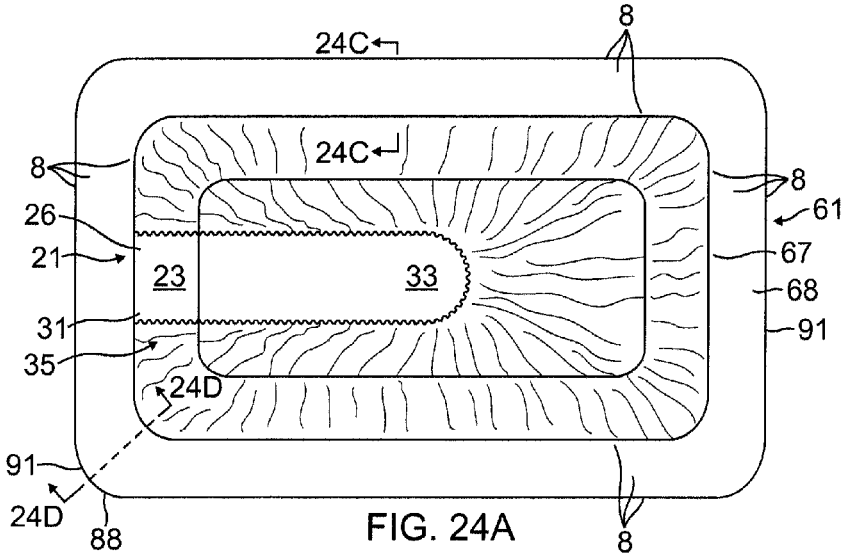
FIG. 24A is a top view of a twenty-fourth embodiment, a bin assembly, together with a liner lining the bin and secured by the ring.
Figure 24B:
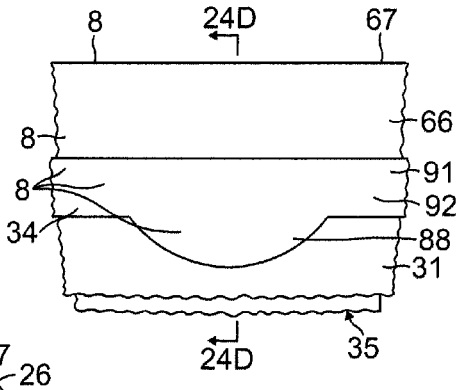
FIG. 24B is a side view of a portion of the rim of the twenty-fourth embodiment together with a liner lining the bin.
Figure 24C:
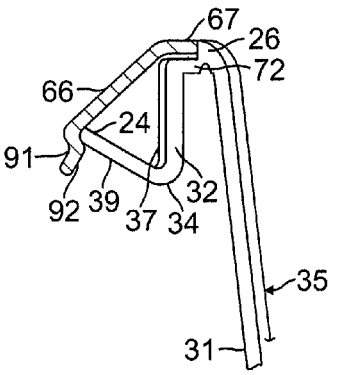
FIG. 24C is a cross section of the rim of the twenty-fourth embodiment together with the liner as shown in FIG. 24A.
Figure 24D:
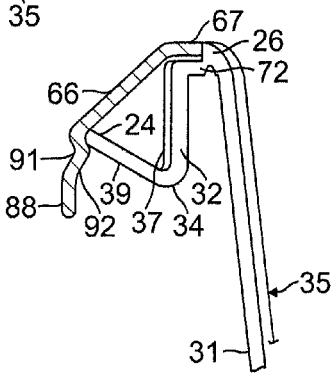
FIG. 24D is a second cross section of the rim of the twenty-fourth embodiment together with the liner as shown in FIG. 24A.

The twenty-fourth embodiment, shown in FIGS. 24A through 24D, like the twenty-third embodiment, is a bin assembly in which the ring 61 is formed of an elastic polymer, such as rubber or synthetic rubber, or a thermoplastic elastomer. The ring 61 engages with the bin 21 and secures a liner. (FIGS. 24A through 24D.) The bottom 33 and mouth 23 of the bin 21 of the twenty-fourth embodiment are essentially rectangular, as are the crest 26 and brim 24, which surround the mouth 23. (FIGS. 24A, 24C, 24D.) The ring 61 is sufficiently expandable to fit the bin 21 at the exterior of the crest 26 and the exterior of the brim 24 and to be removed from the bin 21. (FIGS. 24A through 24D.) The ring 61 is sufficiently retractable to grip the bin 21 at the exterior of the brim 24 and the exterior of the crest 26 and, when a liner 35 is present, to secure the liner 35 at the exterior of the crest 26 and at the seat 72. (FIGS. 24A, 24C, 24D.) Unlike the twenty-third embodiment, the twenty-fourth embodiment has a pull 88, a non-continuous, discrete feature on the rim 27 which is directly observable from the exterior of the bin 21 and which, like a tab 56, provides a point of contact for disengaging the ring 61 from the bin 21.

As in the fifteenth embodiment, all eleven characteristics enumerated as "1" through "11" in the description of the ninth embodiment are shared by the twenty-fourth embodiment (FIGS. 24A through 24D; compare with FIGS. 15A through 15F5.) As in the thirteenth and fifteenth embodiments, the edge 38 of the liner 35 is contained below the ring 61 and in or above the trough 34. (FIGS. 24B and 24C; compare with FIGS. 13E2 through 13G3, and 15H1 through 15H3.) Both the ring 61 and the trough 34 are part of the rim 27 and not within the chamber 45. (FIGS. 24C and 24D.) The trough 34 and its position within the rim 27 is, for grasping purposes, essentially the same as in the thirteenth and fifteenth embodiments and, as more fully described in reference to the thirteenth and fifteenth embodiments, the channel 79 promotes sanitary grasping of the rim 27 and lifting of the bin assembly. (FIGS. 24C and 24D.)

Throughout the ring 61 of the twenty-fourth embodiment, the ring 61 includes a cap 67 which joins an oblique face 66 which joins an indentation 91 which joins a return 92. At one corner of the ring 61, the return 92 joins the pull 88. (FIGS. 24A, 24C, 24D.)

Content information 8 is found on all sides of the ring 61, and is found at the cap 67, the oblique face 66, the indentation 91, the return 92, and the pull 88. (FIGS. 24A and 24B.) The content information 8 includes information in one or more of the six forms listed in the description of the twelfth embodiment and pertains to the identity or character of the items that are contained or intended to be contained within the bin 21, as described immediately after the list of six forms in the first embodiment.

Removal of the ring 61 permits removal of the liner 35 and installation of an alternative liner 35, and the removal of the ring 61 permits installation of a ring 61 with different content information 8. (FIGS. 24A and 24B; compare with FIGS. 7R, 13B, 13C and 14.)

To attach the ring 61 to the bin 21, the indentation 91 is pushed or pulled over the exterior of the brim 24 and the cap 67 is stretched to the exterior of the crest 26. (FIGS. 24A, 24C and 24D.) When no liner 35 is present and the ring 61 is fully installed, the cap 67 sits on the seat 72 and both the oblique face 66 and the indentation 91 grip the brim 24.

A liner 35 is installed and secured in the twenty-fourth embodiment in essentially the same way that a liner 35 is installed and secured in the twenty-third embodiment. The presence of a pull 88 has no significant involvement in the process of installing and securing a liner 35. (FIGS. 24A, 24C and 2DB; compare with FIGS. 23A and 23B.)

The pull 88 does have significant involvement in disengaging the ring 21 and removing any liner 35. By inserting the fingers of one hand between the pull 88 and the exterior wall 31 of the bin 21, placing the thumb of the same hand on the oblique face 66, and pulling the pull 88 outward and upward, the ring 61 may be detached from the brim 24 at the corner of the bin 21 where the pull 88 is located. (FIGS. 24B and 24D.) By pulling the pull 88, oblique face 66 and cap 67 outward and upward, the cap 67 may be lifted over the crest 26, again at the corner of the pull 88. Once the ring 61 has been disengaged from the brim 24 and crest 26 at the corner of the pull 88, the ring 61 may be disengaged from the remainder of the bin 21, thus permitting removal of any liner 35. (FIGS. 24A through 24D.)

Figure 25A:
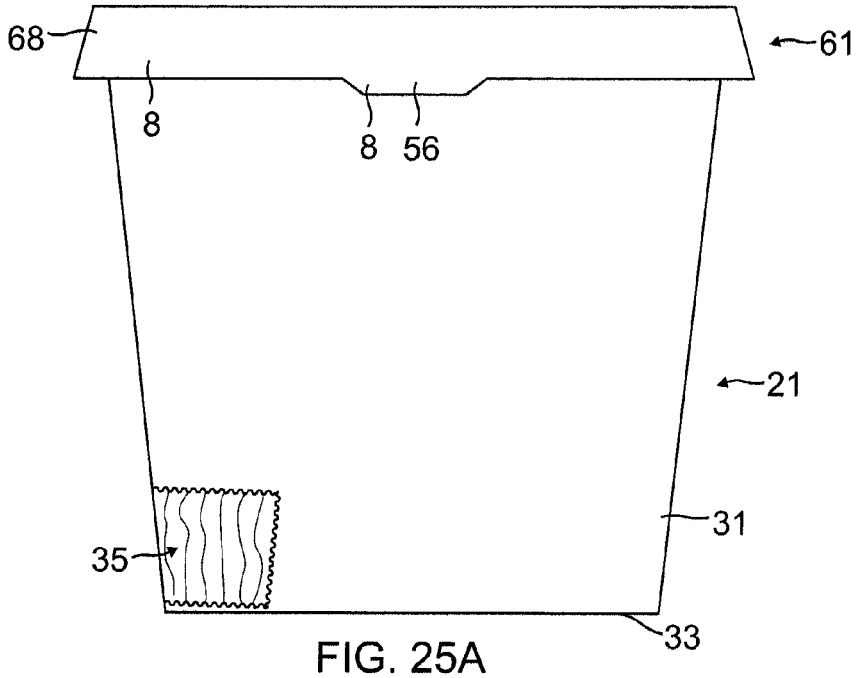
FIG. 25A is a side view of a twenty-fifth embodiment, a bin assembly, together with a liner lining the bin and secured by the ring.

The twenty-fifth embodiment, shown in FIGS. 25A through 25I, is a bin assembly in which the ring 61, like the ring 61 of the fifteenth embodiment, engages with the bin 21 by a snap fit. (FIGS. 25A through 25I; compare with FIGS. 15C, 15F2, 15F3 and 15H3.) Unlike the fifteenth embodiment, the bin of the twenty-fifth embodiment has no oblique face 66. (FIG. 25A.) Also, in the twenty-fifth embodiment, the bin has a ridge 83 and no crest 26, and the ring has no retainer 71. (FIGS. 25A through 25I; compare with FIGS. 15F1, 15F2, 15F3, 15H1, 15H2, 15H3.) Further, as discussed below, the bin of the twenty-fifth embodiment has no trough 34 capable of containing the edge 38 of the liner 35. (FIGS. 25A through 25I.) In place of a trough 34, a flare 81 serves, along with the ring 61, to contain the edge 38 an appropriately sized liner 35. (FIGS. 25C and 25G through 25I.)

Figure 25B:
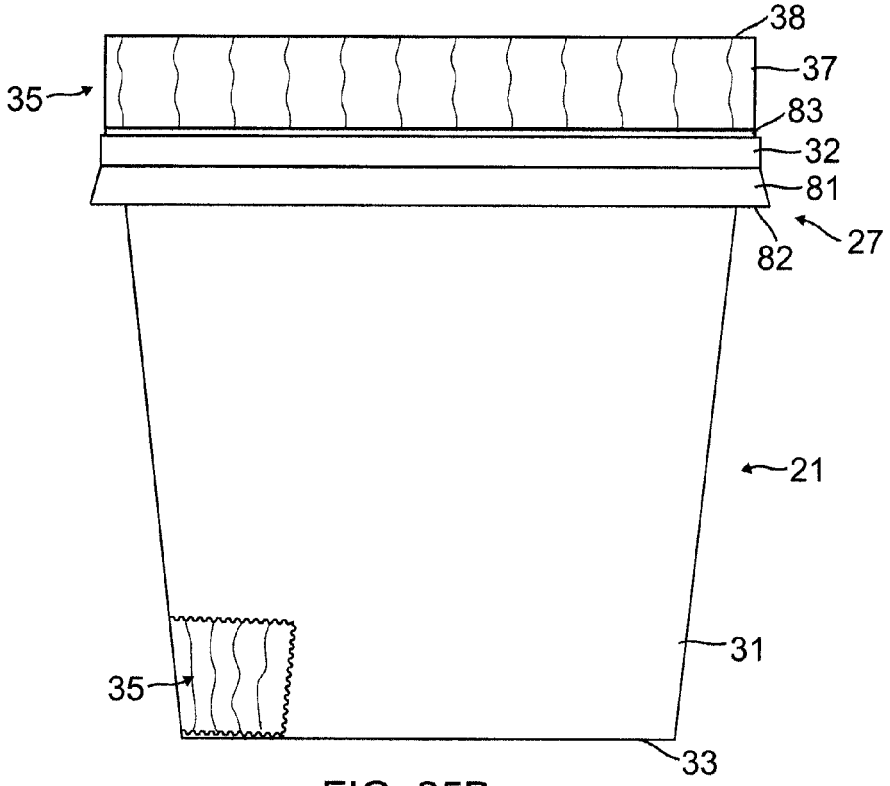
FIG. 25B is a side view of the bin of the twenty-fifth embodiment shown with a liner lining the bin and the edge of the liner extending upward.
Figure 25C:
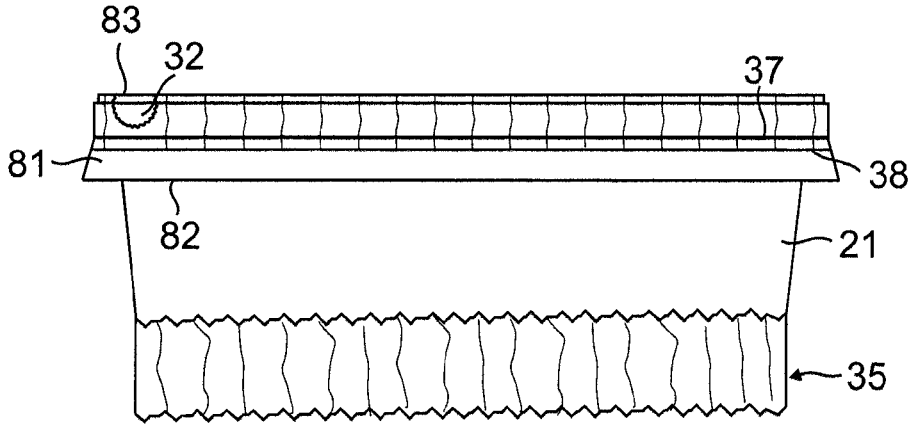
FIG. 25C is a side view of the bin of the twenty-fifth embodiment shown with a liner lining the bin and the edge of the liner turned downward.
Figure 25D:
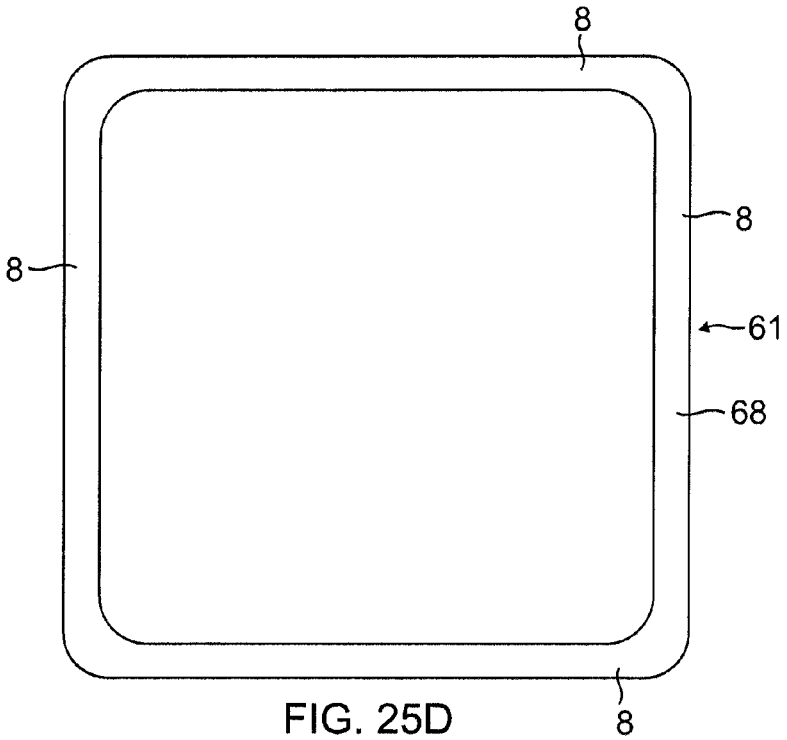
FIG. 25D is a top view of the ring of the twenty-fifth embodiment.
Figure 25E:
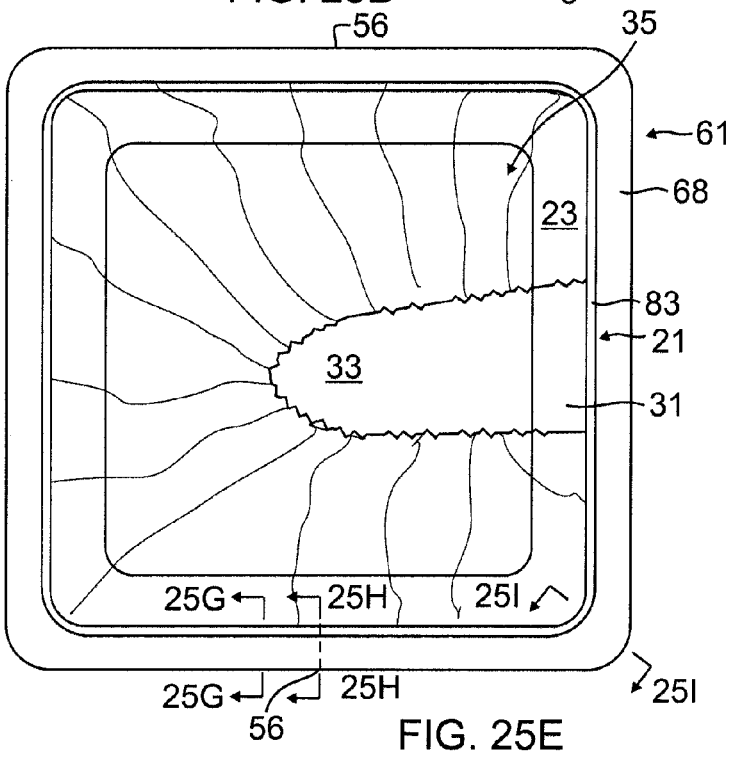
FIG. 25E is a top view of the bin assembly of the twenty-fifth embodiment together with the liner lining the bin and secured by the ring.
Figure 25F:
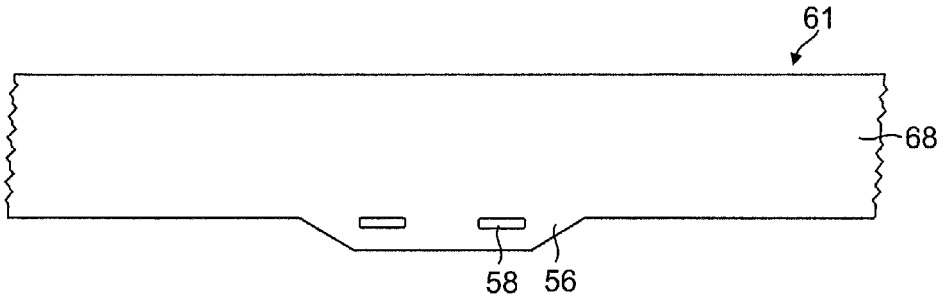
FIG. 25F is an interior view of a portion of the ring of the twenty-fifth embodiment.
Figure 25G:
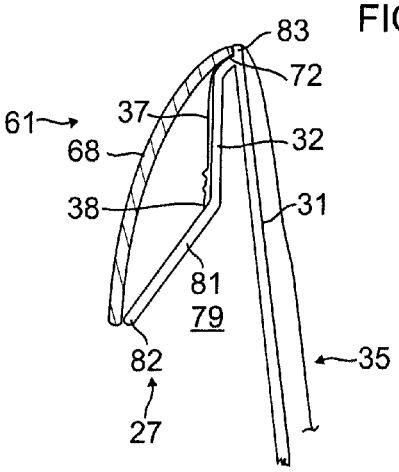
FIG. 25G is a cross section of the rim of the twenty-fifth embodiment together with the liner as shown in FIG. 25E.
Figure 25H:
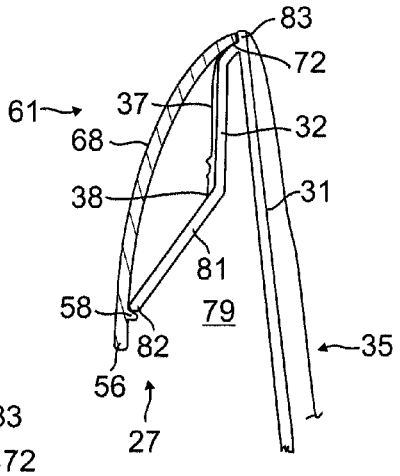
Figure 25I:
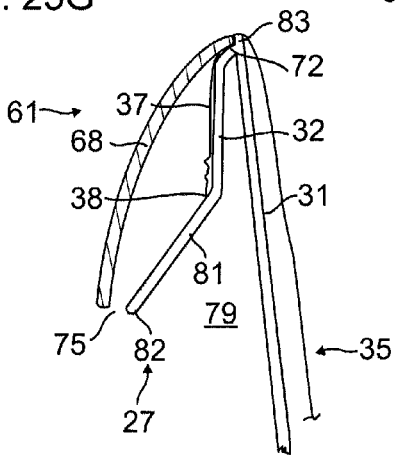

As in the fifteenth embodiment, all eleven characteristics enumerated as "1" through "11" in the description of the ninth embodiment are shared by the twenty-fifth embodiment (FIGS. 25A through 25I; compare with FIGS. 15A through 15F5.) The edge 38 of the liner 35 is contained below the ring 61 and on or above the flare 81. (FIGS. 25C, 25G, 25H, and 25I; compare with FIGS. 13E2 through 1303 and 15H1 through 15H3.) Both the ring 61 and the flare 81 are part of the rim 27 and not within the chamber 45. (FIGS. 25C and 25G through 25I) The flare 81's position within the rim 27 is, for grasping purposes, similar to that of the trough 34 in the thirteenth embodiment. The channel 79 allows fingers, or parts of fingers, to be inserted between the wall 31 and the flare 81 and further allows the rim 27 to be grasped and the bin assembly to be lifted with one hand without inserting fingers, or parts of fingers, in the chamber 45, thus promoting sanitary handling of the bin assembly. (FIGS. 25G through 25I.)

Unlike the troughs 34 of prior embodiments, the flare 81 of the twenty-fifth embodiment is not alone capable of containing the edge 38. Rather, where an appropriately sized liner 35 lines the bin 21, the downward movement of the edge 38 and border 37 will be stopped by the flare 81. (FIGS. 25B, 25C, 25E, 25G, 25H, and 25I; compare with FIGS. 15F1, 15F2, 15F3, 15H1, 15H2 and 15H3.) For the twenty-fifth embodiment, and all other embodiments in which the downward movement of the edge 38 and border 37 are stopped by a flare 81, an appropriately sized liner must not be excessively wide. If, for a given liner 35, any part of the edge 38 and border 37 moves below the flare 81, the perimeter of the liner 35 at the edge 38 or border 37 is too large and a narrower liner 35 is required.

The bottom 33 and mouth 23 of the bin 21 of the twenty-fifth embodiment are essentially rectangular. (FIG. 25E.) Content information 8 is found at all sides of the ring 61. (FIG. 25D.) Further, this content information 8 is found at the curved face 68 and the tab 56. (FIGS. 25A and 25B.)

The content information 8 includes information in one or more of the six forms listed in the description of the twelfth embodiment and pertains to the identity or character of the items that are contained or intended to be contained within the bin 21, as described immediately after the list of six forms in the first embodiment.

Removal of the ring 61 permits removal of the liner 35 and installation of an alternative liner 35, and the removal of the ring 61 permits installation of a ring 61 with different content information 8. (FIGS. 24A and 24B; compare with FIGS. 7R, 13B, 13C and 14.)

A liner 35 is installed and secured in the twenty-fifth embodiment by a method largely the same as that of the fifteenth embodiment (FIGS. 25A through 25I; compare with FIGS. 15C, 15F2, 15H2, 15F3, 15H3, 15F4 and 15F5.) The ring of the twenty-fifth embodiment and the ring of the fifteenth embodiment both engage with their respective bins by snap fits at opposing sides of the assembly. However, in attaching the ring 61 to the bin 21 of the twenty-fifth embodiment, the protuberances 58 (a type of protrusion) of the tabs 56 snap beneath the toe 82 of the flare 81 (FIGS. 25F and 25H; compare with FIGS. 15F3 and 15H3.) Thus, because the bin 21 of the twenty-fifth embodiment has no trough 34, the pre-engagement manual placement of the edge 38 and border 37 of the liner 35 is not encumbered by the rise 39, brim 24 or turn 60. (FIGS. 25G through 25I; compare with FIGS. 13F2, 15F2, 16F2, 17B, 18B, 19B, 20B, 21D1, 22B, 23B and 24C.) As indicated above, when an appropriately sized liner 35 is selected and the border 37 of the liner 35 is turned over the ridge 83, any excessive downward movement of the edge 38 is stopped by the flare 81. (FIGS. 25B, 25C, 25E, 25G, 25H, and 25I.)

In securing the liner 35, the ring 61 of the twenty-fifth embodiment does not employ, as in the fifteenth embodiment, a retainer 71. In the twenty-fifth embodiment, the liner 35 wraps over the ridge 83 and is secured at the seat 72 by the curved face 68. (FIGS. 25G through 25I; compare with FIGS. 15F1, 15F2, 15F3, 15H1, 15H2 and 15H3.)

Both the ring 61 and the liner 35 may be deliberately removed from the bin 21 of the twenty-fifth embodiment by pulling on opposing tabs 56 following essentially the same method used to remove the ring 61 and a liner 35 in the fifteenth embodiment. (FIGS. 25F and 15H; compare with FIGS. 15H3 and 7R.) To allow flexibility for disengaging the ring 61, at all four corners the ring 61 and the bin 21 leave a space 75 between the curve face 68 and the toe 82. (FIGS. 25E and 25I; compare with FIG. 15F4.)

Figure 26:
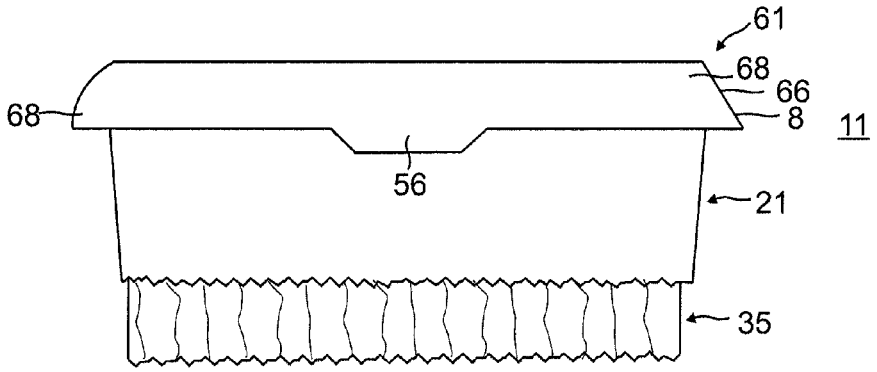

The twenty-sixth embodiment, shown in FIG. 26, is identical to the twenty-fifth embodiment except for one side, where the ring 61 of the twenty-sixth embodiment has an oblique face 66. (FIG. 26.) Structurally, the remaining three sides of the ring 61, and the bin 21 in its entirety, are the same as depicted in FIGS. 25A through 25I. Further, as in the twenty-fifth embodiment, all eleven characteristics enumerated as "1" through "11" in the description of the ninth embodiment are shared by the twenty-sixth embodiment, and, except as specifically provided in this description of the twenty-sixth embodiment, the structural description of the twenty-fifth embodiment applies equally to the twenty-sixth embodiment.

As in the twenty-fifth embodiment, the channel 79 allows fingers, or parts of fingers, to be inserted between the wall 31 and the flare 81 and further allows the rim 27 to be grasped and the bin assembly to be lifted with one hand without inserting fingers, or parts of fingers, in the chamber 45, thus promoting sanitary handling of the bin assembly. (FIGS. 25G through 25I.)

Removal of the ring 61 permits removal of the liner 35 and installation of an alternative liner 35, and the removal of the ring 61 permits installation of a ring 61 with different content information 8. (FIG. 26; compare with FIGS. 7R, 13B, 13C and 14.)

The placement of information on the ring of the twenty-sixth embodiment, however, is not the same as on the twenty-fifth embodiment. The oblique face 16 on one side of the ring 61 distinguishes that side of the ring from every other and provides the bin assembly with an obvious front 11. (FIG. 26.) Like any ring 61 of the fourteenth embodiment, the content information 8 found at the oblique face 66 includes information in one or more of six forms listed in the description of the twelfth embodiment, while the content information 8 found elsewhere on the ring 61 includes only information in one or more of the two forms listed at "a" and "b" in the description of the eighth embodiment. The content information 8 includes information that pertains to the identity or character of the items that are contained or intended to be contained within the bin 21, as described immediately after the list of six forms in the first embodiment.

Unlike the oblique face of the thirteenth, fifteenth and sixteenth embodiments, the oblique face of the twenty-sixth embodiment does not extend below the faces on the remaining sides of the ring 61. (FIG. 26; compare with FIGS. 13A, 15A, and 16A.) However, like oblique face 66 of the sixteenth embodiment, the oblique face of the twenty-sixth embodiment, is angled at approximately 60° below horizontal. (FIG. 26.) Apart from the relative reduction in height of the oblique face 66, the twenty-sixth embodiment has the same information visibility and accessibility characteristics as the sixteenth embodiment, including its structurally related capacity to permit side-by-side comparison of the content information 8 on the oblique faces and oblique lips of similar bins and bin assemblies. (FIG. 26; compare with FIGS. 16A and 1F.)

Figure 27A:
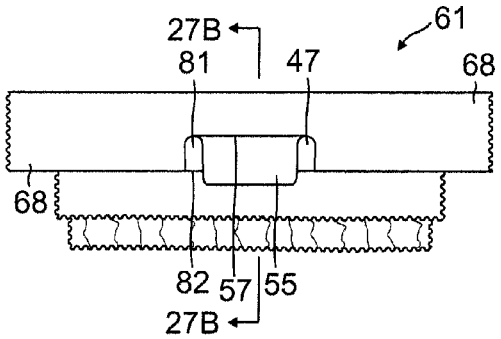
Figure 27B:
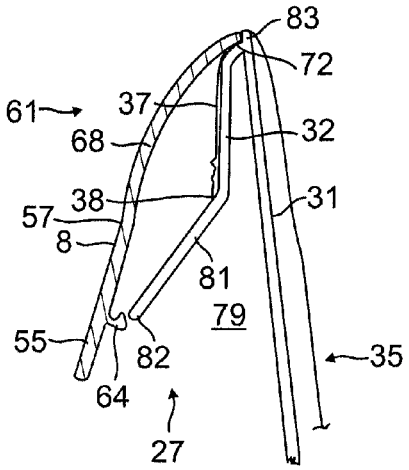

The twenty-seventh embodiment, shown in FIGS. 27A and 27B, is the same as the twenty-fifth embodiment except for the means by which the ring 61 engages and disengages with the bin 21. In the twenty-seventh embodiment, the means of attachment include the latches 55 and live hinges 57 at opposing sides of the bin. (FIGS. 27A and 27B; compare with FIGS. 25F and 25H.) Except for the engagement and disengagement means, described further below, the above description of the twenty-fifth embodiment applies equally to the twenty-seventh embodiment.

In the twenty-seventh embodiment, the ring 61 is engaged with the bin 21 by the closing of two latches 55. (FIGS. 27A and 27B.) Each of the latches 55 joins a live hinge 57 which in turn joins the curved face 68. (FIGS. 27A and 27B.) The two latches 55 are located at opposing sides of the ring 61 and are centered in two latchways 47 which permit the latches 55 to open and close without interference of the curved face 68 of the ring 61. (FIGS. 27A and 27B; compare with FIGS. 25A, 25E, 25F, and 25H). Each of the two latches 55 includes a hook 64 that engages with the toe 82 of the bin 21. The ring 21, flare 81, and fall 32 allow engagement and disengagement to occur by opening and closing the two latches 55. The spaces 75, found at the corners of the twenty-fifth embodiment, are not found in the twenty-seventh embodiment.

Figure 28A:
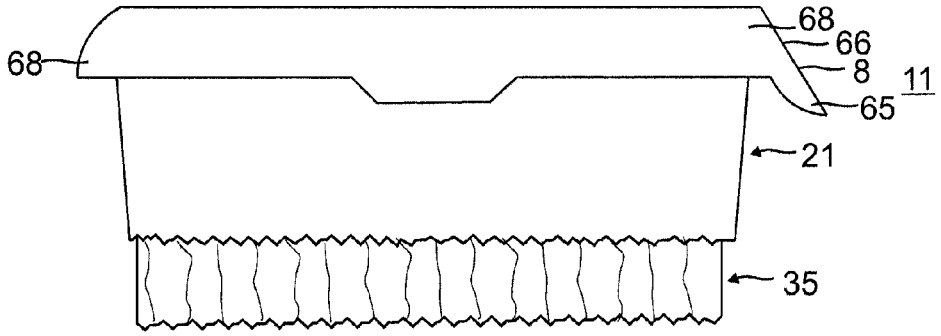
Figure 28B:
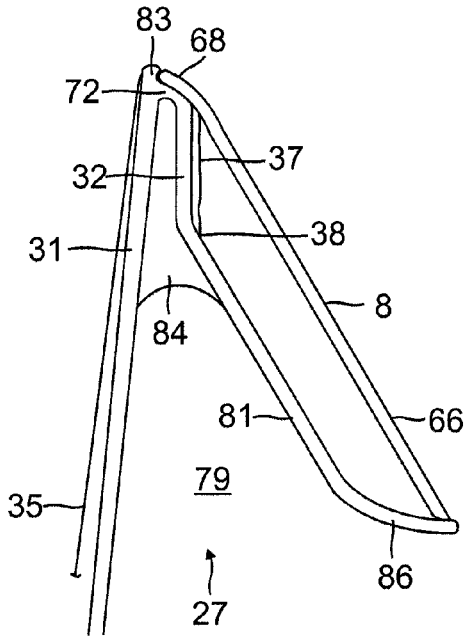

The twenty-eighth embodiment, shown in FIGS. 28A and 28B, is same as the twenty-sixth embodiment except at the front 11 where the oblique face 66 of the twenty-eighth embodiment extends below the curved faces 68 on the remaining sides of the ring 61. Like the oblique face 66 of the twenty-sixth embodiment, the oblique face 66 of the twenty-sixth embodiment is angled at approximately 60° below horizontal. Accommodating the longer oblique face 66, the flare 81 is longer at the front 11 than on the other three sides of the bin 21, (FIGS. 28A and 28B; compare with FIGS. 13E1 and 13E2.)

At the front 11 of the twenty-eighth embodiment, a grip 86 extends from the flare 81 to the oblique face 66 and serves, together with the flare 81, as a means of gripping the engaged bin assembly. (FIGS. 28A and 28B.) While the grip 86's descent lessens as it approaches the oblique face 66, the grip 86 does not turn upward and thus, unlike the trough 34, does not include a rise 39. Like the trough 34, however, the grip 86 may be used to sanitarily lift and grip the bin 21 without touching the bin 21's chamber 45. (FIGS. 28A and 28B; compare with FIGS. 13G2 and 13G3.) A reinforcement 84, between the wall 31 and the fall 32 and flare 81 provides additional strength and rigidity at the front 11. (FIG. 28B; compare with FIG. 15H1.) The grip 86, like the trough 34 and flare 81, promotes sanitary handling of the bin assembly. At all sides of the twenty-eighth embodiment, the channel 79 allows fingers, or parts of fingers, to be inserted between the wall 31 and the flare 81 and further allows the rim 27 to be grasped and the bin assembly to be lifted with one hand without inserting fingers or parts of fingers in the chamber 45, thus promoting sanitary handling of the bin assembly. (FIGS. 28B and 25G through 25I.)

At the front 11, the longer oblique face 66 is accommodated at the adjacent sides of the ring 61 where they join the oblique face 66. At each of these two adjacent sides, a vertical face 65 joins the extended portion of the oblique face 66. (FIG. 28A.)

In summary, except for the extended oblique face 66 and the accompanying elements at the front 11, as described in the preceding three paragraphs, the above descriptions of the twenty-sixth embodiment, including its referenced descriptions of the twenty-fifth embodiment, apply equally to the twenty-eighth embodiment.

Figure 29A:
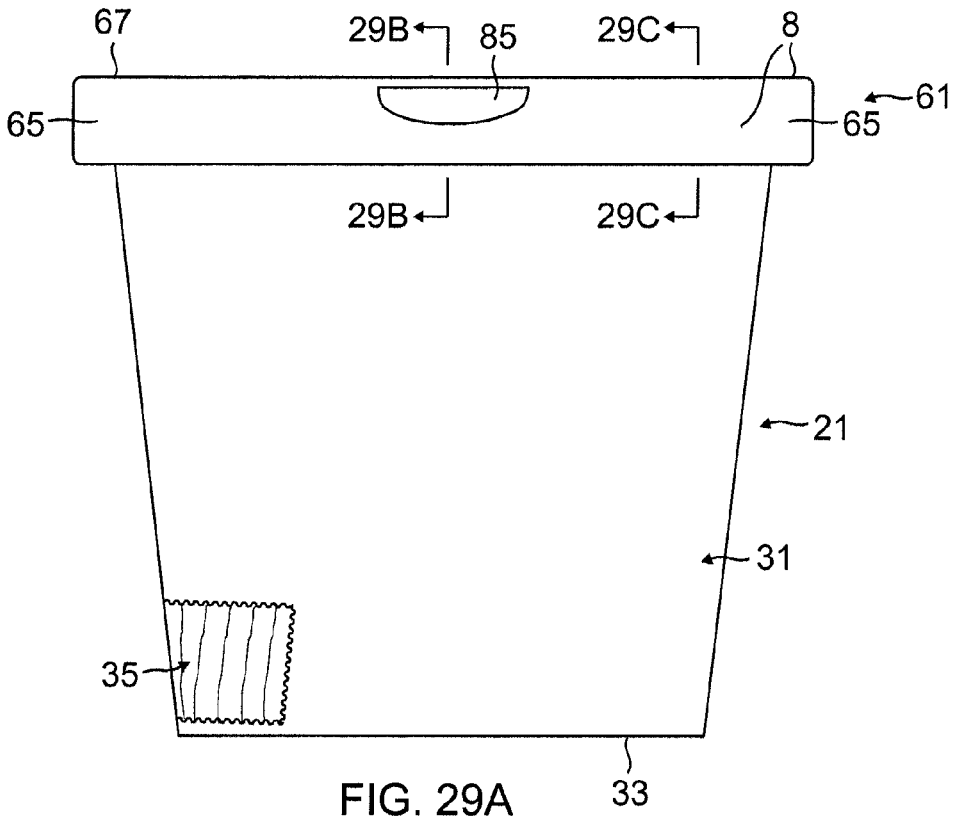
Figure 29B:
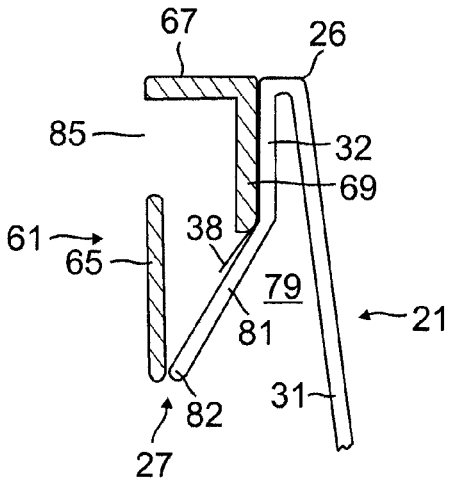
Figure 29C:
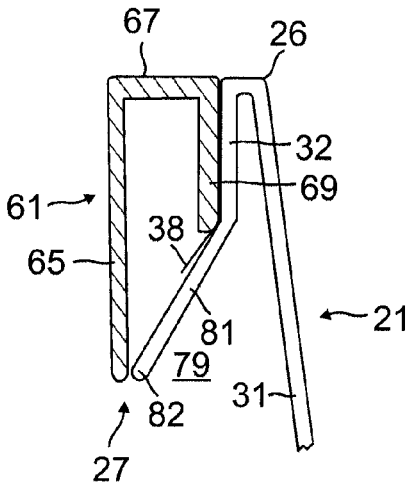

The twenty-ninth embodiment, shown in FIGS. 29A, 29B and 29C, resembles the thirteenth embodiment. In both embodiments, the ring 61 engages with the bin 21 by an interference fit and the disengagement means are visually identifiable at opposing sides of the bin assembly. (FIGS. 29A through 29C; compare with FIGS. 13A through 13G3.) However, like the twenty-fifth embodiment, the twenty-ninth has no oblique face 66 and no trough 34 capable of containing the edge 38 of the liner 35. Here, as with the twenty-fifth embodiment, where an appropriately sized liner 35 lines the bin 21, the downward movement of the edge 38 and border 37 is stopped by the flare 81. (FIGS. 29B and 29C; compare with FIGS. 25B, 25C, 25E, 25G, 25H, and 25I.)

The content information 8 includes information in one or more of the six forms listed in the description of the twelfth embodiment and pertains to the identity or character of the items that are contained or intended to be contained within the bin 21, as described immediately after the list of six forms in the first embodiment.

As in the thirteenth embodiment, all eleven characteristics enumerated as "1" through "11" in the description of the ninth embodiment are shared by the twenty-ninth embodiment (FIGS. 29A through 29C; compare with FIGS. 13A through 13G3.) Further, the edge 38 of the liner 35 is contained below the ring 61 and on or above the flare 81. (FIGS. 25C, 25G, 25H, and 25I; compare with FIGS. 13E2 through 13G3 and 15H1 through 15H3.) Both the ring 61 and the flare 81 are part of the rim 27 and not within the chamber 45. (FIGS. 25C and 25G through 25I.)

The flare 81 and channel 79 of the twenty-ninth embodiment are essentially the same as the flare 81 and channel 79 of the twenty-fifth embodiment. As more fully described above in the description of the twenty-fifth embodiment, the channel 79 promotes sanitary grasping of the rim 27 and lifting of the bin assembly with a single hand. (FIGS. 29B and 29C.). However, the flare 81 of the twenty-ninth embodiment, unlike the flare 81 of the twenty-fifth embodiment, does not engage with the ring 61 in a snap fit.

In the twenty-ninth embodiment, as in the thirteenth embodiment, the interference fit occurs between the riser 69, which is a type of flange, and the fall 32. (FIGS. 29B and 29C; compare with FIGS. 13G2 and 13G3.) The flare 81, however, does participate in the engagement process: in the twenty-ninth embodiment, the downward movement of the riser 69 is stopped by the flare 81. (FIGS. 29B and 29C.) With the exceptions that (1) the twenty-ninth embodiment lacks the extended oblique face 66 and front 11 of the thirteenth embodiment and (2) in the twenty-ninth embodiment the flare 81 stops the riser 69 while in the thirteenth embodiment the trough 34 and rib 78 stop the riser 69, the method of installing and securing a liner 35 is the same for the thirteenth and twenty-ninth embodiments. (FIGS. 29A through 29C; compare with FIGS. 13B, 13C, 13D, 13E1, 13E2, 13E3, 13G2, and 13G3.)

Except in one respect, disengagement of the ring 61 and removal of the liner 35 for the twenty-ninth embodiment is the same as the analogous disengagement and removal for the thirteenth embodiment. The one exception is the means of accessing the cap 67 and thereby exerting upward forces on the ring 61. In the thirteenth embodiment, the user gains access to exert upward forces through the opposing gaps 40, while in the twenty-ninth embodiment, the user gains such access through the opposing holes 85. (FIGS. 29A and 29B; compare with FIGS. 13B, 13G3 and 7R.) Like a gap 40, a hole 85 is a type of aperture and a visual cue to the means of disengagement. (FIG. 29A.)

Figure 30B:
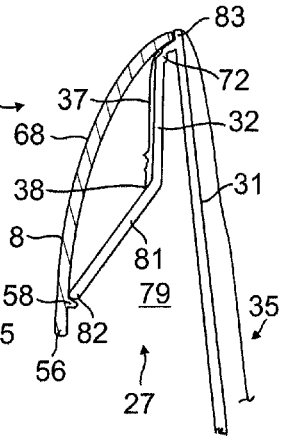

The thirtieth embodiment, shown in FIGS. 30A through 30D, is a bin assembly in which the ring 61, like the ring 61 of the eighteenth embodiment, engages with the bin 21 by a snap fit. (FIGS. 30A and 30B; compare with FIGS. 18A and 18B.) Like the bin 21 of the twenty-fifth embodiment, the bottom 33 and mouth 23 of the thirtieth embodiment are circular as is the ring 61. Like the eighteenth embodiment, the thirtieth embodiment has no oblique face 66. (FIGS. 30A and 30D.) With the exception the differences described in following paragraphs, the descriptions applicable to the eighteenth embodiment apply equally to the thirtieth First, like the twenty-fifth through twenty-ninth embodiments, the bin 21 of the thirtieth embodiment has a flare 81 instead of a trough 34. (FIGS. 30A and 30B; compare with FIGS. 18A and 18B.) The ring 61 of the thirtieth embodiment, like the ring 61 of the twenty-fifth embodiment, makes its snap fit with the flare 81. (FIG. 30B; compare with FIG. 25H.) The edge 38 of the liner 35 is contained below the ring 61 and on or above the flare 81. (FIGS. 30B, 30C and 30D; compare with FIGS. 13E2 through 13G3 and 15H1 through 15H3.) Both the ring 61 and the flare 81 are part of the rim 27 and not within the chamber 45. (FIGS. 30B through 30D.) The flare 81 and its position within the rim 27 is, for grasping purposes, essentially the same as in the twenty-fifth embodiment and, as more fully described for the twenty-fifth embodiment, the flare 81 promotes sanitary handling of the bin assembly. (FIG. 18B.)

Second, while the protuberance 58 (a type of protrusion) of the eighteenth embodiment is continuous and forms a circle on the inside of the vertical face 65, the protuberances 58 of the thirtieth embodiment, like those of the twenty-first embodiment, are discrete. (FIGS. 30C and 30D; compare with 21B.) Engagement of any ring, and the securing of any liner 35, require application of downward forces on the ring 61 only above the discrete protuberances 58.

Third, each protuberance 58 of the thirtieth embodiment is found only on the two tabs 56, which are discrete features of the rim 27 and are pulled outward to disengage the ring 61. (FIGS. 30A and 30B.) In contrast, the eighteenth embodiment has a continuous vertical face 65 but no tab 56. (FIGS. 18A and 18B.)

Fourth, in the thirtieth embodiment, unlike the eighteenth, spaces 75 allow the ring 61 flexibility for engagement and disengagement. (FIGS. 30A and 30D; compare with FIGS. 18A and 18B.) While in the fifteenth and twenty-fifth embodiments, the spaces 75 are found at each of the four corners, in the thirtieth embodiment the spaces 75 are found at opposing sides of the circular rim and equidistant between the two tabs 56. (FIGS. 30A and 30D; compare with FIGS. 15C and 15F4, and 25E and 25I.)

Fifth, the means of securing a liner 35 differs between the eighteenth and thirtieth embodiments. In the eighteenth embodiment, a liner 35 is clamped between the ring 61 and the bin 21 at the seat 72 by the retainer 71 and at the collar 73 by the cap 67. (FIG. 18B.) In the thirtieth embodiment, however, the clamping action of the ring 61 and bin 21 occurs exclusively at the seat 72 by the curved face 68. (FIG. 30B; compare with FIGS. 18A and 18B.)

Sixth, because the thirtieth embodiment has two tabs 56 and no cap 67, content information 8 for the thirtieth embodiment is found, among other locations, on the tabs 56 but not, of course, on any cap 67.

Seventh, while in the eighteenth embodiment the wall 31 of the bin 21 joins a crest 26, in the thirtieth embodiment, the wall 31 of the bin 21 joins a ridge 83 and a seat 72. (FIGS. 30B through 30D; compare with FIG. 18B.)

Eighth, all eleven characteristics enumerated as "1" through "11" in the description of the ninth embodiment are shared by the thirtieth embodiment, while the eleventh of those enumerated characteristics is not shared by the eighteenth embodiment. (FIGS. 30A through 30C; compare with FIGS. 18A and 18B.) The flare 81 and channel 79 of the thirtieth embodiment are essentially the same as the flare 81 and channel 79 of the twenty-fifth embodiment. As more fully described above in the description of the twenty-fifth embodiment, the channel 79 promotes sanitary grasping of the rim 27 and lifting of the bin assembly with a single hand. (FIGS. 30B and 30C.)

The thirty-first embodiment, shown in FIGS. 31A through 31C, is a bin assembly in which the ring 61, like the ring 61 of the thirtieth embodiment, engages with the bin 21 by a snap fit. (FIG. 31B.) Like the mouth 23 and ring 61 of the thirtieth embodiment, the mouth 23 and ring 61 of the thirty-first embodiment are circular (FIG. 31A; compare with FIG. 30A.) With a few differences, identified below, the descriptions applicable to the thirtieth embodiment apply equally to the thirty-first embodiment.

The bin 21 of the thirty-first embodiment differs from the bin 21 of the thirtieth embodiment in its absence of a fall 32 and a crest 26, in its presence of a frame 53 and a ridge 83, and in the joinder of the flare 81 directly with the wall 31 and frame 53. (FIGS. 31B and 31C; compare with FIGS. 30B and 30C.) The ring 61 of the thirty-first embodiment also differs from the ring 61 of the thirtieth embodiment in its inclusion of a cap 67 and in the manner in which cap 67 secures the liner 35. (FIGS. 31A, 31B, and 31C; compare with FIGS. 30A through 30D.)

In the thirty-first embodiment, the cap 67 secures the liner 35 by a downward force exerted by the cap 67 at the ridge 83. (FIGS. 31B and 31C.) In previous lined embodiments, even in lined embodiments in which a ridge 83 was present, the ring 61 secured the liner 35 in such a manner that no interior-facing portion of the bin 21 or ring 61 was left unprotected by the liner. However, in the thirty-first embodiment, the cap 67 leaves its terminus 90, which faces the assembly's chamber 45, unprotected by the liner 35. (FIGS. 31B and 31C.) Of the eleven characteristics enumerated as "1" through "11" in the description of the ninth embodiment, only ten of the characteristics—the first seven and the final three—apply to the thirty-first embodiment. The presence of the unprotected interior-facing terminus 90 precludes application of the eighth enumerated characteristic to the thirty-first embodiment. However, the flare 81 and channel 79 of the twenty-ninth embodiment are essentially the same as the flare 81 and channel 79 of the twenty-fifth embodiment. As more fully described in the twenty-fifth embodiment, the channel 79 promotes sanitary grasping of the rim 27 and lifting of the bin assembly with a single hand. (FIGS. 31B and 31C.)

The content information 8 of the thirty-first embodiment is found not only at the curved face 68, the vertical face 65, and the tab 56, as in the thirtieth embodiment, but also at the cap 67. (FIG. 31A; compare with FIG. 30A.) The content information 8 includes information in one or more of the six forms listed in the description of the twelfth embodiment and pertains to the identity or character of the items that are contained or intended to be contained within the bin 21, as described immediately after the list of six forms in the first embodiment.

The thirty-second embodiment, shown in FIGS. 32A through 33C, is a bin assembly in which the ring 61, like the ring 61 of the twenty-seventh embodiment, engages with, and disengages from, the bin 21 by the opening and closing of two latches 55. Like the mouth 23 and bottom 33 of the thirtieth embodiment, the mouth 23 and bottom 33 of the thirty-second embodiment are circular (FIG. 32A; compare with FIG. 30A.) With the exception of the differences identified in the following paragraphs, the descriptions applicable to the thirtieth embodiment apply also to the thirty-second embodiment.

The ring 61 of the thirty-second embodiment differs from the ring 61 of the thirtieth embodiment in eight respects. First, in the thirty-second embodiment, as discussed further below, the means of engagement and disengagement of the ring 61 differ from the means of engagement and disengagement of the ring 61 of the thirtieth embodiment. (FIGS. 32A through 32H.) Second, the flare 81, unlike the flare 81 of prior embodiments, extends horizontally outward from the fall 32, and the channel 79 is found between the fall 32 and the wall 31. However, as in the thirtieth and twenty-fifth embodiments, the channel 79 allows fingers, or parts of fingers, to be inserted in the channel 79 and further allows the rim 27 to be grasped and the bin assembly to be lifted with one hand without inserting fingers, or parts of fingers, in the chamber 45, thus promoting sanitary handling of the bin assembly. (FIG. 32C; compare with FIGS. 25G through 25I.) Third, the spaces 75 found at each of two opposing sides of the thirtieth embodiment, are not found in the thirty-second embodiment. (FIGS. 32A through 32C; compare with FIG. 30D.) Fourth, while the vertical face 65 in the thirtieth embodiment extends through 360° of the ring 61, the vertical face 65 in the thirty-second embodiment is found only immediately above the two latches 55. Fifth, to accommodate the two live hinges 57, each of the two vertical faces 65 is horizontally straight so that, when viewed from above, the generally circular ring 61 is flattened at each of the two live hinges 57. (FIGS. 32B and 32C.) Sixth, the exterior perimeter of the bin 21—specifically, the turn 60 and the end 62—are similarly flattened at two opposing sides to accommodate the two flattened hinged areas on the ring 61. Seventh, unlike the ring 61 of the thirtieth embodiment, the ring 61 of the thirty-second embodiment has a cap 67. (FIGS. 32A and 32B; compare with FIGS. 30A through 30D.) Eighth, in the thirty-second embodiment, content information 8 is also found on the cap 67 and the latches 55, elements that are not found in the thirtieth embodiment. (FIGS. 32A and 32B; compare with FIGS. 30A through 30D.).

The engagement means of the thirty-second embodiment include two latches 55 which are found at opposite sides of the ring 61. The ring 61 is engaged with the bin 21 by the closing of two latches 55. (FIG. 32C.) Each of the latches 55 joins a live hinge 57 which in turn joins the vertical face 65. (FIGS. 32B and 32C.) The two latches 55 are located at opposing sides of the ring 61. (FIGS. 32A and 32C.) Each of the two latches 55 includes a hook 64 that engages with the end 62. In the thirty-second embodiment, the end 62 is found beneath the flare 81 and the turn 60. (FIGS. 32A and 32C.)

To disengage the rim 61 from the bin 21 of the thirty-second embodiment, the two latches 55 are rotated open, causing the hook 64 to disengage from the end 62. (FIGS. 32A and 32C.) Disengagement of the ring 61 allows for removal of any liner 35.

The thirty-third embodiment, shown in FIGS. 33A and 33B, is a bin assembly in which the circular ring 61, like the circular ring 61 of the twenty-third embodiment, is formed of an elastic polymer, such as rubber or synthetic rubber, or a thermoplastic elastomer. The ring 61 engages with the bin 21 and secures a liner 35. (FIGS. 33A and 32B; compare with FIGS. 23A and 23B.) With the exception of the differences described in the following paragraphs, the descriptions applicable to the twenty-third embodiment apply equally to the thirty-third.

Unlike bin 21 of the twenty-third embodiment, which has a trough 34 that terminates in a brim 24, the bin 21 of the thirty-third embodiment has a flare 81 that terminates in a toe 82 (FIG. 33B; compare with FIG. 23B.) In the thirty-third embodiment, the edge 38 of the liner 35 is contained below the ring 61 and above the flare 81. The flare 81 and its position within the rim 27 is, for grasping purposes, essentially the same as described for the twenty-fifth embodiment, though the indentation 91 extends beneath the toe 81 (FIGS. 33A and 33B; compare with FIGS. 25B and 25G.) Unlike ring 61 of the twenty-third embodiment, the ring 61 of the thirty-third embodiment terminates at the indentation 91; it has no return 92. (FIG. 33B compare with FIG. 23B.) Further, in the thirty-third embodiment, the channel 79 is found not between the trough 34 and the wall 31 but between the flare 81 and the wall 31 and between the fall 32 and the wall 31. (FIG. 33B; compare with FIG. 23B). However, the channel 79 again allows fingers, or parts of fingers, to be inserted in the channel 79 and further allows the rim 27 to be grasped and the bin assembly to be lifted with one hand without inserting fingers, or parts of fingers, in the chamber 45, thus promoting sanitary handling of the bin assembly. (FIG. 33B; compare with FIG. 23B.)

To attach the ring 61 to the bin 21 of the thirty-third embodiment, the indentation 91 is pushed under the exterior of the toe 82 and the cap 67 is stretched to the exterior of the crest 26. When no liner 35 is present and the ring 61 is fully installed, the cap 67 sits on the seat 72 and both the oblique face 66 and the indentation 91 grip the toe 82.

In installing a liner 35, the ring 61 of the thirty-third embodiment may initially be placed on the bin 21 so that the indentation 91 rests on the toe 82. The elastic ring 61 is then pushed under the toe 24, so that (1) the oblique face 66 and indentation 91 grip the toe 82 and (2) the horizontal cap 67 grips the liner 35 at the crest 26 and the seat 72. (FIGS. 33A and 33B.) The grip of the oblique face 66 and indentation 91 of the toe 82 must be sufficiently strong that indentation 91 is not inadvertently dislodged in lifting the bin 21 at the flare 81 and indentation 91. (FIG. 33B.)

To remove the liner 35 from the bin 21, the indentation 91 of the ring 61 may be deliberately pulled upward and outward so that the indentation 91 is pulled above the toe 82. By pulling the oblique face 66 and cap 67 outward and upward, the cap 67 may be lifted over the crest 26. Once the ring 61 has been disengaged from the brim 24 and crest 26 throughout all 360° of the bin 21, the liner 35 may be removed from the bin 21. (FIGS. 33A and 33B.)

The thirty-fourth embodiment, shown in FIGS. 34A through 34D, like the twenty-fourth embodiment, is a bin assembly in which the ring 61 is formed of an elastic polymer, such as rubber or synthetic rubber, or a thermoplastic elastomer. The ring 61 engages with the bin 21 and secures a liner 35. (FIGS. 34A through 34D; compare with FIGS. 24A through 24D.) As in the thirty-third embodiment, in the thirty-fourth embodiment the channel 79 is found between the flare 81 and the wall 31 and between the fall 32 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIGS. 34C and 34D; compare with FIG. 33B.) With the exception of the differences described in the following paragraphs, the descriptions applicable to the thirty-third embodiment apply equally to the thirty-fourth embodiment.

Unlike the thirty-third embodiment, the thirty-fourth embodiment includes a curved face 68 which joins a vertical face 65 and a cap 67 as a continuous curve. (FIGS. 34C and 34D.) The thirty-fourth embodiment has no oblique face 66 and thus, in the thirty-fourth embodiment, the toe 82 is gripped only by the indentation 91. (FIGS. 34C and 34D.) Any liner 35 is gripped only by the cap 67, at the seat 72 and at the exterior of the crest 26. (FIGS. 34C and 34D.)

Unlike the thirty-third embodiment, the thirty-fourth embodiment has a pull 88 to facilitate removal of the ring 61. (FIGS. 34A through 34C.) The pull 88 joins the return 92 which joins the indentation 91. (FIG. 34C.) The pull 88 and the return 92 are located at one of two rounded ends of the ring 61. (FIGS. 34A, 34B, and 34C; compare with FIGS. 24A, 24B, and 24D.) By inserting the fingers of one hand between the pull 88 and the exterior wall 31 of the bin 21, and by pulling the pull 88 outward and upward, the ring 61 may be detached from the immediate portion of the bin 21, thus facilitating complete detachment and removal of the ring 61 and removal of any liner 35. (FIGS. 24B and 24D.)

In the thirty-fourth embodiment content information 8 is found at the cap 67, the curved face 66, the vertical face 65, the indentation 91, the return 92 and the pull 88. (FIGS. 24A and 24C; compare with FIGS. 33A and 33B.) The content information 8 includes information in one or more of the six forms listed in the description of the twelfth embodiment and pertains to the identity or character of the items that are contained or intended to be contained within the bin 21, as described immediately after the list of six forms in the first embodiment.

The thirty-fifth embodiment is a bin assembly that includes a bin 21, a lid 16 and a ring 61. A portion of the bin 21 and a portion of the lid 16 of the thirty-fifth embodiment are depicted in the cross-sectional FIG. 35. The portion of the bin 21 depicted in FIG. 35 includes a rim 27 without the ring 61 but with a liner 35 that lines the bin 21 (FIG. 35.) The rim 27 includes a trough 34, and the edge 38 of the liner 35 is contained below the ring 61 (not shown) and in or above the trough 34. (FIG. 35; compare with FIGS. 13A, 13B and 13C.) The means by which the ring 61 engages with the bin 21 and secures the liner 35 are the ring-engagement means and liner-retention means disclosed in the thirteenth through twenty-fourth embodiments (FIG. 13A through 24D) or by such other means as fall within the spirit of this disclosure. As in the thirteenth and fifteenth embodiments, in the thirty-fifth embodiment the channel 79 is found between the trough 34 and the wall 31 and between the fall 32 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 35.)

The rim 27 of the bin 21 of the thirty-fifth embodiment accommodates the lid 16 so that, when set in place on bin 21, the structure 18 of the lid 16 rests directly on the liner 35 and indirectly on the ledge 51. (FIG. 35.) The lid 16, only a portion of which is shown, may completely cover the mouth 23 of the bin 21. Alternatively, the lid 16 may provide an opening 19 to the mouth 23 and the opening 19 may be either unobstructed or doored. (FIG. 35.) When the lid 16 is removed from the bin 21, the liner 35 remains secured by the ring 61 (not shown). (FIG. 35.)

The thirty-sixth embodiment is a bin assembly that includes a bin 21, a lid 16 and a ring 61. A portion of the bin 21 and a portion of the lid 16 of the thirty-sixth embodiment are depicted in the cross-sectional FIG. 36. The portion of the bin depicted in FIG. 36 includes a rim 27 without the ring 61 but with a liner 35 that lines the bin 21. (FIG. 36.) The rim 27 includes a flare 81, and the edge 38 of the liner 35 is contained below the ring 61 (not shown) and on or above the flare 81. (FIG. 36; compare with FIGS. 25C, 25G, 25H and 25I.) The means by which the ring 61 engages with the bin 21 and secures the liner 35 are the ring-engagement means and liner-retention means shown in the twenty-fifth through thirty-fourth embodiments (FIGS. 25A through 34D) or such other means as fall within the spirit of this disclosure. As in the twenty-fifth embodiment, in the thirty-sixth embodiment the channel 79 is found between the flare 81 and the wall 31 and between the fall 32 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 36; compare with FIG. 25G through 25I.)

The rim 27 of the bin 21 of the thirty-sixth embodiment accommodates the lid 16 so that, when set in place on bin 21, the structure 18 of the lid 16 rests directly on the liner 35 and indirectly on the ledge 51. (FIG. 36.) The lid 16, only a portion of which is shown, may completely cover the mouth 23 of the bin 21. Alternatively, the lid 16 may provide an opening 19 to the mouth 23 and the opening may be either unobstructed or doored. (FIG. 36.) When the lid 16 is removed from the bin 21, the liner 35 remains secured by the ring 61 (not shown). (FIG. 36.)

The thirty-seventh embodiment is a bin assembly that includes a bin 27 and a lid 16. A portion of the bin 21 and a portion of a lid 16 of the thirty-seventh embodiment are depicted in FIG. 37. A liner 35 lines the bin 21. (FIG. 37.)

The bin 21 of the thirty-seventh embodiment includes a wall 31, a fall 32, and a trough 34, which includes a rise 39 that terminates in a brim 24. The bin 21 also includes a seat 72 which joins the wall 31 and the fall 32. The lid 16 includes a cover 17, a curved face 68, a vertical face 65, and two opposing tabs 56 with a protuberance 58 (a type of protrusion) on each tab (only one tab 56 shown). (FIG. 37.)

The edge 38 of a liner 35 is contained below the lid 16 and above or in the trough 34. (FIG. 37.) As previously described, the trough 34 contains the edge of a liner 35. (FIG. 37; compare with FIG. 15H3.) As in the thirteenth and fifteenth embodiments, in the thirty-seventh embodiment the channel 79 is found between the trough 34 and the wall 31 and between the fall 32 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 37.)

The lid 16 is engaged with the bin 21 at the brim 24. (FIG. 37.) The lid 16 engages with the bin 21 by a snap fit, and the means of engagement and disengagement are essentially the same as the means of engagement and disengagement for the ring 61 in the fifteenth embodiment. (FIG. 37; compare with FIG. 15H3.) To allow the lid sufficient flexibility to engage and disengage with the bin 21 by a snap fit, the lid 16 of the thirty-seventh embodiment leaves spaces 75 between the vertical face 65 and the brim 24 at appropriate locations. (FIGS. 30A and 30D.)

The lid 16 secures the liner 35 at the seat 72. (FIG. 37.) The downward force of the cover 17 of the engaged lid 16 holds the liner 35 against the seat 72. (FIG. 37.) The liner 35 is released for removal by disengaging the lid 16 in essentially the same manner as the liner 35 is released by disengaging the ring 61 in the fifteenth embodiment. (FIG. 37; compare with FIG. 15H3.)

The lid 16, only a portion of which is shown in FIG. 37, may completely cover the mouth 23 of the bin 21. (FIG. 37.) Alternatively, the lid 16 may not cover the entire mouth 23 but may provide an opening 19 to the mouth 23 and the opening 19 may be either unobstructed or doored. (FIG. 37.) When the lid 16 of the thirty-seventh embodiment is removed from the bin 21, the liner 35 is no longer secured and may be removed from the bin and replaced by an alternative liner 35. (FIG. 37.)

The thirty-eighth embodiment is a bin assembly that includes a bin 27 and a lid 16. A portion of the bin 21 and a portion of the lid 16 of the thirty-seventh embodiment are depicted in FIG. 37. A liner 35 lines the bin 21, (FIG. 38). With the exception of the differences described in the following paragraphs, the descriptions applicable to the thirty-seventh embodiment apply equally to the thirty-eighth embodiment.

The bin 21 of the thirty-eighth embodiment differs from the bin 21 of the thirty-seventh embodiment in the absence of a seat 72 and a fall 32 and in the presence of a frame 53 and a ridge 83. The vertical frame 53 joins the wall 31 and terminates in the ridge 83. The trough 34 is found at the junction of the wall 31 and the frame 53. The rise 39 is straight and joins both the wall 31 and the frame 53. (FIG. 38.) The thirty-eighth embodiment lacks the channel 79 and does not allow fingers, or parts of fingers, to be inserted behind the trough 34 other than by inserting fingers or parts of fingers into the chamber 45. (FIG. 38.) The lid 16 of the thirty-eighth embodiment differs from the lid 16 of the thirty-seventh embodiment in the absence of any tab 56 or protuberance 58 (a type of protrusion) and the presence of an indentation 91. Unlike the lid 16 of the thirty-seventh embodiment, the lid 16 of the thirty-eighth embodiment, or the periphery of the lid 16, is formed of an elastic polymer, such as rubber, a synthetic rubber, or a thermoplastic elastomer. (FIG. 38; compare with FIG. 37.) (FIG. 38.)

The means of engaging and disengaging the lid 16 of the thirty-eighth embodiment are similar to the means of engaging and disengaging the ring 61 of the twenty-third embodiment. (FIG. 38; compare with FIG. 23B.) To engage the lid 16 on the bin 21 of the thirty-eighth embodiment, the lid 16 may initially be placed on the bin 21 so that the return 92 rests on the brim 24. The lid 16, or the periphery of the lid 16, is then pushed or pulled over the exterior of the brim 24 so that the indentation 91 grips the brim 24 and the cover 17 exerts sufficient downward force at the ridge 83 to secure any liner 35. (FIG. 38; compare with FIG. 23B.) To disengage the lid 16 and to remove any liner 35 from the bin 21, the return 92 or indentation 91 may be deliberately pulled outward and upward so that the indentation 91 is pulled above the brim 24, thus permitting the lid 16 to be removed from the bin 21 and allowing removal of any liner 35 and installation of a replacement liner 35.

The thirty-ninth embodiment is a bin assembly that includes a bin 27 and a lid 16. A portion of the bin 21 and a portion of a lid 16 of the thirty-ninth embodiment are depicted in FIG. 39. A liner 35 lines the bin 21. (FIG. 39.) With the exception of the differences described in the following paragraphs, the descriptions applicable to the thirty-seventh embodiment apply equally to the thirty-ninth embodiment.

The bin 21 of the thirty-ninth embodiment includes a ridge 83 at the top of the wall 31. The seat 72 of the thirty-ninth embodiment, which is less extensive than the seat 72 of the thirty-seventh embodiment, sits between the ridge 83 and the fall 32. The bin also includes a brim 24 that includes a notch 59 that opens outward. The lid 16 includes two live hinges 57, each joining an opposing tab 56 to a curved face 68, which is vertically curved. An insert 54 (a type of protrusion) is found on the inner side of each of the two opposing tabs 56. From the cover 17 of the lid 16, a retainer 71 (a type of flange) extends downward. (FIG. 39.) Unlike the lid 16 of the thirty-seventh embodiment, the lid 16 of the thirty-ninth embodiment leaves no spaces 75 between the vertical face 65 and the brim 24.

The lid 16 secures the liner 35 at the seat 72. (FIG. 39.) The downward force of the retainer 71 holds the liner 35 against the seat 72. (FIG. 39.)

The lid 16 engages with, and disengages from, the bin 21 at the brim 24 in a manner similar to the manner that the ring 61 of the twenty-second embodiment engages with, and disengages from, the bin 21 of the sixteenth embodiment. To engage the lid 16, two latches 55, each of which is attached to a live hinge 57, are closed so that each of the two inserts 54 lock in its corresponding notch 59. (FIG. 39; compare with FIG. 22B.)

To disengage the lid 16, the two latches 55 are pulled open, thereby disengaging the inserts 54 from the notches 59 and permitting removal of the lid 16, removal of the liner 35, and installation of a replacement liner 35. (FIG. 39; compare with FIG. 16F3.)

The fortieth embodiment is a bin assembly that includes a bin 27 and a lid 16. A portion of the bin 21 and a portion of a lid 16 of the fortieth embodiment are depicted in FIG. 40. A liner 35 lines the bin 21. (FIG. 40.) With the exception of the differences described in the following paragraphs, the descriptions applicable to the thirty-seventh embodiment apply equally to the fortieth embodiment.

Unlike the lid 16 and bin 21 of the thirty-seventh embodiment, the lid 16 and bin 21 of the fortieth embodiment do not engage. The bin 21 of the fortieth embodiment differs from the bin 21 of the thirty-seventh embodiment only with respect to the brim 24 of the rise 39. While the brim 24 of the thirty-seventh embodiment has a substantial downward curve to facilitate a snap fit, the brim 24 of the fortieth embodiment, which does not participate in a snap fit, terminates more abruptly. Further, because the lid 16 of the fortieth embodiment does not engage with the bin 21, the lid 16 lacks any engagement means and, unlike the thirty-seventh embodiment, has neither a tab 56 nor a protuberance 58 (a type of protrusion). At each of two opposing sides of the lid 16, a lift 87 extends horizontally outward from the vertical face 65. (FIG. 40.) The two lifts 87 facilitate the lifting of the lid 16 from the bin 21. (FIG. 40.)

The lid 16 secures the liner 35 at the seat 72. (FIG. 40.) The weight of the lid 16 at the seat 72 holds the liner 35 in place. (FIG. 40.) The liner 35 is released for removal and replacement by lifting the lid 16 from the bin 21. (FIG. 40.)

The forty-first embodiment is a bin assembly that includes a bin 27 and a lid 16. A portion of the bin 21 and a portion of a lid 16 of the forty-first embodiment are depicted in FIG. 41. An appropriately sized liner 35 lines the bin 21. (FIG. 41.)

The bin 21 of the forty-first embodiment includes a wall 31, a fall 32, and a flare 81 which terminates in a toe 82. The bin 21 also includes a seat 72 which joins the wall 31 and the fall 32. The lid 16 includes a cover 17, a curved face 68, a vertical face 65, and two opposing tabs 56 with a protuberance 58 (a type of protrusion) on the inward facing side of each tab 56 (only one tab 56 shown). (FIG. 41.)

The edge 38 of a liner 35 is contained below the lid 16 and above or on the flare 81. (FIG. 41.) As previously described, the flare 81 stops the downward movement of the edge of an appropriately sized liner. As in the twenty-fifth embodiment, in the forty-first embodiment the channel 79 is found between the flare 81 and the wall 31 and between the fall 32 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 41; compare with FIGS. 25G through 25I.)

The lid 16 is engaged with the bin 21 at the toe 82. (FIG. 41.) The lid 16 engages with the bin 21 by a snap fit, and the means of engagement and disengagement of the ring are essentially the same as the means of engagement and disengagement for the rings 61 in the twenty-fifth and thirtieth embodiments. (FIG. 41; compare with FIG. 25H.) To allow the lid 16 sufficient flexibility to engage and disengage with the bin 21 by a snap fit, the lid 16 of the forty-first embodiment leaves spaces 75 between the vertical face 65 and the toe 82 at appropriate locations. (FIGS. 30A and 30D.)

The lid 16 secures the liner 35 at the seat 72. (FIG. 41.) The downward force of the cover 17 of the engaged lid 16 holds the liner 35 against the seat 72. (FIG. 41.) The liner 35 is released for removal by disengaging the lid 16 in essentially the same manner as the liner 35 is released by disengaging the ring 61 in the fifteenth embodiment. (FIG. 41; compare with FIG. 15H3.)

The lid 16, only a portion of which is shown in FIG. 41, may completely cover the mouth 23 of the bin 21. (FIG. 41.) Alternatively, the lid 16 may not cover the entire mouth 23 but provide an opening 19 to the mouth 23 and the opening 19 may be either unobstructed or doored. (FIG. 41.) When the lid 16 of the forty-first embodiment is removed from the bin 21, the liner 35 is no longer secured and may be removed from the bin and replaced by an alternative liner 35. (FIG. 41.)

The forty-second embodiment is a bin assembly that includes a bin 27 and a lid 16. A portion of the bin 21 and a portion of a lid 16 of the forty-second embodiment are depicted in FIG. 41. A liner 35 lines the bin 21. (FIG. 42.) With the exception of the differences described in the following paragraphs, the descriptions applicable to the forty-first embodiment apply equally to the forty-second embodiment.

The bin 21 of the forty-second embodiment differs from the bin 21 of the forty-first embodiment in the absence of a seat 72 and a fall 32 and in the presence of a frame 53 and a ridge 83.

The vertical frame 53 joins the wall 31 and terminates in the ridge 83. The flare 81 is found extending from the junction of the wall 31 and the frame 53. (FIG. 42.) However, as in the forty-first embodiment, in the forty-second embodiment the channel 79 is found between the flare 81 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 42; compare with FIGS. 25G through 25I.)

The lid 16 of the forty-second embodiment differs from the lid 16 of the forty-first embodiment in the absence of any tab 56 or protuberance 58 (a type of protrusion) and in the presence of an indentation 91. (FIG. 42; compare with FIG. 41.) Unlike the lid 16 of the forty-first embodiment, the lid 16 of the forty-second embodiment, or the periphery of the lid 16, is formed of an elastic polymer, such as rubber, a synthetic rubber, or a thermoplastic elastomer.

Unlike the lid 16 of the forty-first embodiment, the lid 16 of the forty-second embodiment leaves no spaces 75 between the ring 61 and the toe 82. The means of engagement and disengagement are generally similar to the means of engaging and disengaging the ring 61 of the thirty-third embodiment. (FIG. 42; compare with FIG. 33B.) To engage the lid 16 on bin 21, the lid 16 may initially be placed on the bin 21 so that the indentation 91 rests on the toe 82. The lid 16, or the periphery of the lid 16, is then pushed over the toe 82 so that the indentation 91 grips the toe 82 and the cover 17 exerts sufficient downward force at the ridge 83 to secure a liner 35. (FIG. 42; compare with FIG. 33B.) To disengage the lid 16 and to remove any liner 35 from the bin 21, the indentation 91 of the ring 61 may be deliberately pulled upward and outward so that the indentation 91 is pulled above the toe 82, thus freeing the lid 16 to be removed from the bin 21 and permitting removal of a liner 35 and installation of a replacement liner 35.

The forty-third embodiment is a bin assembly that includes a bin 27 and a lid 16. A portion of the bin 21 and a portion of a lid 16 of the forty-third embodiment are depicted in FIG. 39. A liner 35 lines the bin 21. (FIG. 39.). With the exception of the differences described in the following paragraphs, the descriptions applicable to the forty-first embodiment apply equally to the forty-third embodiment.

The bin 21 of the forty-third embodiment includes a ridge 83 at the top of the wall 31. The seat 72, which is less extensive that the seat 72 of the forty-first embodiment, sits between the ridge 83 and the fall 32. As in the thirty-second embodiment, the flare 81 is horizontal and terminates at a brim 24 that includes a notch 59 that opens outward. The lid 16 includes two live hinges 57, each joining an opposing tab 56 to a curved face 68, which is vertically curved. An insert 54 (a type of protrusion) is found on the inner side of each of the two opposing tabs 56. From the cover 17 of the lid 16, a retainer 71 extends downward. (FIG. 43.) Unlike the lid 16 of the forty-first embodiment, the lid 16 of the forty-third embodiment leaves no spaces 75 between the vertical face 65 and the brim 24.

Unlike channel 79 of the forty-first embodiment, the channel 79 of the forty-third embodiment is found between the fall 32 and the wall 31. However, as in the forty-first and twenty-fifth embodiment, the channel 79 allows fingers, or parts of fingers, to be inserted in the channel 79 and further allows the rim 27 to be grasped and the bin assembly to be lifted with one hand without inserting fingers, or parts of fingers, in the chamber 45. (FIG. 43; compare with FIGS. 41 and 25G through 25I.)

The lid 16 secures the liner 35 at the seat 72. (FIG. 39.) The downward force of the retainer 71 holds the liner 35 against the seat 72. (FIG. 39.)

The lid 16 engages with, and disengages from, the bin 21 in a manner similar to that of the ring 61 of the twenty-seventh embodiment. To engage the lid 16, the two latches 55, each of which is attached to a live hinge 57, are closed. (FIG. 43; compare with FIGS. 27A and 27B.) In the forty-third embodiment, when the latches 55 close, the inserts 54 lock into the notches 59 at the brim 24. (FIG. 43.)

To disengage the lid 16, the two latches 55 are pulled open, thereby disengaging the inserts 54 from the notches 59 and permitting removal of the lid 16, removal of the liner 35, and installation of a replacement liner 35. (FIG. 39; compare with FIG. 16F3.)

The forty-fourth embodiment is a bin assembly that includes a bin 27 and a lid 16. A portion of the bin 21 and a portion of a lid 16 of the forty-forth embodiment are depicted in FIG. 44. A liner 35 lines the bin 21. (FIG. 44.). With the exception of the differences described in following paragraphs, the descriptions applicable to the forty-first embodiment apply equally to the forty-fourth embodiment.

Unlike the lid 16 and bin 21 of the forty-first embodiment, the lid 16 and bin 21 of the forty-fourth embodiment do not engage. The bin 21 of the forty-fourth embodiment differs from the bin 21 of the forty-first embodiment in its absence of a fall 32, and the channel 79 is found only between the flare 81 and the wall 31. In the forty-first embodiment, the crest 72 directly joins the flare 81. (FIG. 44.). Further, because the lid 16 of the forty-fourth embodiment does not engage with the bin 21, the lid 16 lacks any engagement means and, unlike the lid 16 of the forty-first embodiment, has neither a tab 56 nor a protuberance 58 (a type of protrusion). At each of two opposing sides of the lid 16, a lift 87 extends horizontally outward from the vertical face 65, (FIG. 44.). The lifts 87 facilitate the lifting of the lid 16 from the bin 21. (FIG. 44.)

Although the bin 21 and lid 16 of the forty-fourth embodiment do not engage, the edge 38 of a liner 35 is contained below the lid 16 and above or on the flare 81. (FIG. 44.) The lid 16 secures the liner 35 at the seat 72. (FIG. 44.) The weight of the lid 16 at the seat 72 holds the liner 35 in place. (FIG. 44.) The liner 35 is released for removal and replacement by lifting the lid 16 from the bin 21. (FIG. 44.)

The forty-fifth embodiment is a bin assembly that includes a bin 21, a lid 16 and a ring 61. A portion of the bin 21, a portion of the lid 16, and a portion of the ring 61 of the forty-fifth embodiment are depicted in the cross-sectional FIG. 45. The portion of the bin 21 depicted in FIG. 45 includes a rim 27 with a liner 35 that lines the bin 21 and is secured by the ring 61. (FIG. 45.)

The ring 61 of the forty-fifth embodiment engages and disengages with the bin 21, and secures and permits removal of the liner 35, in the same fashion as the rings 61 of the seventh and eleventh embodiments. However, other means of engaging and disengaging the ring 61, and securing and removing the liner 35, including but not limited to the means described in other embodiments of this disclosure, also fall within the spirit of this disclosure.

As shown in FIG. 45, the rim 27 of the bin 21 includes a ledge 51, frame 53, a base 49, a vertical lip 29, and a discrete and non-continuous feature, namely, a slot 43, a type of aperture, which contributes to the disengagement of the ring 61. Although not shown in cross-sectional FIG. 45, the rim 27 also includes a horizontal lip 28. (FIG. 45; compare with FIGS. 7N1 through 7N3 and 7Q.) The ring 61 includes a riser 69 and a cap 67. (FIG. 45.) As shown in FIG. 45, the cap 67 does not extend as far outward as the base 49. (FIG. 45; compare with FIGS. 7N1 and 7N3 and 7Q.)

The ring 61 and bin 21 of the forty-fifth embodiment accommodate the lid 16 and, when engaged with the bin 21, the lid 16 extends over all or part of the chamber 45 of the bin 21. (FIG. 45.) Although not shown in FIG. 45, the lid 16 may provide an opening 19 to the chamber 45 and the opening 19 may be either unobstructed or doored. When the lid 16 is removed from the bin 21, the liner 35 remains secured by the ring 61. (FIG. 45.)

As shown in FIG. 45, the lid 16 engages with the bin 21 by a snap fit. Discrete, non-continuous features of the ring 16, specifically, the protuberances 58 (a type of protrusion) and opposing tabs 56 on which the protuberances 58 are found, participate in the engagement and disengagement of the lid 16 in a similar manner to the participation of the protuberances 58 and tabs 56 in the engagement and disengagement of the ring 16 of the twenty-first embodiment. (FIG. 45; compare FIGS. 21D2 and 21E2.) In the forty-fifth embodiment, the protuberances 58 snap below the vertical lip 29. (FIG. 45.) Other means of engagement, including but not limited to the means described in other embodiments of this disclosure, also fall within the spirit of this disclosure. Further, the lid 16 need not engage with the bin 21. (Compare FIG. 45 with FIG. 44.)

To empty the bin 21 of the forty-fifth embodiment, the lid 16 is removed from the bin 21. However, unlike lids 16 of the thirty-seventh through forty-fourth embodiments, when the lid 16 of the forty-fifth embodiment is removed, the liner 35 remains secured by the ring 61. Because the ring 61 secures the liner 35, the lid 16 may be removed and the bin 21 may be overturned and emptied with the liner 35 held in place for subsequent use. If the liner needs to be replaced, the ring 61 may be disengaged by use of the slot 43, a type of aperture. The slot 43 that may be matched with an identical slot 45 at the opposing side the ring. (FIG. 45.)

As in the seventh and eleventh embodiments, in the forty-fifth embodiment the channel 79 is found between the vertical lip 29 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 45; compare with FIGS. 7N1 through 7N3, 7Q and 11.)

The forty-sixth embodiment, like the forty-fifth embodiment, is a bin assembly that includes a bin 21, a lid 16 and a ring 61. A portion of the bin 21, a portion of the lid 16, and a portion of the ring 61 of the forty-sixth embodiment are depicted in the cross-sectional FIG. 46. The portion of the bin 21 depicted in FIG. 46 includes a rim 27 of the bin 21 with a liner 35 that lines the bin 21 and is secured by the ring 61. (FIG. 46.) The above description of the forty-fifth embodiment applies equally to the forty-sixth embodiment except as stated in the paragraphs below.

The ring 61 of the forty-sixth embodiment engages and disengages with the bin 21, and secures and permits removal of the liner 35, in largely the same fashion as the rings 61 of the thirteenth and twentieth embodiments, though the unlike the rings 61 of the thirteenth and twentieth embodiments, the ring of the forty-sixth embodiment does not include opposing gaps 40.

As shown in FIG. 46, the rim 27 includes a crest 26, a fall 32, and a trough 34 that includes a rise 39 and a brim 24. As shown in FIG. 46, the cap 67 does not extend as far outward as the brim 24 (FIG. 46.)

As depicted in FIG. 46, the discrete and non-continuous protuberances 58 (a type of protrusion) snap below the brim 24. As in the thirteenth embodiment, in the forty-sixth embodiment the channel 79 is found between the trough 34 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 46; compare with FIGS. 13E1, 13F, 13G2 and 13G3.)

The forty-seventh embodiment, like the forty-fifth embodiment, is a bin assembly that includes a bin 21, a lid 16 and a ring 61. A portion of the bin 21, a portion of the lid 16, and a portion of the ring 61 of the forty-seventh embodiment are depicted in the cross-sectional FIG. 47. The portion of the bin 21 depicted in FIG. 47 includes a rim 27 with a liner 35 that lines the bin 21 and is secured by the ring 61. (FIG. 47.) The above description of the forty-fifth embodiment applies equally to the forty-seventh embodiment except as stated in the paragraphs below.

The ring 61 of the forty-seventh embodiment engages and disengages with the bin 21, and secures and permits removal of the liner 35, in the largely the same fashion as the ring 61 of the twenty-ninth embodiment, though the unlike the ring of the twenty-ninth embodiment, the ring of the forty-sixth embodiment does not include opposing holes 85. (FIG. 47; compare with FIGS. 29A through 29C.)

As shown in FIG. 47, the rim 27 includes a crest 26, a fall 32, and a flare 81 that includes a toe 82. As shown in FIG. 47, the cap 67 does not extend as far outward as the toe 82. (FIG. 47.)

As depicted in FIG. 47, the discrete and non-continuous protuberances 58 (a type of protrusion) snap below the toe 82.

As in the twenty-fifth and twenty-ninth embodiments, in the forty-seventh embodiment the channel 79 is found between the flare 81 and the wall 31 and between the fall 32 and the wall 31 and again allows fingers, or parts of fingers, to be inserted in the channel 79 and further allows the rim 27 to be grasped and the bin assembly to be lifted with one hand without inserting fingers, or parts of fingers, in the chamber 45. (FIG. 47; compare with FIGS. 25G through 25I, 29B and 29C.)

The forty-eighth embodiment, as shown in FIG. 48, is a bin assembly that includes a bin 21 and a ring 61. A portion of the bin 21 and a portion of the ring 61 embodiment are depicted in the cross-sectional FIG. 48, which shows that the ring 61 is joined to the trough 34 of the bin 21 at a hinge 52. In the forty-eighth embodiment, the ring 61 rotates in the hinge 52 and engages and disengages at the trough 34 at the opposite side of the bin 21. (FIG. 48.) The means of engagement and disengagement at the opposite side of the bin 21 may include any discrete and non-continuous engagement means that fall within the spirit of this disclosure.

The trough 34 of the forty-eighth embodiment is capable of containing a liner 34 and the means of securing a liner include any means that fall within the spirit of this disclosure. (FIG. 48; compare with, e.g., FIG. 15H3.)

In a variation of the forty-eighth embodiment, the hinge 52 joins the trough 34 to a lid 16 which engages and disengages at the opposite side of the bin 21 may include any discrete and non-continuous engagement means that fall within the spirit of this disclosure. The lid 16 may completely cover the mouth 23 of the bin 21, or the lid 16 may not cover the entire mouth 23 but provide an opening 19 to the mouth 23 and the opening 19 may be either unobstructed or doored. (FIG. 48; compare with FIG. 37.) Again, in this variation, the trough 34 of the forty-eighth embodiment is capable of containing a liner 34 and the means of securing a liner 35 include any means that fall within the spirit of this disclosure. (FIG. 48; compare with, e.g., FIG. 37.)

The forty-ninth embodiment, as shown in FIG. 49, is a bin assembly that, like the forty-eighth embodiment, includes a bin 21 and a ring 61. The above description of the forty-eighth applies equally to the forty-ninth except that, in the forty-ninth embodiment, the ring 16 joins the hinge 52 of a flare 81. (FIG. 49.) The flare 81 is capable of stopping the fall of the edge 38 and border 37 of an appropriately sized liner 34 and, together with the ring 16, the flare is capable of containing the liner 34. (FIG. 49; compare with, e.g., FIGS. 25C and 25G through 25I.)

In a variation of the forty-ninth embodiment, the hinge 52 joins the flare 81 to a lid 16 which engages and disengages at the opposite side of the bin 21 may include any discrete and non-continuous engagement means that fall within the spirit of this disclosure. (FIG. 49.) As in the variation of the forty-eighth embodiment, the lid 16 may completely cover the mouth 23 of the bin 21, or the lid 16 may not cover the entire mouth 23 but provide an opening 19 to the mouth 23 and the opening 19 may be either unobstructed or doored. (FIG. 49; compare with FIG. 41.) In this variation, the flare 81 of the forty-ninth embodiment is again capable of stopping the fall of the edge 38 and border 37 of an appropriately sized liner 34 and, together with the lid 16, the flare 81 is capable of containing the liner 34. Further, the means of securing a liner include any means that fall within the spirit of this disclosure. (FIG. 49; compare with, e.g., FIG. 37.)

The fiftieth embodiment, as shown in FIG. 50, is a bin assembly that, like the forty-eighth embodiment, includes a bin 21 and a ring 61. The above description of the forty-eighth applies equally to the fiftieth embodiment except as describe below.

In the fiftieth embodiment, the ring 61 joins the hinge 52 of a vertical lip 29. (FIG. 50; compare with FIG. 11.) The hinge 52 extends horizontally outward and constitutes a flare 81 that is capable of stopping the fall of the edge 38 and border 37 of an appropriately sized liner 34 and, together with the ring 61, is capable of containing the liner 34. (FIG. 50; compare with FIGS. 32C and 43.)

In a variation of the fiftieth embodiment, the hinge 52 joins the vertical lip 21 to a lid 16 which engages and disengages at the opposite side of the bin 21 may include any discrete and non-continuous engagement means that fall within the spirit of this disclosure. (FIG. 50.) As in the variation of the forty-eighth embodiment, the lid 16 may completely cover the mouth 23 of the bin 21, or the lid 16 may not cover the entire mouth 23 but provide an opening 19 to the mouth 23 and the opening 19 may be either unobstructed or doored. (FIG. 50; compare with FIG. 43.) In this variation, the hinge 52 again constitutes a flare 81 that is capable of stopping the fall of the edge 38 and border 37 of an appropriately sized liner 34 and, together with the lid 16, is capable of containing the liner 34. (FIG. 50.) Further, the means of securing a liner include any means that fall within the spirit of this disclosure. (FIG. 50; compare with FIGS. 32C and 43.)

The fifty-first embodiment, shown in FIGS. 51 and 7A through 7R, is a set of liners 35 and a bin and ring assembly of the seventh embodiment such that: (1) each liner 35 of the set of liners 35 may be installed and secured by a ring 61 in the bin 21 of the seventh embodiment, thereby forming a bin assembly that includes a liner 35, (2) each liner 35 of the set of liners 35 may be released and removed from the bin assembly, thus allowing for the replacement of one liner 35 of the set with another liner 35 of the set, (3) each liner 35 of the set of liners 35, when installed and secured by a ring 61 in the bin 21 of the seventh embodiment, provides content information 8 at the rim 27 in one or more of the six forms listed in the description of the twelfth embodiment, and (4) the content information 8 at the rim 27 of each liner 35 is distinguishable in one or more respects from the content information 8 of every other liner 35 of the set.

The liners 35 depicted in FIG. 51 are identified as liners I, II, and III. Each of these liners is associated with the identity or character of the items that are contained or intended to be contained within the bin 21, as described immediately after the list of six forms in the description of the first embodiment.

In addition to the bin assembly described above, this disclosure encompasses all bin assemblies of this disclosure that include a bin 21, a ring 61 and a set of liners 35 as depicted in FIG. 7B and as described above in reference to the seventh embodiment. Thus, like the seventh embodiment, each of the following embodiments—the ninth, eleventh, thirteenth, and fifteenth through fortieth embodiments—may be fitted with the liners 35 of FIG. 51 to form a bin assembly that includes a bin 21, a ring 61, and each alternative liner 35 of the set of liners depicted in FIG. 51 and described above. Each such bin assembly is within the scope of this disclosure. Further, all bin assemblies that include a bin 21 and a ring 61 and that fall within the spirit of this disclosure may be fitted with the liners 35 of FIG. 51 to form bin assemblies that include a bin 21, a ring 61, and each alternative liner 35 of the set of liners depicted in FIG. 51 and described above. Each such bin assembly is also within the scope of this disclosure.

The fifty-second embodiment, shown in FIG. 52 and in FIG. 1A, is a set of placards 10 and a bin 21 of the first embodiment as structurally depicted in FIG. 1A, such that: (1) each placard 10 of the set of placards 10 may be attached to the rim 27 of the bin 21 of the first embodiment thereby forming a bin assembly that includes a placard 10; (2) each placard 10 of the set of placards 10, when attached to the rim 27 of the bin 21 of the first embodiment, provides content information 8 at the rim 27 in one or more of the six forms listed in the description of the twelfth embodiment; and (3) the content information 8 of each placard 10 is distinguishable in one or more respects from the content information 8 of every other placard 10 of the set. The content information 8 pertains to the identity or character of the items that are contained or intended to be contained within the bin 21, as described immediately after the list of six forms in the description of the first embodiment.

The placards 10 depicted in FIG. 52 are identified as placards I, II, and III. Each placard 10 of the set of placards 10 may be attached to the rim 27 of the bin 21 of the first embodiment in such a manner that the content information 8 of the placard 10 is accessible at the rim 27. (FIGS. 52 and 1A; compare with FIG. 1B.) Each placard 10 of the set of placards 10 may be removed from the rim 27 of the bin 21 of the first embodiment in such a manner that another placard 10 of the set of placards 10 may be attached in its place.

This disclosure encompasses all bin assemblies that include a bin 21 and a set of placards 10 as depicted in FIG. 52 and as generally described in the fifty-second embodiment when (1) the bin 21 or (2) the bin 21 and ring 61 are within the spirit of this disclosure, including but not limited to the bins 21 and rings 61 as disclosed in the first through fortieth embodiments and the placards 10 of the set of placards 10 are each attached either to a bin 21 or a ring 61 of the rim 27.

The placards 10 shown in FIG. 52 are essentially rectangular and the informational side of each of the placards 10 shown in FIG. 52 lie in a single plane. However, in this disclosure, "placard 10" and "placards 10" are not limited to a rectangular shape or to having an informational side that lies in a single plane. Placards 10 may be configured to fit the part or parts of the rim to which they attach. Thus, for example, the placards 10 in a set of placards 10 may be curved and may conform to the curved lip 30 of a bin 21 or to the curved face 68 of a ring 61. Also, for example, the placards 10 in a set of placards 10 may conform to a portion of a rim 27 that includes a vertical lip and a horizontal lip or over a portion of a ring 61 that includes a vertical face 65 and a cap 67. Additionally, for example, placards 10 in a set of placard 10 may be configured to snap onto, and off of, a rim 27 or a ring 61 or to include any other attachment and detachment means.

The fifty-third embodiment, shown in FIGS. 53 and 1A, is a set of labels 9 and a bin 21 of the first embodiment as structurally depicted in FIG. 1A, such that: (1) each label 9 of the set of labels 9 may be attached to the rim 27 of the first embodiment thereby forming a bin assembly that includes a label 9; (2) each label 9 of the set of labels 9, when attached to the rim 27 of the first embodiment, provides content information 8 in one or more of the six forms listed in the description of the twelfth embodiment; and (3) the content information 8 of each label 9 is distinguishable in one or more respects from the content information 8 of every other label 9 of the set. The content information 8 pertains to the identity or character of the items that are contained or intended to be contained within the bin 21, as described immediately after the list of six forms in the description of the first embodiment.

The labels 9 depicted in FIG. 53 are identified as labels I, II, and III. Each of the labels 9 of the set of labels depicted in FIG. 53 may be attached to the rim 27, and each of the labels 9 of the set of labels 9 may be attached to each of the other labels 9 of the set. Further, each of the labels 9 of the set may be removed from the rim 27. Thus, each label 9 may be substituted for another label 9 on the rim 27 by overlaying the second label 9 on the first label 9 or by removing the first label 9 and attaching the second label 9 in its place. Each label 9 of the set of labels 9 may be attached to the rim 27 of the first embodiment in such a manner that the content information 8 of the label 9 is accessible at the rim 27. (FIGS. 53 and 1A; compare with FIG. 1B.)

This disclosure encompasses all bin assemblies that include a bin 21 and a set of labels 9 as depicted in FIG. 53 and as generally described in the fifty-third embodiment, when (1) the bin 21, (2) the bin 21 and ring 61, (3) the bin 21 and ring 61 and liner 35, or (4) the bin 21 and ring 61 and placard 10 are within the spirit of this disclosure, including but not limited to the bins 21, rings 61, liners 35, and placards 10 as disclosed in the first through fortieth, fifty-first, and fifty-second embodiments and the labels 9 of the set of labels 9 are each attached to a bin 21, a ring 61, a liner 35, or a placard 10 of the rim 27 or to another label 10 of the rim 27 as disclosed in the fifty-third embodiment.

The labels 9 shown in FIG. 53 are essentially rectangular. However, in this disclosure, "label 9" and "labels 9" are not limited to a rectangular shape. Labels 9 may be configured to fit the part or parts of the rim 27, ring 61, liner 35 or placard 10 to which they attach. Thus, for example, the labels 9 in a set of labels 9 may conform to a conical shape, such as found, for example, on an oblique lip 20 of a bin 21 with a circular mouth or an oblique face 66 of a ring 61 for a bin 21 with a circular mouth.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "front," "back," and similar terms have been used herein to describe a spatial relationship of one element to another, it is understood that these terms are intended to encompass different orientations of the various elements and components of the invention in addition to the orientation depicted in the figures. Additionally, the terms "horizontal" and "vertical" used herein shall mean "substantially horizontal" and "substantially vertical," respectively. Moreover, as used herein, the terms "substantially," "essentially" and similar terms are used as terms of approximation and not as terms of degree, and are intended to account for the inherent deviations in measured or calculated values that would be recognized by those of ordinary skill in the art.

What is claimed is:

1. A bin assembly for receiving or storing one or more items, comprising:

a bin, comprising:

a wall having an upper end and a lower end;

a bottom extending along the lower end of the wall, the wall and the bottom cooperating to define a chamber for receiving or storing the one or more items;

a mouth defined by an upper end of the wall, the mouth in communication with the chamber;

a rim extending outward around a periphery of the mouth and downward from the mouth, the rim having a first end portion proximate to the mouth and a second end portion distal to the mouth, the second end portion being a distalmost portion of the rim relative to a vertical centerline of the bin, the rim comprising at least one of a ridge and a crest at the first end portion; and a channel defined below a lower surface of the rim, the channel configured to facilitate grasping the bin; and one of a ring and a lid configured to fit over a peripheral portion of the rim between the first and second end portions, wherein, when the one of the ring and the lid is fit over the peripheral portion of the rim between the first and second end portions:

the one of the ring and the lid covers an exterior surface of the peripheral portion of the rim between the first and second end portions, a cavity is defined between the rim and the one of the ring and the lid, the cavity being configured to accommodate an edge portion of a liner, the one of the ring and the lid contacts the first end portion of the rim, the contact between the one of the ring and the lid and the first end portion of the rim separating the cavity from the chamber, and wherein, when the one of the ring and the lid is the ring and the ring contacts the first end portion of the rim:

the one of the ridge and the crest separates an innermost portion of the ring from the mouth and the chamber.

2. The bin assembly of claim 1, wherein the rim comprises a downwardly extending flare fixedly coupled to the wall.

3. The bin assembly of claim 2, wherein the channel is wedge-shaped, and wherein the wedge-shaped channel is defined between a lower surface of the flare and an outer surface of the wall.

4. The bin assembly of claim 2, wherein the second end portion of the rim comprises a toe of the flare.

5. The bin assembly of claim 2, further comprising a rise connected to a lowermost end of the flare, and wherein the second end portion of the rim comprises a brim of the rise.

6. The bin assembly of claim 1, wherein the rim comprises a trough fixedly coupled to the wall.

7. The bin assembly of claim 6, wherein the channel is wedge-shaped, and wherein the wedge-shaped channel is defined between a lower surface of the trough and an outer surface of the wall.

8. The bin assembly of claim 7, wherein the rim further comprises a fall fixedly coupled to an uppermost portion of the wall, and wherein the trough is fixedly coupled to a lower end of the fall.

9. The bin assembly of claim 8, further comprising a rise connected to a lowermost end of the trough.

10. The bin assembly of claim 9, wherein the second end portion of the rim comprises a brim of the rise.

11. The bin assembly of claim 9, further comprising a downward turn connected to an upper end of the rise, and wherein the second end portion of the rim comprises an end of the downward turn.

12. The bin assembly of claim 1, wherein the rim comprises an oblique lip fixedly coupled to the wall.

13. The bin assembly of claim 1, wherein the channel extends continuously around the rim.

14. The bin assembly of claim 1, wherein the channel is discontinuous.

15. The bin assembly of claim 1, wherein the rim comprises a fall fixedly coupled to an uppermost portion of the wall and a flare fixedly coupled to a lower end of the fall, and wherein the second end portion of the rim comprises a toe of the flare.

16. The bin assembly of claim 1, further comprising content information on at least a portion of an exterior surface of the one of the ring and the lid, the content information configured to identify the one or more items the bin is intended to receive or store.

17. The bin assembly of claim 16, wherein the content information is selected from the group consisting of a writing, a picture, a symbol, machine-readable code, a surface treatment, and any combination thereof.

18. The bin assembly of claim 16, wherein the content information includes a first one of the content information and a second one of the content information associated with the first one of the content information, the first one of the content information comprising at least one of a color of the one of the ring and the lid different than a color of the bin and a material characteristic of the one of the ring and the lid different than a material characteristic of the bin.

19. The bin assembly of claim 18, wherein the second one of the content information is selected from the group consisting of a writing, a picture, a symbol, machine-readable code, and any combination thereof.

20. The bin assembly of claim 16, wherein the content information further indicates the character of the one or more items, the character information selected from the group consisting of a benefit of the one or more items, a price of the one or more items, a source of the one or more items, manufacturing information regarding the one or more items, processing information regarding the one or more items, use of the one or more items, a destination of the one or more items, information regarding entities or individuals associated with the one or more items, and combinations thereof.

21. The bin assembly of claim 16, wherein the content information does not include information regarding the commercial product name, number, or dimensions of the bin, the name, logo, identifier or contact information of the manufacturer of the bin, the name, logo, identifier or contact information of a manufacturer of a liner of the bin, or the specifications of the liner.

22. The bin assembly of claim 16, further comprising a plurality of labels configured to be coupled to the one of the ring and the lid, and wherein content information on a first one of the plurality of labels is different than content information on a second one of the labels.

23. The bin assembly of claim 16, further comprising a plurality of placards configured to be detachably coupled to the one of the ring and the lid, and wherein content information on a first one of the plurality of placards is different than content information on a second one of the placards.

24. The bin assembly of claim 16, further comprising a plurality of liners configured to be detachably coupled to the bin by the one of the ring and the lid, and wherein content information on a first one of the plurality of liners is different than content information on a second one of the liners.

25. The bin assembly of claim 16, wherein the one of the ring and the lid comprises a plurality of detachable rings, wherein content information on a first one of the plurality of detachable rings is different than content information on a second one of the plurality of detachable rings.

26. The bin assembly of claim 16, wherein the one of the ring and the lid comprises the ring, wherein the ring comprises an oblique face, and wherein the content information is on the oblique face.

27. The bin assembly of claim 16, wherein the rim comprises a non-oblique face, and wherein the content information is on the non-oblique face.

28. The bin assembly of claim 1, wherein the one of the ring and the lid comprises the ring, and the ring is configured to be attached to the rim of the bin.

29. The bin assembly of claim 28, wherein the bin further comprises a seat defined in the rim of the bin, and wherein, when the ring is attached to the bin, an innermost portion of the ring is received in the seat.

30. The bin assembly of claim 29, wherein the rim of the bin further comprises a seat wall, and wherein, when the ring is attached to the bin, the seat wall is disposed between the innermost portion of the ring and the chamber.

31. The bin assembly of claim 28, wherein the bin further comprises a ridge, and wherein, when the ring is attached to the bin, the ridge is between an innermost portion of the ring and the chamber.

32. The bin assembly of claim 28, wherein the bin further comprises a crest, and wherein when the ring is attached to the bin, the crest is between an innermost portion of the ring and the chamber.

33. The bin assembly of claim 28, wherein at least one aperture is defined in the rim of the bin to facilitate disengagement of the ring.

34. The bin assembly of claim 28, wherein the ring comprises an elastic polymer material.

35. The bin assembly of claim 28, further comprising a liner lining the chamber, and wherein a portion of the liner is secured between the ring and the rim of the bin.

36. The bin assembly of claim 28, wherein, when the ring is attached to the rim of the bin, no portion of the ring is shared with an interior surface of the chamber.

37. The bin assembly of claim 1, wherein the one of the ring and the lid comprises at least one discrete and non-continuous engagement mechanism for engaging the rim of the bin.

38. The bin assembly of claim 37, wherein the at least one discrete and non-continuous engagement mechanism comprises a discrete and non-continuous protrusion on an interior surface of the one of the ring and the lid, the protrusion configured to engage a portion of the rim of the bin.

39. The bin assembly of claim 38, wherein the one of the ring and the lid further comprises a tab, and wherein the protrusion is on the tab.

40. The bin assembly of claim 38, wherein an exterior surface of the one of the ring and the lid further comprises a disengagement indicium proximate to the protrusion.

41. The bin assembly of claim 38, wherein the rim of the bin defines a notch configured to receive the protrusion.

42. The bin assembly of claim 38, wherein, when the one of the ring and the lid is engaged with the rim of the bin, the protrusion underlaps a portion of the rim.

43. The bin assembly of claim 37, wherein the discrete and non-continuous engagement mechanism comprises an inwardly extending indentation.

44. The bin assembly of claim 37, wherein the discrete and non-continuous engagement mechanism comprises a latch, the latch configured to rotate between an engaged position and a disengaged position.

45. The bin assembly of claim 44, further comprising a live hinge hingedly coupling the latch to the one of the ring and the lid.

46. The bin assembly of claim 44, wherein the latch further comprises a hook configured to detachably engage a portion of the rim.

47. The bin assembly of claim 44, wherein the latch further comprises a protrusion configured to detachably engage a portion of the rim of the bin.

48. The bin assembly of claim 37, wherein the one of the ring and lid is configured to detachably engage the rim of the bin with a snap fit or a friction fit connection.

49. The bin assembly of claim 37, wherein the rim of the bin comprises a hinge hingedly coupling the one of the ring and the lid to the rim of the bin.

50. The bin assembly of claim 37, further comprising the other of the ring and the lid configured to engage the rim of the bin.

51. A bin assembly for receiving or storing one or more items, comprising:

a bin, comprising:

a wall having an upper end and a lower end;

a bottom extending along the lower end of the wall, the wall and the bottom cooperating to define a chamber for receiving or storing the one or more items;

a mouth defined by an upper end of the wall, the mouth in communication with the chamber;

a rim extending outward around a periphery of the mouth and downward from the mouth, the rim having a first end portion proximate to the mouth and a second end portion distal to the mouth, the second end portion being a distalmost portion of the rim relative to a vertical centerline of the bin, the rim comprising at least one of a ridge and a crest at the first end portion;

a channel defined below a lower surface of the rim, the channel configured to facilitate grasping the bin; and a ring configured to fit over a peripheral portion of the rim between the first and second end portions, wherein, when the ring is fit over the peripheral portion of the rim between the first and second end portions:

the ring covers an exterior surface of the peripheral portion of the rim between the first and second end portions, a cavity is defined between the rim and the ring, the cavity being configured to accommodate an edge portion of a liner, the ring contacts the first end portion of the rim, the contact between the ring and the first end portion of the rim separating the cavity from the chamber, and the one of the ridge and the crest separates an innermost portion of the ring from the mouth and the chamber.

* * * * *